US010787828B2

(12) United States Patent
Itagaki et al.

(10) Patent No.: US 10,787,828 B2
(45) Date of Patent: Sep. 29, 2020

(54) BINDING MACHINE

(71) Applicant: MAX CO., LTD., Chuo-ku, Tokyo (JP)

(72) Inventors: Osamu Itagaki, Tokyo (JP); Takeshi Morijiri, Tokyo (JP); Tatsunori Sera, Tokyo (JP); Takuya Chigira, Tokyo (JP); Kazuhisa Takeuchi, Tokyo (JP); Sadayoshi Takeuchi, Tokyo (JP)

(73) Assignee: MAX CO., LTD., Tokyo (JP)

( * ) Notice: Subject to any disclaimer, the term of this patent is extended or adjusted under 35 U.S.C. 154(b) by 283 days.

(21) Appl. No.: 15/577,260

(22) PCT Filed: Jul. 21, 2016

(86) PCT No.: PCT/JP2016/071409
§ 371 (c)(1),
(2) Date: Nov. 27, 2017

(87) PCT Pub. No.: WO2017/014266
PCT Pub. Date: Jan. 26, 2017

(65) Prior Publication Data

US 2018/0148943 A1 May 31, 2018

(30) Foreign Application Priority Data

Jul. 22, 2015 (JP) ..... 2015-145282
Jul. 22, 2015 (JP) ..... 2015-145286
Jul. 8, 2016 (JP) ..... 2016-136066

(51) Int. Cl.
*E04G 21/22* (2006.01)
*E04G 21/12* (2006.01)
(Continued)

(52) U.S. Cl.
CPC ..... *E04G 21/122* (2013.01); *B65B 13/18* (2013.01); *B65B 13/28* (2013.01); *B65B 13/32* (2013.01);
(Continued)

(58) Field of Classification Search
CPC ..... E04G 21/122; E04G 21/123; B65B 13/18; B65B 13/32; B65B 13/28; B65B 13/183;
(Continued)

(56) References Cited

U.S. PATENT DOCUMENTS 5,682,927 A * 11/1997 Takahashi ..... B65B 13/28 140/119
5,944,064 A 8/1999 Saito et al.
(Continued)

FOREIGN PATENT DOCUMENTS

CL 2009001205 A1 6/2010
CL 2009001206 A1 9/2010
(Continued)

OTHER PUBLICATIONS

English translate (CN2090362U), retrieved date Jan. 10, 2020.*
(Continued)

*Primary Examiner* — Adam J Eiseman
*Assistant Examiner* — Mohammed S. Alawadi
(74) *Attorney, Agent, or Firm* — Rothwell, Figg, Ernst & Manbeck, P.C.

(57) ABSTRACT

The reinforcing bar binding machine which is capable of surely wrapping and binding a wire to a binding object. The reinforcing bar binding machine includes a magazine in which two wires are housed so as to be drawable, a curl guide unit which winds the arranged wires around the reinforcing bar, by the operation of feeding the parallel wires at the curl guide unit to wind around the reinforcing bar, a wire feeding unit which feeds the wires so that they are wound around the reinforcing bar, and a binding unit which twists an intersecting portion between one end side and the other end side of the wires wound around the reinforcing bar.

24 Claims, 48 Drawing Sheets

(51) Int. Cl.
*B65B 13/18* (2006.01)
*B65B 13/32* (2006.01)
*B65B 13/28* (2006.01)

(52) U.S. Cl.
CPC ..... *E04G 21/123* (2013.01); *B65B 13/183* (2013.01); *B65B 13/186* (2013.01)

(58) Field of Classification Search
CPC ..... B65B 13/186; B65B 13/04; B21F 7/00; B21F 715/04
USPC ..... 156/111; 140/93.6, 118, 149
See application file for complete search history.

(56) References Cited

U.S. PATENT DOCUMENTS

| | | | |
|---|---|---|---|
| 6,136,118 | A | 10/2000 | Bartholomew et al. |
| 2005/0005991 | A1 | 1/2005 | Ishikawa et al. |
| 2005/0061389 | A1* | 3/2005 | Nakagawa ..... E04G 21/122 140/119 |
| 2006/0254666 | A1 | 11/2006 | Kusakari et al. |
| 2009/0283167 | A1 | 11/2009 | Nakagawa et al. |
| 2009/0283168 | A1* | 11/2009 | Kusakari ..... E04G 21/122 140/119 |
| 2009/0283170 | A1 | 11/2009 | Nagaoka |
| 2009/0283171 | A1 | 11/2009 | Nagaoka et al. |
| 2014/0091171 | A1 | 4/2014 | Nakagawa et al. |
| 2015/0266082 | A1 | 9/2015 | Horn |
| 2018/0155940 | A1 | 6/2018 | Nagaoka et al. |
| 2018/0161848 | A1 | 6/2018 | Itagaki et al. |

FOREIGN PATENT DOCUMENTS

| | | | | |
|---|---|---|---|---|
| CL | 2009001207 | A1 | | 9/2010 |
| CL | 2015000677 | A1 | | 7/2015 |
| CL | 2017003252 | A1 | | 6/2018 |
| CN | 2090362 | U | * | 12/1991 |
| CN | 2090362 | U | | 12/1991 |
| CN | 101585422 | A | | 11/2009 |
| JP | 0715502 | U | | 3/1995 |
| JP | 08277632 | A | | 10/1996 |
| JP | 10-245006 | A | | 9/1998 |
| JP | 11207505 | A | | 8/1999 |
| JP | 2001-502646 | A | | 2/2001 |
| JP | 2005-170489 | A | | 6/2005 |
| JP | 4747454 | B2 | | 8/2011 |
| JP | 2011-207505 | A | | 10/2011 |
| JP | 2014-169122 | A | | 9/2014 |
| SU | 311515 | A1 | | 12/1977 |
| TW | I333013 | B | | 11/2010 |
| WO | 95/05313 | A1 | | 2/1995 |

OTHER PUBLICATIONS

International Search Report dated Oct. 18, 2016 in PCT/JP2016/071409 (5 pages) and Written Opinion of the International Search Authority (3 pages).
Office Action dated Nov. 19, 2018 in corresponding Russian Patent Application No. 2017144208 (with an English translation)(11 pages).
European Search Report issued in Application No. 16827826.5, dated Apr. 18, 2019, 7 pages.
Further Examination Report dated Oct. 12, 2018 in corresponding New Zealand Patent Application No. 738556 (2 pages).
Australian Office Action issued in Application No. 2016294894, dated Mar. 5, 2019 (6 pages).
Office Action issued for Chilean patent application 201703253 dated Mar. 12, 2020, 20 pages.

* cited by examiner

L2 : L1 = 1.0 : 1.2 OR MORE

BINDING MACHINE

CROSS REFERENCE TO RELATED APPLICATION

This application is a 35 U.S.C. 371 National Phase Entry Application from PCT/JP2016/071409, filed Jul. 21, 2016, which claims priority to Japanese Patent Application Nos. 2015-145282, filed Jul. 22, 2015; 2015-145286, filed Jul. 22, 2015; and 2016-136066, filed Jul. 8, 2016, the disclosures of which are incorporated herein in their entirety by reference.

TECHNICAL FIELD

The present invention relates to a binding machine for binding a binding object such as reinforcing bars with a wire.

BACKGROUND ART

In the related art, there has been suggested a binding machine called a reinforcing bar binding machine which winds a wire around two or more reinforcing bars and twists the wound wire to bind the two or more reinforcing bars.

The reinforcing bar binding machine according to the related art has a configuration in which one wire made of a metal is wound around the reinforcing bar, and a position at which one end side and the other end side of the wire wound around the reinforcing bar intersect with each other is twisted to bind the reinforcing bar (for example, refer to Patent Literature 1).

CITATION LIST

Patent Literature

[Patent Literature 1]: Japanese Patent No. 4747454

SUMMARY

Technical Problem

It is necessary for the wire used in the reinforcing bar binding machine to secure such strength as to bind the reinforcing bars and maintain the reinforcing bars in the bound state. That is, the wire is required to have strength that cannot be unintentionally broken due to the action of being twisted by the reinforcing bar binding machine or the like. In addition, the wire needs to have strength that cannot be broken even after binding. Furthermore, the bound wire needs to be sufficiently strong so that the twisted section does not loosen and does not come off. In the following description, the strength required for the wire is collectively referred to as a binding strength.

In the reinforcing bar binding machine, for example, a relatively thick wire exceeding 1.5 mm in diameter is used to secure the binding strength of the reinforcing bars. However, if a wire with a large diameter is used, since the rigidity of the wire is enhanced, a large force is required for binding the reinforcing bars.

The present invention has been made to solve such problems, and an object thereof is to provide a binding machine capable of ensuring the binding strength of a binding object with a small force.

Solution to Problem

In order to solve the above-described problems, the present invention provides a binding device which includes a feeding unit that is capable of feeding two or more wires and winding the wires around a binding object, and a binding unit that binds the binding object by gripping and twisting the two or more wire wound around the binding object by the feeding unit.

Advantageous Effects of the Invention

In the binding machine of the present invention, since the rigidity of each wire can be lowered using two or more wires, it is possible to secure the binding strength of the binding object with a small force.

DETAILED DESCRIPTION

Hereinafter, an example of a reinforcing bar binding machine as an embodiment of a binding machine of the present invention will be described with reference to the drawings.

<Example of Configuration of Reinforcing Bar Binding Machine of the Embodiment>

Figure 1:
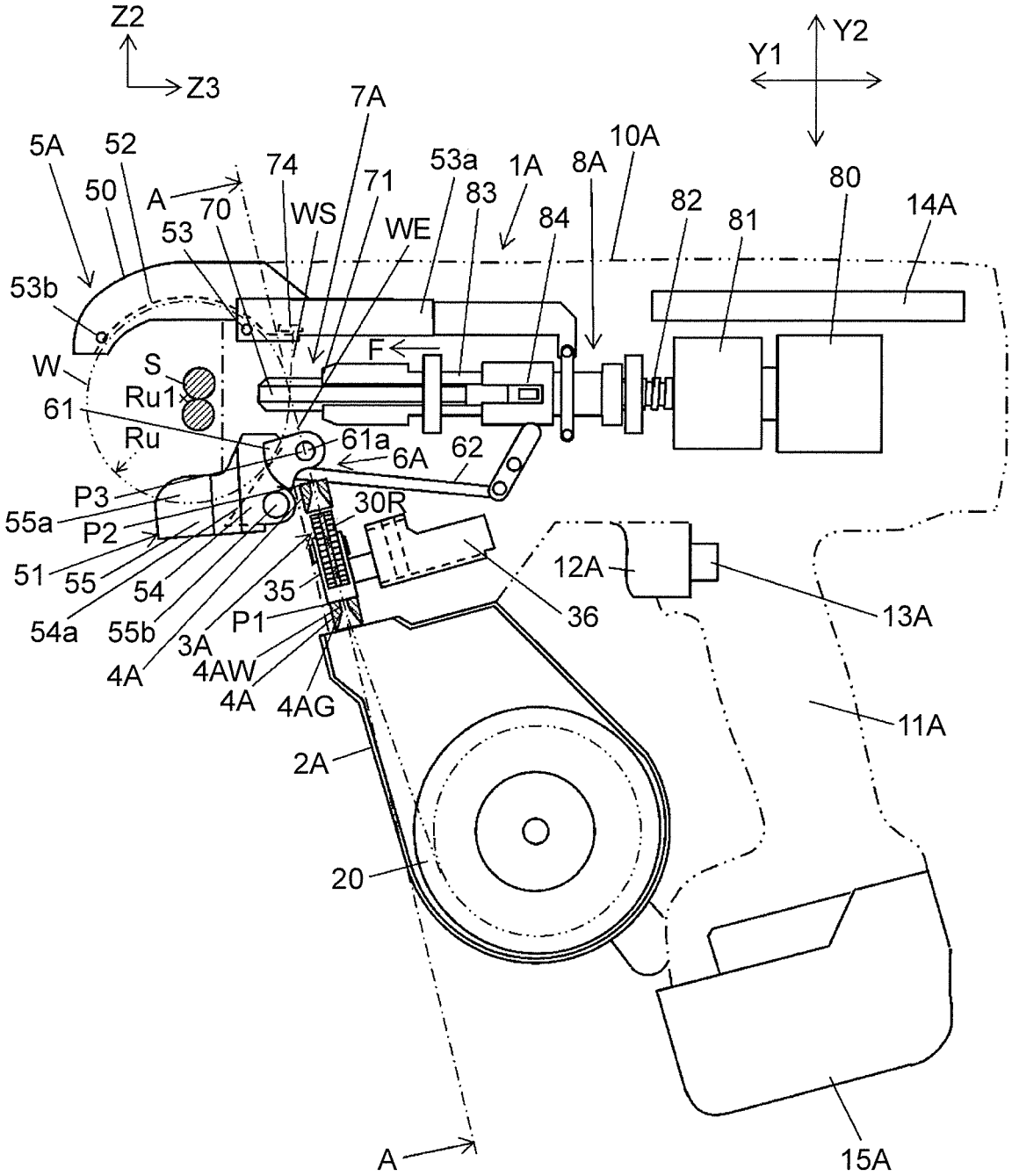
FIG. 1 is a view of an example of an overall configuration of a reinforcing bar binding machine of the present embodiment as viewed from the side.
Figure 2:
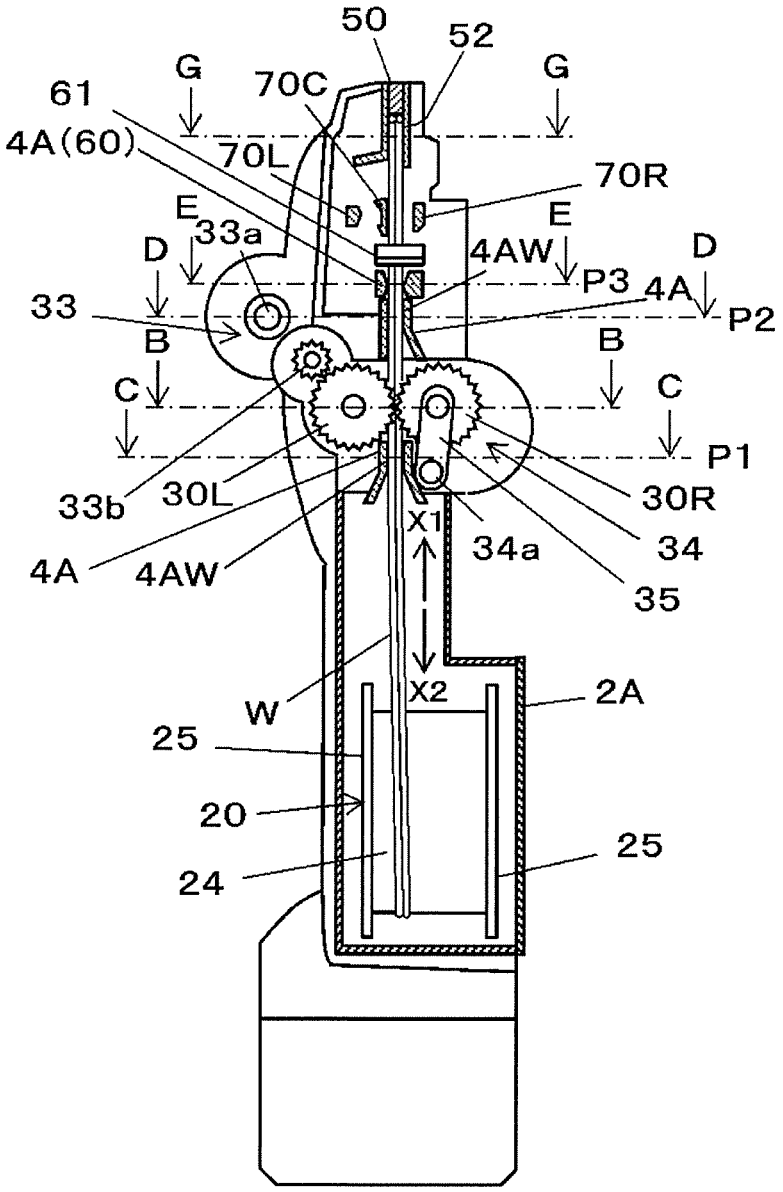
FIG. 2 is a front view illustrating an example of the overall configuration of the reinforcing bar binding machine of the present embodiment as viewed from the front.

FIG. 1 is a view of an example of the overall configuration of a reinforcing bar binding machine according to the present embodiment as seen from a side, and FIG. 2 is a view illustrating an example of the overall configuration of the reinforcing bar binding machine of the present embodiment as seen from a front. Here, FIG. 2 schematically illustrates the internal configuration of the line A-A in FIG. 1.

The reinforcing bar binding machine 1A of the present embodiment binds the reinforcing bar S, which is a binding object, by using two or more wires W having a diameter smaller compared to a conventional wire having a large diameter. In the reinforcing bar binding machine 1A, as will be described later, by the operation of winding the wire W around the reinforcing bar S, the operation of winding the wire W wound around the reinforcing bar S in close contact with the reinforcing bar S, and the operation of twisting the wire wound around the reinforcing bar S, the reinforcing bar S is bound with the wire W. In the reinforcing bar binding machine 1A, since the wire W is bent in any of the operations described above, by using the wire W having a smaller diameter than the conventional wire, the wire is wound on the reinforcing bar S with less force, and it is possible to twist the wire W with less force. Further, by using two or more wires, it is possible to secure the binding strength of the reinforcing bar S by the wire W. In addition, by arranging two or more wires W to be fed in parallel, the time required for winding the wire W can be shortened compared with the operation of winding the reinforcing bar twice or more with one wire. It should also be noted that winding the wire W around the reinforcing bar S and winding the wire W wound around the reinforcing bar S in close contact with the reinforcing bar S is collectively referred to as winding the wire W. The wire W may be wound on a binding object other than the reinforcing bar S. Here, as the wire W, a single wire or a twisted wire made of a metal that can be plastically deformed is used.

The reinforcing bar binding machine 1A includes a magazine 2A that is a housing unit that houses the wire W, a wire feeding unit 3A that feeds the wire W housed in the magazine 2A, a parallel guide 4A for arranging the wires W fed to the wire feeding unit 3A and the wires W fed out from the wire feeding unit 3A in parallel. The reinforcing bar binding machine 1A further includes a curl guide unit 5A that winds the wires W fed out in parallel around the reinforcing bar S, and a cutting unit 6A that cuts the wire W wound around the reinforcing bar S. Further, the reinforcing bar binding machine 1A includes a binding unit 7A that grips and twists the wire W wound around the reinforcing bar S.

The magazine 2A is an example of a housing unit. In the embodiment, a reel 20, having two long wires W wound thereon in a drawable manner, is detachably housed in the magazine.

Figure 3A:
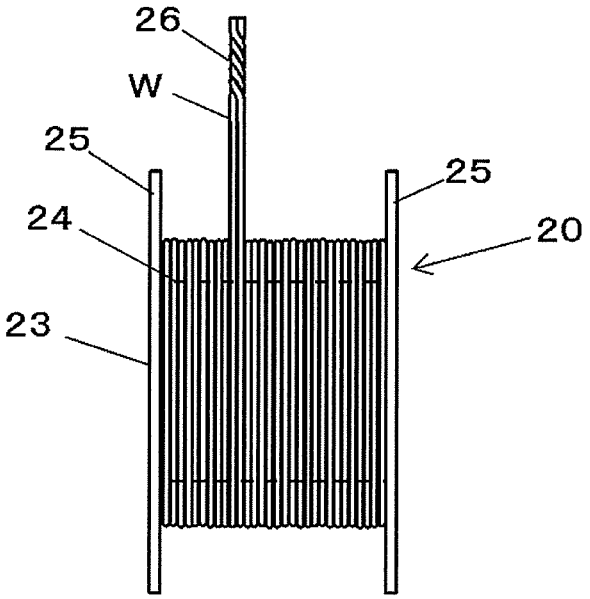
FIG. 3A is a view illustrating an example of a reel and a wire of the present embodiment.

FIG. 3A is a view illustrating an example of the reel and the wire of the present embodiment. The reel 20 includes a core portion 24 on which the wire W is wound and flange portions 25 provided on both end sides along the axial direction of the core portion 24. The diameter of the flange portion 25 is larger than that of the core portion 24, and the wire W wound around the core portion 24 is suppressed from coming off.

The wire W wound around the reel 20 is wound in a state that a plurality of wires W, in this example, two wires W are arranged side by side in a direction along the axial direction of the core portion 24 in a drawable manner. In the reinforcing bar binding machine 1A, while the reel 20 housed in the magazine 2A rotates, the two wires W are fed out from the reel 20 through the operation of feeding the two wires W by the wire feeding unit 3A and the operation of feeding the two wires W manually. At this time, the two wires W are wound around the core portion 24 so that the two wires W are fed out without being twisted. The two wires W are joined such that a part (joint part or joint section 26) is provided on a tip portion or leading end portion to be fed out from the reel 20.

Figure 3B:
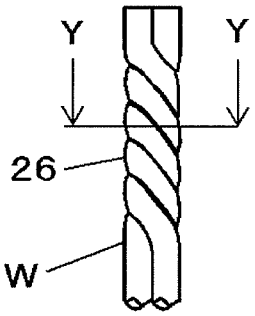
FIG. 3B is a plan view illustrating an example of a joint unit of a wire.
Figure 3C:
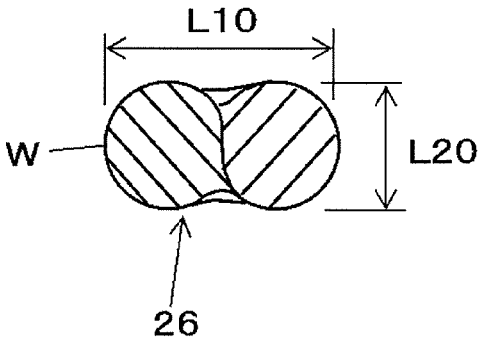
FIG. 3C is a cross-sectional view illustrating an example of a joint unit of a wire.

FIG. 3B is a plan view illustrating an example of a joint unit or joint section of the wire, and FIG. 3C is a cross-sectional view illustrating an example of the joint unit of the wire taken along the line Y-Y in FIG. 3B. In the joint part 26, the two wires W are twisted together such that the two wires W intersect or are intertwined with each other. As illustrated in FIG. 3C, the sectional shape illustrated in the cross sectional view taken along line Y-Y of FIG. 3B is molded in accordance with the shape of the parallel guide 4A so that the wire can pass through the parallel guide 4A. When the two wires W are twisted, the length in the lateral direction of the twisted portion is slightly longer than the diameter of one wire W. Therefore, in this example, after a part of the two wires W is twisted in the joint part 26, the twisted portion is crushed or conformed according to the shape of the parallel guide 4A. In this example, as illustrated in FIG. 3C, the joint part 26 after molding has a length L10 in the longitudinal direction substantially the same length as the diameter r of two wires W in the form in which two wires W are arranged along the cross-sectional direction and a length L20 in the lateral direction substantially the same length as the diameter r of one wire W. The twisted section is provided at or near the leading tip of the reel, and the reel is supplied in that state and inserted in the housing.

The wire feeding unit 3A is an example of a wire feeding unit constituting a feeding unit and includes a first feed gear 30L and a second feed gear 30R as a pair of feeding members for feeding the parallel wires W, the first feed gear 30L has a spur gear shape which feeds the wire W by a rotation operation, and the second feed gear 30R also has a spur gear shape which sandwiches the wire W with the first feed gear 30L. Although the details of the first feed gear 30L and the second feed gear 30R will be described later, the first feed gear 30L and the second feed gear 30R have a spur gear shape in which teeth are formed on the outer peripheral surface of a disk-like member. The first feed gear 30L and the second feed gear 30R are meshed with each other, and the driving force is transmitted from one feed gear to the other feed gear, so that the two wires W can be appropriately fed, however, the drive coupling is not limited to a spur gear arrangement.

The first feed gear 30L and the second feed gear 30R are each formed of a disk-shaped member. In the wire feeding unit 3A, the first feed gear 30L and the second feed gear 30R are provided so as to sandwich the feed path of the wire W, so that the outer peripheral surfaces of the first feed gear 30L and the second feed gear 30R face each other. The first feed gear 30L and the second feed gear 30R sandwich the two parallel wires W between portions opposing to the outer peripheral surface. The first feed gear 30L and the second feed gear 30R feed two wires W along the extending direction of the wire W in a state where the two wires W are arranged in parallel with each other.

Figure 4:
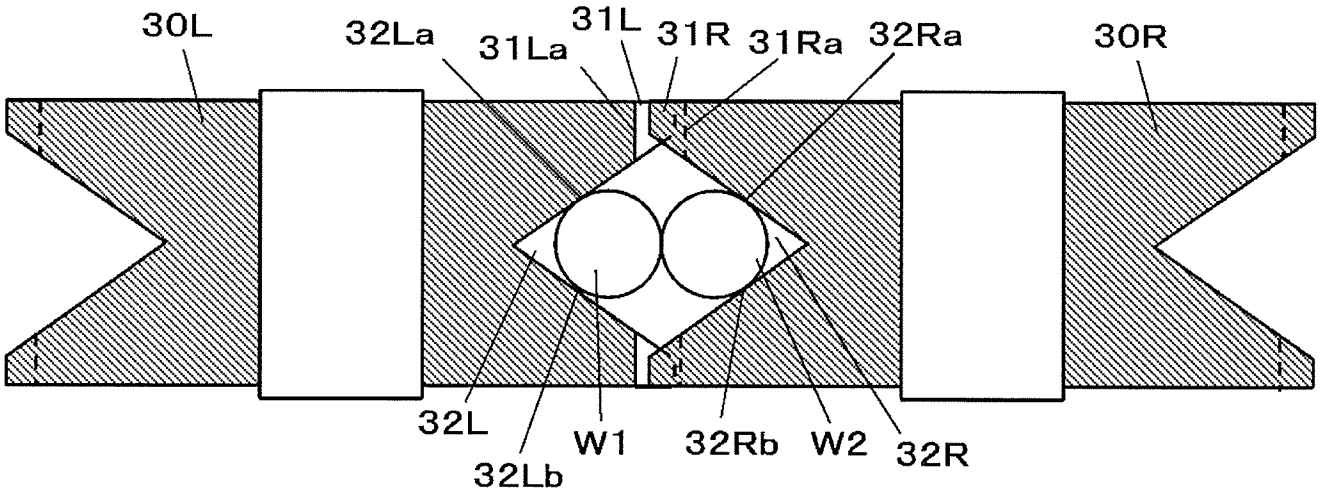
FIG. 4 is a view illustrating an example of a feed gear according to the present embodiment.

FIG. 4 is an assembly or operational view illustrating an example of the feed gear of this embodiment. FIG. 4 is a sectional view taken along the line B-B of FIG. 2. The first feed gear 30L includes a tooth portion 31L on its outer peripheral surface. The second feed gear 30R includes a tooth portion 31R on its outer peripheral surface.

The first feed gear 30L and the second feed gear 30R are arranged in parallel with each other so that the teeth portions 31L and 31R face each other. In other words, the first feed gear 30L and the second feed gear 30R are arranged in parallel in a direction along the axial direction Ru1 of a loop Ru formed by the wire W wound by the curl guide unit 5A, that is, along the axial direction of the virtual circle in which the loop Ru formed by the wire W is regarded as a circle. In the following description, the axial direction Ru1 of the loop Ru formed by the wire W wound by the curl guide unit 5A is also referred to as the axial direction Ru1 of the loop-shaped wire W.

The first feed gear 30L includes a first feed groove 32L on its outer peripheral surface. The second feed gear 30R includes a second feed groove 32R on its outer peripheral surface. The first feed gear 30L and the second feed gear 30R are arranged such that the first feed groove 32L and the second feed groove 32R face each other and the first feed groove 32L and the second feed groove 32R form a pinching portion.

The first feed groove 32L is formed in a V-groove shape on the outer peripheral surface of the first feed gear 30L along the rotation direction of the first feed gear 30L. The first feed groove 32L has a first inclined surface 32La and a second inclined surface 32Lb forming a V-shaped groove. The first feed groove 32L has a V-shaped cross section so that the first inclined surface 32La and the second inclined surface 32Lb face each other at a predetermined angle. When the wires W are held between the first feed gear 30L and the second feed gear 30R in parallel, the first feed groove 32L is configured such that one wire among the outermost wires of the wires W arranged in parallel, in this example, a part of the outer peripheral surface of one wire W1 of the two wires W arranged in parallel is in contact with the first inclined surface 32La and the second inclined surface 32Lb.

The second feed groove 32R is formed in a V-groove shape on the outer peripheral surface of the second feed gear 30R along the rotation direction of the second feed gear 30R. The second feed groove 32R has a first inclined surface 32Ra and a second inclined surface 32Rb that form a V-shaped groove. Similarly to the first feed groove 32L, the second feed groove 32R has a V-shaped cross-sectional shape, and the first inclined surface 32Ra and the second inclined surface 32Rb face each other at a predetermined angle. When the wire W is held between the first feed gear 30L and the second feed gear 30R in parallel, the second feed groove 32R is configured such that, the other wire among the outermost wires of the wires W arranged in parallel, in this example, a part of the outer peripheral surface of the other wire W2 of the two wires W arranged in parallel is in contact with the first inclined surface 32Ra and the second inclined surface 32Rb.

When the wire W is pinched between the first feed gear 30L and the second feed gear 30R, the first feed groove 32L is configured with a depth and an angle (between the first inclined surface 32La and the second inclined surface 32Lb) such that a part, on the side facing the second feed gear 30R, of one wire W1 in contact with the first inclined surface 32La and the second inclined surface 32Lb protrudes from the tooth bottom circle 31La of the first feed gear 30L.

When the wire W is pinched between the first feed gear 30L and the second feed gear 30R, the second feed groove 32R is configured with a depth and an angle (between the first inclined surface 32Ra and the second inclined surface 32Rb) such that a part, on the side facing the first feed gear 30L, of the other wire W2 in contact with the first inclined surface 32Ra and the second inclined surface 32Rb protrudes from the tooth bottom circle 31Ra of the second feed gear 30R.

As a result, the two wires W pinched between the first feed gear 30L and the second feed gear 30R are arranged such that one wire W1 is pressed against the first inclined surface 32La and the second inclined surface 32Lb of the first feed groove 32L, and the other wire W2 is pressed against the first inclined surface 32Ra and the second inclined surface 32Rb of the second feeding groove 32R. Then, one wire W1 and the other wire W2 are pressed against each other. Therefore, by rotation of the first feed gear 30L and the second feed gear 30R, the two wires W (one wire W1 and the other wire W2) are simultaneously fed between the first feed gear 30L and the second feed gear 30R while being in contact with each other. In this example, the first feed groove 32L and the second feed groove 32R have a V-shaped cross-sectional shape, but it is not necessarily limited to the V-groove shape, and it may be, for example, a trapezoidal shape or an arcuate shape. Further, in order to transmit the rotation of the first feed gear 30L to the second feed gear 30R, between the first feed gear 30L and the second feed gear 30R, a transmission mechanism including an even number of gears or the like for rotating the first feed gear 30L and the second feed gear 30R in opposite directions to each other may be provided.

The wire feeding unit 3A includes a driving unit 33 for driving the first feed gear 30L and a displacement unit 34 for pressing and separating the second feed gear 30R against the first feed gear 30L.

The driving unit 33 includes a feed motor 33*a* for driving the first feed gear 30L and a transmission mechanism 33*b* including a combination of a gear and the like for transmitting the driving force of the feed motor 33*a* to the first feed gear 30L.

In the first feed gear 30L, the rotation operation of the feed motor 33*a* is transmitted via the transmission mechanism 33*b* and the first feed gear 30L rotates. In the second feed gear 30R, the rotation operation of the first feed gear 30L is transmitted to the tooth portion 31R via the tooth portion 31L and the second feed gear 30R rotates in accordance with the first feed gear 30L.

As a result, by the rotation of the first feed gear 30L and the second feed gear 30R, due to the frictional force generated between the first feed gear 30L and the one wire W1, the friction force generated between the second feed gear 30R and the other wire W2, and the frictional force generated between the one wire W1 and the other wire W2, the two wires W are fed in a state of being arranged in parallel with each other.

By switching the forward and backward directions of the rotation direction of the feed motor 33*a*, the wire feeding unit 3A switches the direction of rotation of the first feed gear 30L and the direction of rotation of the second feed gear 30R, and the forward and reverse of the feeding direction of the wire W are switched.

In the reinforcing bar binding machine 1A, by forward rotation of the first feed gear 30L and the second feed gear 30R in the wire feeding unit 3A, the wire W is fed in the forward direction indicated by the arrow X1, that is, in the direction of the curl guide unit 5A and is wound around the reinforcing bar S at the curl guide unit 5A. Further, after the wire W is wound around the reinforcing bar S, the first feed gear 30L and the second feed gear 30R are reversely rotated, whereby the wire W is fed in the backward direction indicated by the arrow X2, that is, in the direction of the magazine 2A (pulled back). The wire W is wound around the reinforcing bar S and then pulled back, whereby the wire W is brought into close contact with the reinforcing bar S.

FIGS. 5A, 5B, 5C, and 5D are views illustrating an example of the displacement unit of the present embodiment. The displacement unit 34 is an example of a displacement unit, and includes a first displacement member 35 that displaces the second feed gear 30R in a direction in which the second feed gear 30R is brought into close contact and separated with/from the first feed gear 30L in the rotation operation with the shaft 34*a* illustrated in FIG. 2 as a fulcrum and a second displacement member 36 that displaces the first displacement member 35. The second feed gear 30R is pressed in the direction of the first feed gear 30L by a spring 37 that biases the second displacement member 36 that is displaced by a rotational operation with the shaft 36*a* as a fulcrum. Thus, in this example, the two wires W are held between the first feed groove 32L of the first feed gear 30L and the second feed groove 32R of the second feed gear 30R. Further, the tooth portion 31L of the first feed gear 30L and the tooth portion 31R of the second feed gear 30R mesh with each other. Here, in the relationship between the first displacement member 35 and the second displacement member 36, by displacing the second displacement member 36 to bring the first displacement member 35 into a free state, the second feed gear 30R can be separated from the first feed gear 30L. However, the first displacement member 35 and the second displacement member 36 may be interlocked with each other.

The displacement unit 34 includes an operation button 38 for pressing the second displacement member 36 and a release lever 39 for locking and unlocking the operation button 38. The operation button 38 is an example of an operation member, protrudes outward from the main body 10A, and is supported so as to be movable in directions indicated by arrows T1 and T2.

The operation button 38 has a first locking recess 38*a* and a second locking recess 38*b*. The release lever 39 is locked to the first locking recess 38*a* at a wire feed position where the wire W can be fed by the first feed gear 30L and the second feed gear 30R. The release lever 39 is locked to the second locking recess 38*b* at a wire loading position where the wire W can be loaded by separating the first feed gear 30L and the second feed gear 30R.

The release lever 39 is an example of a release member and is supported so as to be movable in directions indicated by arrows U1 and U2 intersecting the movement direction of the operation button 38. The release lever 39 includes a locking protrusion 39*a* to be locked to the first locking recess 38*a* and the second locking recess 38*b* of the operation button 38.

Figure 5A:
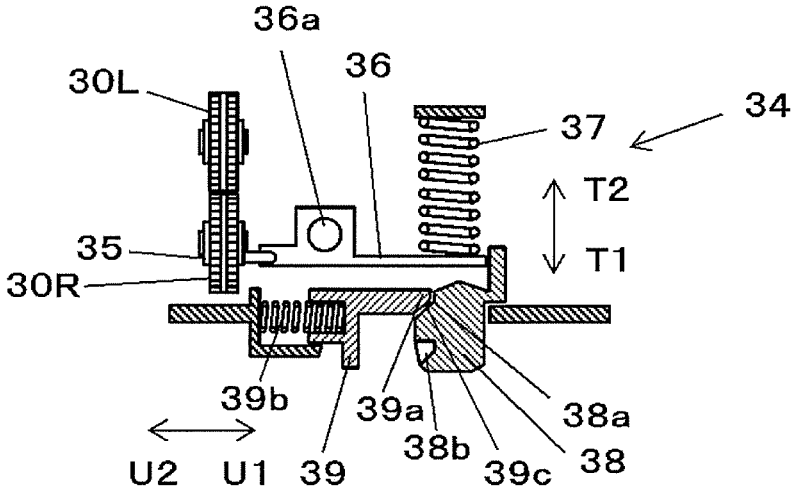
FIG. 5A is a view illustrating an example of a displacement unit of the present embodiment.
Figure 5B:
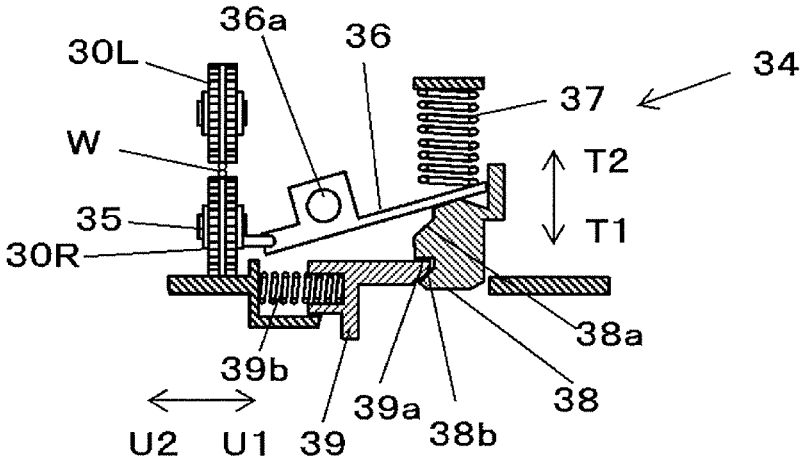
FIG. 5B is a view illustrating an example of a displacement unit of the present embodiment.

The release lever 39 is biased by a spring 39*b* in the direction of the arrow U1 approaching the operation button 38 and is locked such that the locking protrusion 39*a* enters the first locking recess 38*a* of the operation button 38 in the wire feed position shown in FIG. 5A, or the locking protrusion 39*a* enters the second locking recess 38*b* of the operation button 38 in the wire loading position shown in FIG. 5B.

A guide slope 39*c* along the movement direction of the operation button 38 is formed on the locking protrusion 39*a*. In the release lever 39, the guide slope 39*c* is pushed by the operation in which the operation button 38 at the wire feed position is pushed in the direction of the arrow T2, and the locking protrusion 39*a* disengages from the first locking recess 38*a*, whereby the release lever 39 is displaced in a direction of the arrow U2.

The displacement unit 34 includes the second displacement member 36 in a direction substantially orthogonal to the feeding direction of the wire W fed by the first feed gear 30L and the second feed gear 30R in the wire feeding unit 3A, behind the first feed gear 30L and the second feed gear 30R, that is, on the side of the handle unit 11A with respect to the wire feeding unit 3A in the main body 10A. Also, the operation button 38 and the release lever 39 are provided behind the first feed gear 30L and the second feed gear 30R, that is, on the handle unit 11A side with respect to the wire feeding unit 3A in the main body 10A.

As illustrated in FIG. 5A, when the operation button 38 is in the wire feed position, the locking protrusion 39*a* of the release lever 39 is locked to the first locking recess 38*a* of the operation button 38, and the operation button 38 is held at the wire feed position.

As illustrated in FIG. 5A, in the displacement unit 34, when the operation button 38 is in the wire feed position, the second displacement member 36 is pressed by the spring 37, and the second displacement member 36 rotates about the shaft 36*a* as a fulcrum, and is displaced in a direction where the second feed gear 30R presses against the first feed gear 30L.

As illustrated in FIG. 5B, in the displacement unit 34, when the operation button 38 is in the wire loading position, the locking protrusion 39*a* of the release lever 39 is locked to the second locking recess 38*b* of the operation button 38 and the operation button 38 is held at the wire loading position.

As illustrated in FIG. 5B, in the displacement unit 34, when the operation button 38 is in the wire loading position, the second displacement member 36 is pressed by the operation button 38 and the second displacement member 36 displaces the second feed gear 30R in a direction away from the first feed gear 30L with the shaft 36*a* as a fulcrum.

Figure 6A:
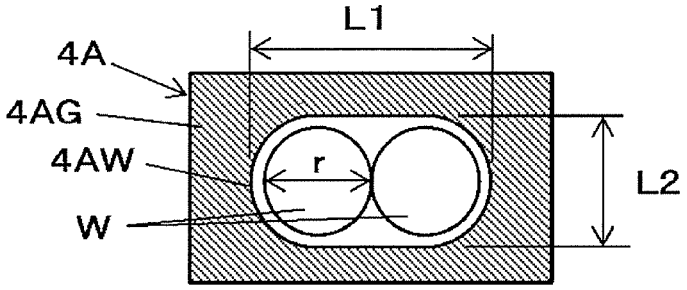
FIG. 6A is a view illustrating an example of a parallel guide of the present embodiment.
Figure 6B:
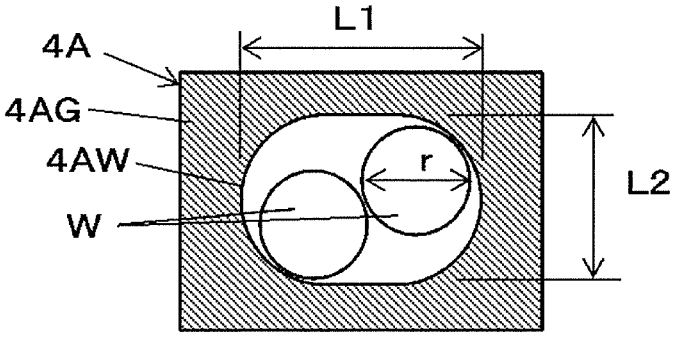
FIG. 6B is a view illustrating an example of a parallel guide of the present embodiment.
Figure 6C:
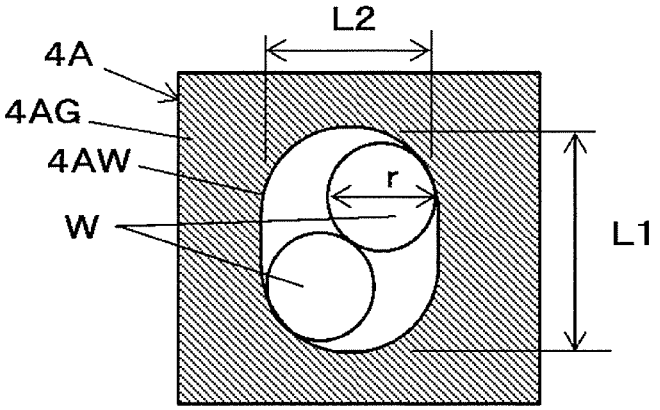
FIG. 6C is a view illustrating an example of a parallel guide of the present embodiment.
Figure 6D:
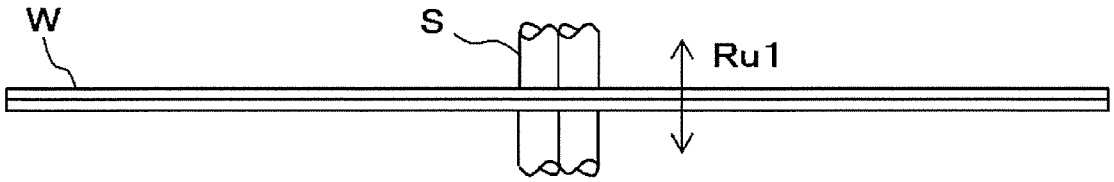
FIG. 6D is a view illustrating an example of parallel wires.
Figure 6E:
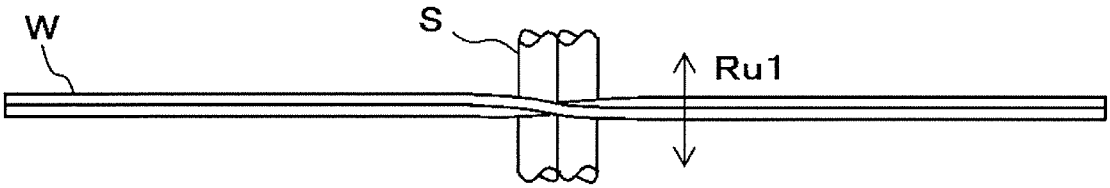
FIG. 6E is a view illustrating an example of intersecting twisted wires.

FIGS. 6A, 6B, and 6C are views illustrating an example of a parallel guide according to the present embodiment. FIGS. 6A, 6B, and 6C are cross-sectional views taken along a line C-C of FIG. 2 and show the cross sectional shape of the parallel guide 4A provided at the introduction position P1. Further, the cross-sectional view taken along a line D-D of FIG. 2 illustrating the sectional shape of the parallel guide 4A provided at the intermediate position P2, and the cross-sectional view taken along a line E-E of FIG. 2 illustrating the sectional shape of the parallel guide 4A provided at the cutting discharge position P3 show the same shape. Further, FIG. 6D is a view illustrating an example of parallel wires, and FIG. 6E is a view illustrating an example of twisted wires intersecting each other.

The parallel guide 4A is an example of a restricting unit constituting the feeding unit and restricts the direction of a plurality of (two or more) wires W that have been sent. Two or more wires W enter and the parallel guide 4A feeds the two or more wires W in parallel. In the parallel guide 4A, two or more wires are arranged in parallel along a direction orthogonal to the feeding direction of the wire W. Specifically, two or more wires W are arranged in parallel along the axial direction of the loop-like wire W wound around the reinforcing bar S by the curl guide unit 5A. The parallel guide 4A has a wire restricting unit (for example, an opening 4AW described later) that restricts the directions and relative movement of the two or more wires W and makes them parallel. In this example, the parallel guide 4A has a guide main body 4AG, and the guide main body 4AG is formed with an opening 4AW which is the wire restricting unit for passing (inserting) a plurality of wires W. The opening 4AW penetrates the guide main body 4AG along the feeding direction of the wire W. When the plurality of sent wires W pass through the opening 4AW and after passing through the opening 4AW, the shape thereof is determined so that the plurality of wires W are arranged in parallel (that is, each of the plurality of wires W is aligned in a direction (radial direction) orthogonal to the feeding direction of the wire W (axial direction) and the axis of each of the plurality of wires W is substantially parallel to each other). Therefore, the plurality of wires W that have passed through the parallel guide 4A go out from the parallel guide 4A in a state of being arranged in parallel. In this way, the parallel guide 4A restricts the direction and orientation in which the two wires W are aligned in the radial direction so that the two wires W are arranged in parallel. Therefore, in the opening 4AW, one direction orthogonal to the feeding direction of the wire W is longer than the other direction which is orthogonal to the feeding direction of the wire W orthogonal to the one direction. The opening 4AW has a longitudinal direction (in which two or more wires W can be juxtaposed) is disposed along a direction orthogonal to the feeding direction of the wire W, more specifically, along the axial direction of the wire W loop-shaped by the curl guide unit 5A. As a result, two or more wires W inserted through the opening 4AW are fed in parallel to the feeding direction of the wire W, and an axis of one wire is offset from an axis of the other wire in a direction parallel to the axial direction Ru1 of the loop of wire W. Therefore, the pinching portion controls a direction of movement of the two or more wires.

In the following description, when describing the shape of the opening 4AW, a cross-sectional shape (along a cross-section cut in a direction orthogonal to the feeding direction, and viewed in the feeding direction of the wire W) will be described. The cross-sectional shape in the direction along the feeding direction of the wire W will be described in each case.

For example, when the opening 4AW (the cross section thereof) is a circle having a diameter equal to or more than twice of the diameter of the wire W, or the length of one side is substantially a square which is twice or more the diameter of the wire W, the two wires W passing through the opening 4AW are in a state where they can freely move in the radial direction.

If the two wires W passing through the opening 4AW can freely move in the radial direction within the opening 4AW, the direction in which the two wires W are arranged in the radial direction cannot be restricted, whereby the two wires W coming out from the opening 4AW may not be in parallel, may be twisted or intersected.

In view of this, the opening 4AW is formed such that the length in the one direction, that is, the length L1 in the longitudinal direction is set to be slightly (n) times longer than the diameter r of the wire W in the form in which the plurality (n) of wires W are arranged along the radial direction, and the length in the other direction, that is, the length L2 in the lateral direction is set to be slightly (n) times longer than the diameter r of one wire W. In the present example, the opening 4AW has a length L1 in the longitudinal direction slightly twice longer than a diameter r of the wire W, and a length L2 in the lateral direction slightly longer than a diameter r of one wire W. In the present embodiment, the parallel guide 4A is configured such that the longitudinal direction of the opening 4AW is linear and the lateral direction is arcuate, but the configuration is not limited thereto.

In the example illustrated in FIG. 6A, the length L2 in the lateral direction of the parallel guide 4A is set to a length slightly longer than the diameter r of one wire W as a preferable length. However, since it is sufficient that the wire W comes off from the opening 4AW in a parallel state without intersecting or being twisted, in the configuration in which the longitudinal direction of the parallel guide 4A is oriented along the axial direction Ru1 of the loop of the wire W wound around the reinforcing bar S at the curl guide unit 5A, the length L2 of the parallel guide 4A in the lateral direction, as illustrated in FIG. 6B, may be within a range from a length slightly longer than the diameter r of one wire W to a length slightly shorter than the diameter r of two wires W.

Further, in the configuration in which the longitudinal direction of the parallel guide 4A is oriented in a direction orthogonal to the axial direction Ru1 of the loop of the wire W wound around the reinforcing bar S in the curl guide unit 5A, as illustrated in FIG. 6C, the length L2 in the lateral direction of the parallel guide 4A may be within a range from a length slightly longer than the diameter r of one wire W to a length shorter than the diameter r of two wires W.

In the parallel guide 4A, the longitudinal direction of the opening 4AW is oriented along a direction orthogonal to the feeding direction of the wire W, in this example, along the axial direction Ru1 of the loop of the wire W wound around the reinforcing bar S in the curl guide unit 5A.

As a result, the parallel guide 4A can pass two wires in parallel along the axial direction Ru1 of the loop of the wire W.

In the parallel guide 4A, when the length L2 in the lateral direction of the opening 4AW is shorter than twice the diameter r of the wire W and slightly longer than the diameter r of the wire W, even if the length L1 in the longitudinal direction of the opening 4AW is sufficiently twice or more times longer than the diameter r of the wire W, it is possible to pass the wires W in parallel.

However, the longer the length L2 in the lateral direction (for example, the length close to twice the diameter r of the wire W) and the longer the length L1 in the longitudinal direction, the wire W can further freely move in the opening 4AW. Then, the respective axes of the two wires W do not become parallel in the opening 4AW, and there is a high possibility that the wires W are twisted or intersect each other after passing through the opening 4AW.

Therefore, it is preferable that the longitudinal length L1 of the opening 4AW is slightly longer than twice the diameter r of the wire W, and the length L2 in the lateral direction is also slightly longer than the diameter r of the wire W so that the two wires W are arranged in parallel in the feed direction, and are adjacent each other in the lateral or radial direction.

The parallel guide 4A is provided at predetermined positions on the upstream side and the downstream side of the first feed gear 30L and the second feed gear 30R (the wire feeding unit 3A) with respect to the feeding direction for feeding the wire W in the forward direction. By providing the parallel guide 4A on the upstream side of the first feed gear 30L and the second feed gear 30R, the two wires W in a parallel state enter the wire feeding unit 3A. Therefore, the wire feeding unit 3A can feed the wire W appropriately (in parallel). Furthermore, by providing the parallel guide 4A also on the downstream side of the first feed gear 30L and the second feed gear 30R, while maintaining the parallel state of the two wires W sent from the wire feeding unit 3A, the wire W can be further sent to the downstream side.

The parallel guides 4A provided on the upstream side of the first feed gear 30L and the second feed gear 30R are provided at the introduction position P1 between the first feed gear 30L and the second feed gear 30R and the magazine 2A such that the wires W fed to the wire feeding unit 3A are arranged in parallel in a predetermined direction.

One of the parallel guides 4A provided on the downstream side of the first feed gear 30L and the second feed gear 30R is provided at the intermediate position P2 between the first feed gear 30L and the second feed gear 30R and the cutting unit 6A such that the wires W fed to the cutting unit 6A are arranged in parallel in the predetermined direction.

Further, the other one of the parallel guides 4A provided on the downstream side of the first feed gear 30L and the second feed gear 30R is provided at the cutting discharge position P3 where the cutting unit 6A is disposed such that the wires W fed to the curl guide unit 5A are arranged in parallel in the predetermined direction.

The parallel guide 4A provided at the introduction position P1 has the above-described shape in which at least the downstream side of the opening 4AW restricts the radial direction of the wire W with respect to the feeding direction of the wire W sent in the forward direction. On the other hand, the opening area of the side facing the magazine 2A (the wire introducing unit), which is the upstream side of the opening 4AW with respect to the feeding direction of the wire W sent in the forward direction, has a larger opening area than the downstream side. Specifically, the opening 4AW has a tube-shaped hole portion that restricts the direction of the wire W and a conical (funnel-shaped, tapered) hole portion in which an opening area gradually increases from the upstream side end of the tube-shaped hole portion to the inlet portion of the opening 4AW as the wire introducing portion. By making the opening area of the wire introducing portion the largest and gradually reducing the opening area therefrom, it is easy to allow the wire W to enter the parallel guide 4. Therefore, the work of introducing the wire W into the opening 4AW can be performed easily.

The other parallel guide 4A also has the same configuration, and the downstream opening 4AW with respect to the feeding direction of the wire W sent in the forward direction has the above-described shape that restricts the direction of the wire W in the radial direction. Further, with regard to the other parallel guide 4, the opening area of the opening on the upstream side with respect to the feeding direction of the wire W sent in the forward direction may be made larger than the opening area of the opening on the downstream side.

The parallel guide 4A provided at the introduction position P1, the parallel guide 4A provided at the intermediate position P2, and the parallel guide 4A provided at the cutting discharge position P3 are arranged such that the longitudinal direction of the opening 4AW orthogonal to the feeding direction of the wire W is in the direction along the axial direction Ru1 of the loop of the wire W wound around the reinforcing bar S.

As a result, as illustrated in FIG. 6D, the two wires W sent by the first feed gear 30L and the second feed gear 30R are sent while maintaining a state of being arranged in parallel in the axial direction Ru1 of the loop of the wire W wound around the reinforcing bar S, and, as illustrated in FIG. 6E, the two wires W are prevented from intersecting (or interfering with each other) and are prevented from being twisted during feeding, by controlling feeding of the two wires together and restricting movement in directions orthogonal to the feeding direction (radial or lateral directions of the wire) and restricting lateral movement of the wires relative to each other.

In the present example, the opening 4AW is a tube-shaped hole having a predetermined depth (a predetermined distance or depth from the inlet to the outlet of the opening 4AW) from the inlet to the outlet of the opening 4AW (in the feeding direction of the wire W), but the shape of the opening 4AW is not limited to this. For example, the opening 4AW may be a planar hole having almost no depth with which the plate-like guide main body 4AG is opened. Further, the opening 4AW may be a groove-shaped guide (for example, a U-shaped guide groove with an opened upper portion) instead of the hole portion penetrating through the guide main body 4AG. Furthermore, in the present example, the opening area of the inlet portion of the opening 4AW as the wire introducing portion is made larger than the other portion, but it may not necessarily be larger than the other portion. The shape of the opening 4AW is not limited to a specific shape as long as the plurality of wires that have passed through the opening 4AW and come out of the parallel guide 4A are in a parallel state.

Hitherto, an example in which the parallel guide 4A is provided at the upstream side (introduction position P1) and a predetermined position (intermediate position P2 and cutting discharge position P3) on the downstream side of the first feed gear 30L and the second feed gear 30R is described. However, the position where the parallel guide 4A is installed is not necessarily limited to these three positions. That is, the parallel guide 4A may be installed only in the introduction position P1, only in the intermediate position P2, or only in the cutting discharge position P3, and only in the introduction position P1 and the intermediate position P2, only in the introduction position P1 and the cutting discharge position P3, or only in the intermediate position P2 and the cutting discharge position P3. Further, four or more parallel guides 4A may be provided at any position between the introduction position P1 and the curl guide unit 5A on the downstream side of the cutting position P3. The introduction position P1 also includes the inside of the magazine 2A. That is, the parallel guide 4A may be arranged in the vicinity of the outlet from which the wire W is drawn inside the magazine 2A.

The curl guide unit 5A is an example of guide unit constituting the feeding unit and forms a conveying path for winding the two wires W around the reinforcing bars S in a loop shape. The curl guide unit 5A includes a first guide unit 50 for curling the wire W sent by the first feed gear 30L and the second feed gear 30R and a second guide unit 51 for guiding the wire W fed from the first guide unit 50 to the binding unit 7A.

Figure 7:
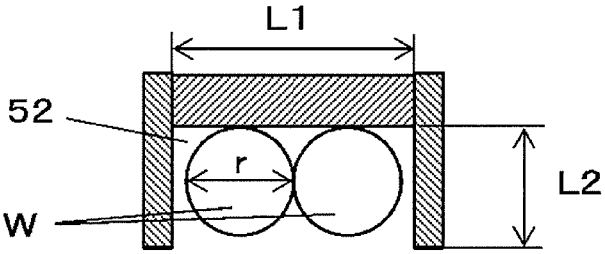
FIG. 7 is a view illustrating an example of a guide groove of the present embodiment.

The first guide unit 50 includes guide grooves 52 constituting a feed path of the wire W and guide pins 53 and 53*b* as a guide member for curling the wire W in cooperation with the guide groove 52. FIG. 7 is a view illustrating an example of the guide groove of the present embodiment. FIG. 7 is a sectional view taken along the line G-G of FIG. 2.

The guide groove 52 forms a guide unit and restricts a direction in the radial direction of movement the wire W orthogonal to the feeding direction of the wire W together with the parallel guide 4A. Therefore, in this example, the guide groove 52 is configured by an opening with an elongated shape in which one direction orthogonal to the feeding direction of the wire W is longer than the other direction orthogonal to the feeding direction of the wire W and orthogonal to the one direction.

The guide groove 52 has a longitudinal length L1 slightly twice or more times longer than the diameter r of one wire W in a form in which the wires W are arranged along the radial direction and a lateral length L2 slightly longer than the diameter r of one wire W. In the present embodiment, the length L1 in the longitudinal direction is slightly twice longer than the diameter r of the wire W. In the guide groove 52, the longitudinal direction of the opening is arranged in the direction along the axial direction Ru1 of the loop of the wire W. It should be noted that the guide groove 52 need not necessarily have the function of restricting the direction of the wire W in the radial direction. In that case, the dimension (length) in the longitudinal direction and in the lateral direction of the guide groove 52 is not limited to the above-described size.

The guide pin 53 is provided on the side of the introducing portion of the wire W that is fed by the first feed gear 30L and the second feed gear 30R in the first guide unit 50 and is arranged inside the loop Ru formed by the wire W in the radial direction with respect to the feed path of the wire W by the guide groove 52. The guide pin 53 restricts the feed path of the wire W so that the wire W fed along the guide groove 52 does not enter the inside of the loop Ru formed by the wire W in the radial direction.

The guide pin 53*b* is provided on the side of the discharge portion of the wire W which is fed by the first feed gear 30L and the second feed gear 30R in the first guide unit 50 and is arranged on the outer side in the radial direction of the loop Ru formed by the wire W with respect to the feed path of the wire W by the guide groove 52.

In the wire W sent by the first feed gear 30L and the second feed gear 30R, the radial position of the loop Ru formed by the wire W is restricted at least at three points including two points on the outer side in the radial direction of the loop Ru formed by the wire W and at least one point on the inner side between the two points, so that the wire W is curled.

In this example, the radially outer position of the loop Ru formed by the wire W is restricted at two points of the parallel guide 4A at the cutting discharge position P3 provided on the upstream side of the guide pin 53 with respect to the feeding direction of the wire W sent in the forward direction and the guide pin 53*b* provided on the downstream side of the guide pin 53. Further, the radially inner position of the loop Ru formed by the wire W is restricted by the guide pin 53.

The curl guide unit 5A includes a retreat mechanism 53*a* for allowing the guide pin 53 to retreat from a path through which the wire W moves by an operation of winding the wire W around the reinforcing bar S. After the wire W is wound around the reinforcing bar S, the retreat mechanism 53*a* is displaced in conjunction with the operation of the binding unit 7A, and retreats the guide pin 53 from the path where the wire W moves before the timing of winding the wire W around the reinforcing bar S.

The second guide unit 51 includes a fixed guide unit 54 as a third guide unit for restricting the radial position of the loop Ru (movement of the wire W in the radial direction of the loop Ru) formed by the wire W wound around the reinforcing bar S and a movable guide unit 55 serving as a fourth guide unit for restricting the position along the axial direction Ru1 of the loop Ru formed by the wire W wound around the reinforcing bar S (movement of the wire W in the axial direction Ru1 of the loop Ru).

Figure 8:
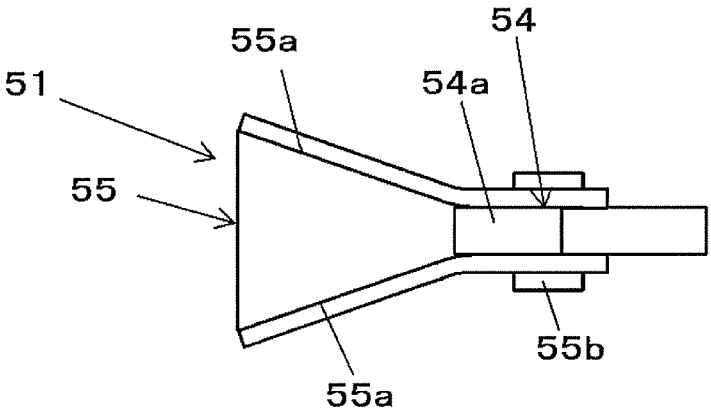
FIG. 8 is a view illustrating an example of a second guide unit of the present embodiment.
Figure 9A:
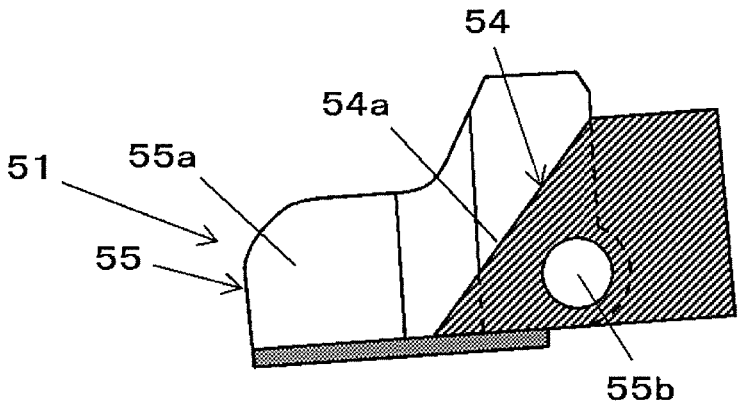
FIG. 9A is a view illustrating an example of a second guide unit of the present embodiment.
Figure 9B:
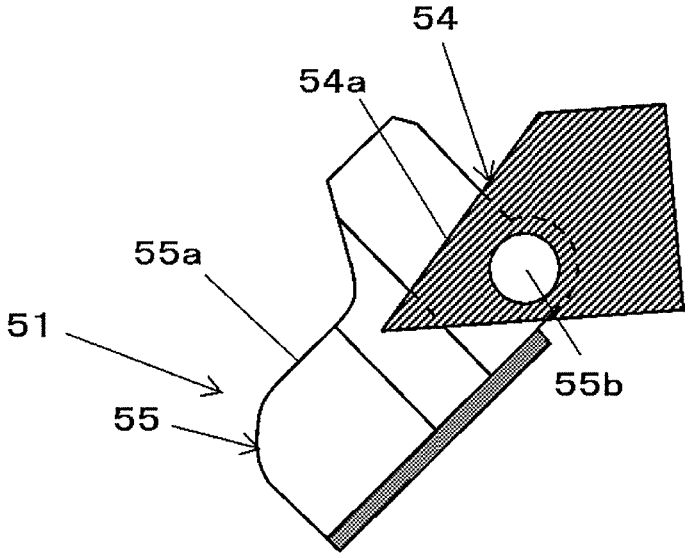
FIG. 9B is a view illustrating an example of a second guide unit of the present embodiment.
Figure 10A:
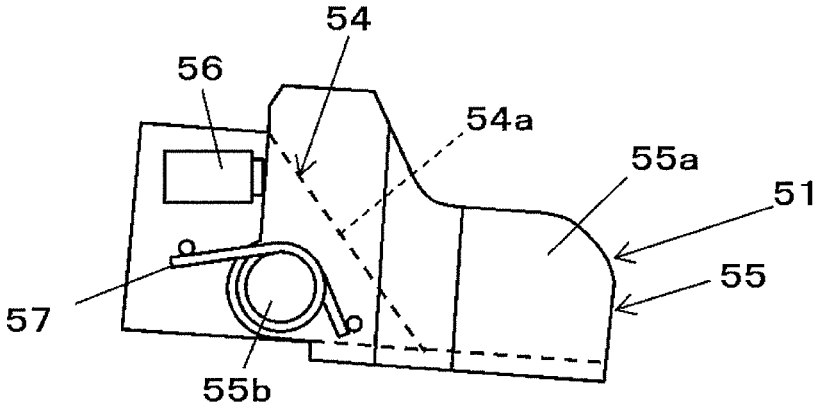
FIG. 10A is a view illustrating an example of a second guide unit of the present embodiment.
Figure 10B:
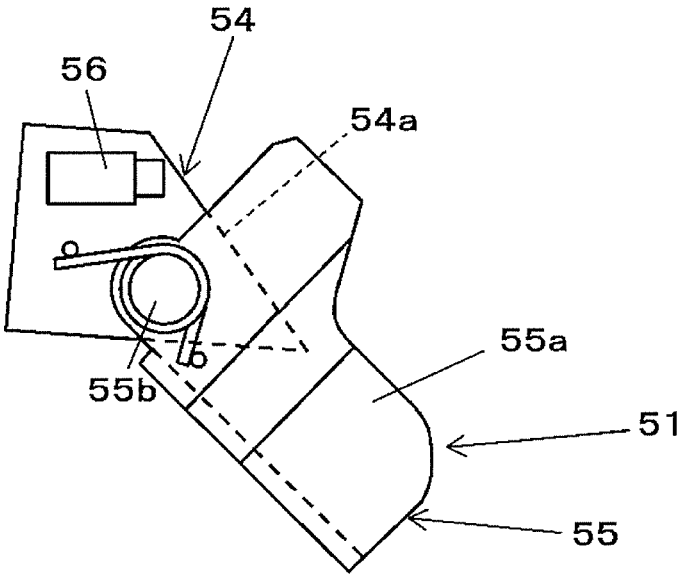
FIG. 10B is a view illustrating an example of a second guide unit of the present embodiment.

FIGS. 8, 9A, 9B, 10A, and 10B are views illustrating an example of a second guide unit, FIG. 8 is a plan view of the second guide unit 51 as viewed from above, FIGS. 9A and 9B are side views of the second guide unit 51 as viewed from one side, and FIGS. 10A and 10B are side views of the second guide unit 51 as viewed from the other side.

The fixed guide unit 54 is provided with a wall surface 54*a* as a surface extending along the feeding direction of the wire W on the outer side in the radial direction of the loop Ru formed by the wire W wound around the reinforcing bar S. When the wire W is wound around the reinforcing bar S, the wall surface 54*a* of the fixed guide unit 54 restricts the radial position of the loop Ru formed by the wire W wound around the reinforcing bar S. The fixed guide unit 54 is fixed to the main body 10A of the reinforcing bar binding machine 1A, and the position thereof is fixed with respect to the first guide unit 50. The fixed guide unit 54 may be integrally formed with the main body 10A. In addition, in the configuration in which the fixed guide unit 54, which is a separate component, is attached to the main body 10A, the fixed guide unit 54 is not perfectly fixed to the main body 10A, but in the operation of forming the loop Ru may be movable to such an extent that movement of the wire W can be restricted.

The movable guide unit 55 is provided on the distal end side of the second guide unit 51 and includes a wall surface 55*a* that is provided on both sides along the axial direction Ru1 of the loop Ru formed by the wire W wound around the reinforcing bar S and is erected inward in the radial direction of the loop Ru from the wall surface 54*a*. When the wire W is wound around the reinforcing bar S, the movable guide unit 55 restricts the position along the axial direction Ru1 of the loop Ru formed by the wire W wound around the reinforcing bar S using the wall surface 55*a*. The wall surface 55*a* of the movable guide unit 55 has a tapered shape in which the gap of the wall surfaces 55*a* is spread at the tip side where the wire W sent from the first guide unit 50 enters and narrows toward the fixed guide unit 54*b*. As a result, the position of the wire W sent from the first guide unit 50 in the axial direction Ru1 of the loop Ru formed by the wire W wound around the reinforcing bar S is restricted by the wall surface 55*a* of the movable guide unit 55, and guided to the fixed guide unit 54 by the movable guide unit 55.

The movable guide unit 55 is supported on the fixed guide unit 54 by a shaft 55*b* on the side opposite to the tip side into which the wire W sent from the first guide unit 50 enters. In the movable guide unit 55 (the distal end side thereof into which the wire W fed from the first guide unit 50 enters) is opened and closed in the direction to come into contact with and separate from the first guide unit 50 by the rotation operation of the loop Ru formed by the wire W wound around the reinforcing bar S along the axial direction Ru1 with the shaft 55*b* as a fulcrum.

In the reinforcing bar binding machine, when binding the reinforcing bar S, between a pair of guide members provided for winding the wire W around the reinforcing bar S, in this example, between the first guide unit 50 and the second guide unit 51, a reinforcing bar is inserted (set) and then the binding work is performed. When the binding work is completed, in order to perform the next binding work, the first guide unit 50 and the second guide unit 51 are pulled out from the reinforcing bar S after the completion of the binding. In the case of pulling out the first guide unit 50 and the second guide unit 51 from about the reinforcing bar S, if the reinforcing bar binding machine 1A is moved in the direction of the arrow Z3 (see FIG. 1) which is one direction of separation from the reinforcing bar S, the reinforcing bar S can be pulled out from the first guide unit 50 and the second guide unit 51 without any problem. However, for example, when the reinforcing bar S is arranged at a predetermined interval along the arrow Y2 and these reinforcing bars S are sequentially bound, moving the reinforcing bar binding machine 1A in the direction of the arrow Z3 after each binding is troublesome, and if it can be moved in the direction of arrow Z2, the binding work can be performed quickly. However, in the conventional reinforcing bar binding machine disclosed in, for example, Japanese Patent No. 4747456, since the guide member corresponding to the second guide unit 51 in the present example is fixed to the binding machine body, when trying to move the reinforcing bar binding machine in the direction of the arrow Z2, the guide member is caught on the reinforcing bar S. Therefore, in the reinforcing bar binding machine 1A, the second guide unit 51 (the movable guide unit 55) is made movable as described above and the reinforcing bar binding machine 1A is moved in the direction of the arrow Z2 so that the reinforcing bar S is more easily pulled out from between the first guide unit 50 and the second guide unit 51.

Therefore, the movable guide unit 55 rotates about the shaft 55*b* as a fulcrum, and thus opened and closed between a guide position at which the wire W sent out from the first guide unit 50 can be guided to the second guide unit 51 and a retreat position at which the reinforcing bar binding machine 1A is moved in the direction of the arrow Z2 and then is retreated in the operation of pulling out the reinforcing bar binding machine 1A from the reinforcing bar S.

The movable guide unit 55 is biased in a direction in which the distance between the tip side of the first guide unit 50 and the tip side of the second guide unit 51 is reduced by the urging unit (biasing unit) such as a torsion coil spring 57, and is held in the guide position illustrated in FIGS. 9A and 10A by the force of the torsion coil spring 57. In addition, in an operation of pulling out the reinforcing bar binding machine 1A from the reinforcing bar S, the movable guide unit 55 is pushed to the reinforcing bar S, and thereby the movable guide unit 55 is opened from the guide position to the retreat position illustrated in FIGS. 9B and 10B. The guide position is a position where the wall surface 55*a* of the movable guide unit 55 exists at a position where the wire W forming the loop Ru passes. The retreat position is a position at which at which the reinforcing bar S presses the movable guide unit 55 by the movement of the reinforcing bar binding machine 1A, and the reinforcing bar S can be pulled out from between the first guide unit 50 and the second guide unit 51. Here, the direction in which the reinforcing bar binding machine 1A is moved is not uniform, and even if the movable guide unit 55 slightly moves from the guide position, the reinforcing bar S can be pulled out from between the first guide unit 50 and the second guide unit 51, and thus a position slightly moved from the guide position is also included in the retreat position.

The reinforcing bar binding machine 1A includes a guide opening/closing sensor 56 that detects opening and closing of the movable guide unit 55. The guide opening/closing sensor 56 detects the closed state and the open state of the movable guide unit 55, and outputs a predetermined detection signal.

The cutting unit 6A includes a fixed blade unit 60, a rotary blade unit 61 for cutting the wire W in cooperation with the fixed blade unit 60, and a transmission mechanism 62 which transmits the operation of the binding unit 7A, in this example, the operation of a movable member 83 (to be described later) moving in a liner direction to the rotary blade unit 61 and rotates the rotary blade unit 61. The fixed blade unit 60 is configured by providing an edge portion capable of cutting the wire W in the opening through which the wire W passes. In the present example, the fixed blade unit 60 includes a parallel guide 4A arranged at the cutting discharge position P3.

The rotary blade unit 61 cuts the wire W passing through the parallel guide 4A of the fixed blade unit 60 by the rotation operation with the shaft 61*a* as a fulcrum. The transmission mechanism 62 is displaced in conjunction with the operation of the binding unit 7A, and after the wire W is wound around the reinforcing bar S, the rotary blade unit 61 is rotated according to the timing of twisting the wire W to cut the wire W.

The binding unit 7A is an example of a binding unit, and includes a gripping unit 70 that grips the wire W and a bending unit 71 configured to bend one end WS side and the other end WE side of the wire W gripped by the gripping unit 70 toward the reinforcing bar S.

The gripping unit 70 is an example of a gripping unit, and includes a fixed gripping member 70C, a first movable gripping member 70L, and a second movable gripping member 70R as illustrated in FIG. 2. The first movable gripping member 70L and the second movable gripping member 70R are arranged in the lateral direction via the fixed gripping member 70C. Specifically, the first movable gripping member 70L is disposed on one side along the axial direction of the wire W to be wound around, with respect to the fixed gripping member 70C, and the second movable gripping member 70R is disposed on the other side.

The first movable gripping member 70L is displaced in a direction to come into contact with and separate from the fixed gripping member 70C. In addition, the second movable gripping member 70R is displaced in a direction to come into contact with and separate from the fixed gripping member 70C.

As the first movable gripping member 70L moves in a direction away from the fixed gripping member 70C, in the gripping unit 70, a feed path through which the wire W passes between the first movable gripping member 70L and the fixed gripping member 70C is formed. On the other hand, as the first movable gripping member 70L moves toward the fixed gripping member 70C, the wire W is gripped between the first movable gripping member 70L and the fixed gripping member 70C.

When the second movable gripping member 70R moves in a direction away from the fixed gripping member 70C, in the gripping unit 70, a feed path through which the wire W passes between the second movable gripping member 70R and the fixed gripping member 70C is formed. On the other hand, as the second movable gripping member 70R moves toward the fixed gripping member 70C, the wire W is gripped between the second movable gripping member 70R and the fixed gripping member 70C.

The wire W sent by the first feed gear 30L and the second feed gear 30R and passed through the parallel guide 4A at the cutting discharge position P3 passes between the fixed gripping member 70C and the second movable gripping member 70R and is guided to the curl guide unit 5A. The wire W which has been wound by the curl guide unit 5A passes between the fixed gripping member 70C and the first movable gripping member 70L.

Therefore, a first gripping unit for gripping one end WS side of the wire W is constituted by the fixed gripping member 70C and the first movable gripping member 70L. Further, the fixed gripping member 70C and the second movable gripping member 70R constitute a second gripping unit for gripping the other end WE side of the wire W cut by the cutting unit 6A.

Figure 11A:
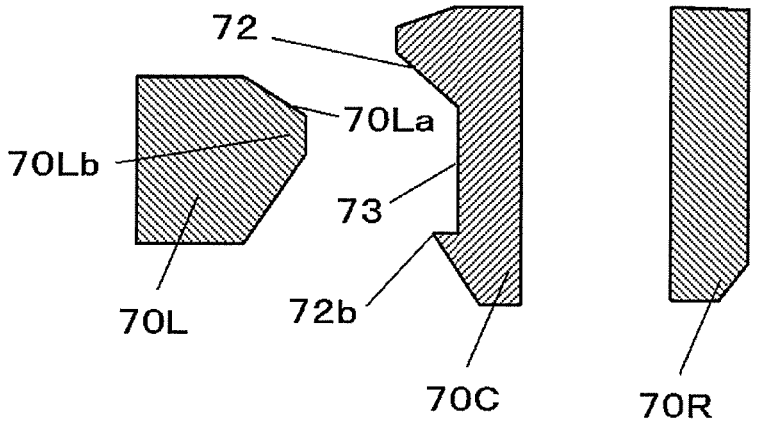
FIG. 11A is a view illustrating main parts of a gripping unit according to the present embodiment.
Figure 11B:
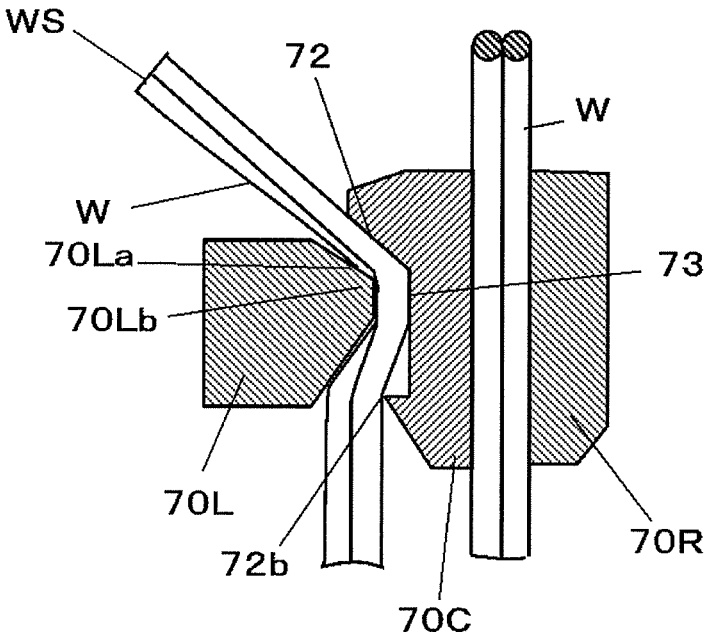
FIG. 11B is a view illustrating main parts of a gripping unit according to the present embodiment.

FIGS. 11A and 11B are views illustrating main parts of the gripping unit of this embodiment. The fixed gripping member 70C includes a preliminary bending portion 72. The preliminary bending portion 72 is configured such that a protrusion protruding toward the first movable gripping member 70L is provided at a downstream end along the feeding direction of the wire W fed in the forward direction on the surface facing the first movable gripping member 70L of the fixed gripping member 70C.

In order to grip the wire W between the fixed gripping member 70C and the first movable gripping member 70L and prevent the gripped wire W from being pulled out, the gripping unit 70 has the protrusion portion 72*b* and the recess portion 73 on the fixed gripping member 70C. The protrusion portion 72*b* is provided on the upstream end along the feeding direction of the wire W fed in the forward direction on the surface facing the first movable gripping member 70L of the fixed gripping member 70C and protrudes to the first movable gripping member 70L. The recess portion 73 is provided between the preliminary bending portion 72 and the protrusion portion 72*b* and has a recess shape in a direction opposite to the first movable gripping member 70L.

The first movable gripping member 70L has a recess portion 70La into which the preliminary bending portion 72 of the fixed gripping member 70C enters and a protrusion portion 70Lb which enters the recess portion 73 of the fixed gripping member 70C.

As a result, as illustrated in FIG. 11B, by the operation of gripping one end WS side of the wire W between the fixed gripping member 70C and the first movable gripping member 70L, the wire W is pressed by the preliminary bending portion 72 on the first movable gripping member 70L side, and one end WS of the wire W is bent in a direction away from the wire W gripped by the fixed gripping member 70C and the second movable gripping member 70R.

Gripping the wire W with the fixed gripping member 70C and the second movable gripping member 70R includes a state in which the wire W can move freely to some extent between the fixed gripping member 70C and the second movable gripping member 70R. This is because, in the operation of winding the wire W around the reinforcing bar S, it is necessary to move the wire W between the fixed gripping member 70C and the second movable gripping member 70R.

The bending portion 71 is an example of a bending unit, is provided around the gripping unit 70 so as to cover a part of the gripping unit 70, and is provided so as to be movable along the axial direction of the gripping unit 70. Specifically, the bending portion 71 approaches the one end WS side of the wire W gripped by the fixed gripping member 70C and the first movable gripping member 70L and the other end WE side of the wire W gripped by the fixed gripping member 70C and the second movable gripping member 70R and is movable in a forward and backward direction in which one end WS side and the other end WE side of the wire W are bent in the direction away from the bent wire W (the end portions are bent toward the binding object, or to a lower vertical position compared to the top portion of the wire).

The bending portion 71 moves in the forward direction (see FIG. 1) indicated by an arrow F, so that one end WS side of the wire W gripped by the fixed gripping member 70C and the first movable gripping member 70L is bent to the reinforcing bar S side with the gripping position as the fulcrum. Further, the bending portion 71 moves in the forward direction indicated by the arrow F, whereby the other end WE side of the wire W between the fixed gripping member 70C and the second movable gripping member 70R is bent to the reinforcing bar S side with the gripping position as the fulcrum.

The wire W is bent by the movement of the bending portion 71, so that the wire W passing between the second movable gripping member 70R and the fixed gripping member 70C is pressed by the bending portion 71, and the wire W is prevented from coming off between the fixed gripping member 70C and the second movable gripping member 70R.

The binding unit 7A includes a length restricting unit 74 that restricts the position of one end WS of the wire W. The length restricting unit 74 is constituted by providing a member against which the one end WS of the wire W abuts in the feed path of the wire W that has passed between the fixed gripping member 70C and the first movable gripping member 70L. In order to secure a predetermined distance from the gripping position of the wire W by the fixed gripping member 70C and the first movable gripping member 70L, the length restricting unit 74 is provided in the first guide unit 50 of the curl guide unit 5A in this example.

The reinforcing bar binding machine 1A includes a binding unit driving mechanism 8A that drives the binding unit 7A. The binding unit driving mechanism 8A includes a motor 80, a rotary shaft 82 driven by the motor 80 via a speed reducer 81 that performs deceleration and torque amplification, a movable member 83 that is displaced by a rotation operation of the rotary shaft 82, and a rotation restricting member 84 that restricts the rotation of the movable member 83 interlocking with the rotation operation of the rotary shaft 82.

In the rotary shaft 82 and the movable member 83, by the screw portion provided on the rotary shaft 82 and the nut portion provided in the movable member 83, the rotation operation of the rotary shaft 82 is converted to the movement of the movable member 83 along the rotary shaft 82 in the forward and backward direction.

The movable member 83 is locked to the rotation restricting member 84 in the operation region where the wire W is gripped by the gripping unit 70, and then the wire W is bent by the bending portion 71, so that the movable member 83 moves in the forward and backward direction in a state where the rotation operation is restricted by the rotation restricting member 84. Further, the movable member 83 is rotated by the rotation operation of the rotary shaft 82 by coming off from the locking of the rotation restricting member 84.

In this example, the movable member 83 is connected to the first movable gripping member 70L and the second movable gripping member 70R via a cam (not illustrated). The binding unit driving mechanism 8A is configured that the movement of the movable member 83 in the forward and backward direction is converted into the operation of displacing the first movable gripping member 70L in the direction to come into contact with and separate from the fixed gripping member 70C, and the operation of displacing the second movable gripping member 70R in the direction to come into contact with and separate from the fixed gripping member 70C.

Further, in the binding unit driving mechanism 8A, the rotation operation of the movable member 83 is converted into the rotation operation of the fixed gripping member 70C, the first movable gripping member 70L and the second movable gripping member 70R.

Furthermore, in the binding unit driving mechanism 8A, the bending portion 71 is provided integrally with the movable member 83, so that the bending portion 71 moves in the forward and backward direction by the movement of the movable member 83 in the forward and backward direction.

The retreat mechanism 53*a* of the guide pin 53 is configured by a link mechanism that converts the movement of the movable member 83 in the forward and backward direction into displacement of the guide pin 53. The transmission mechanism 62 of the rotary blade portion 61 is configured by a link mechanism that converts the movement of the movable member 83 in the forward and backward direction into the rotation operation of the rotary blade portion 61.

Figure 12:
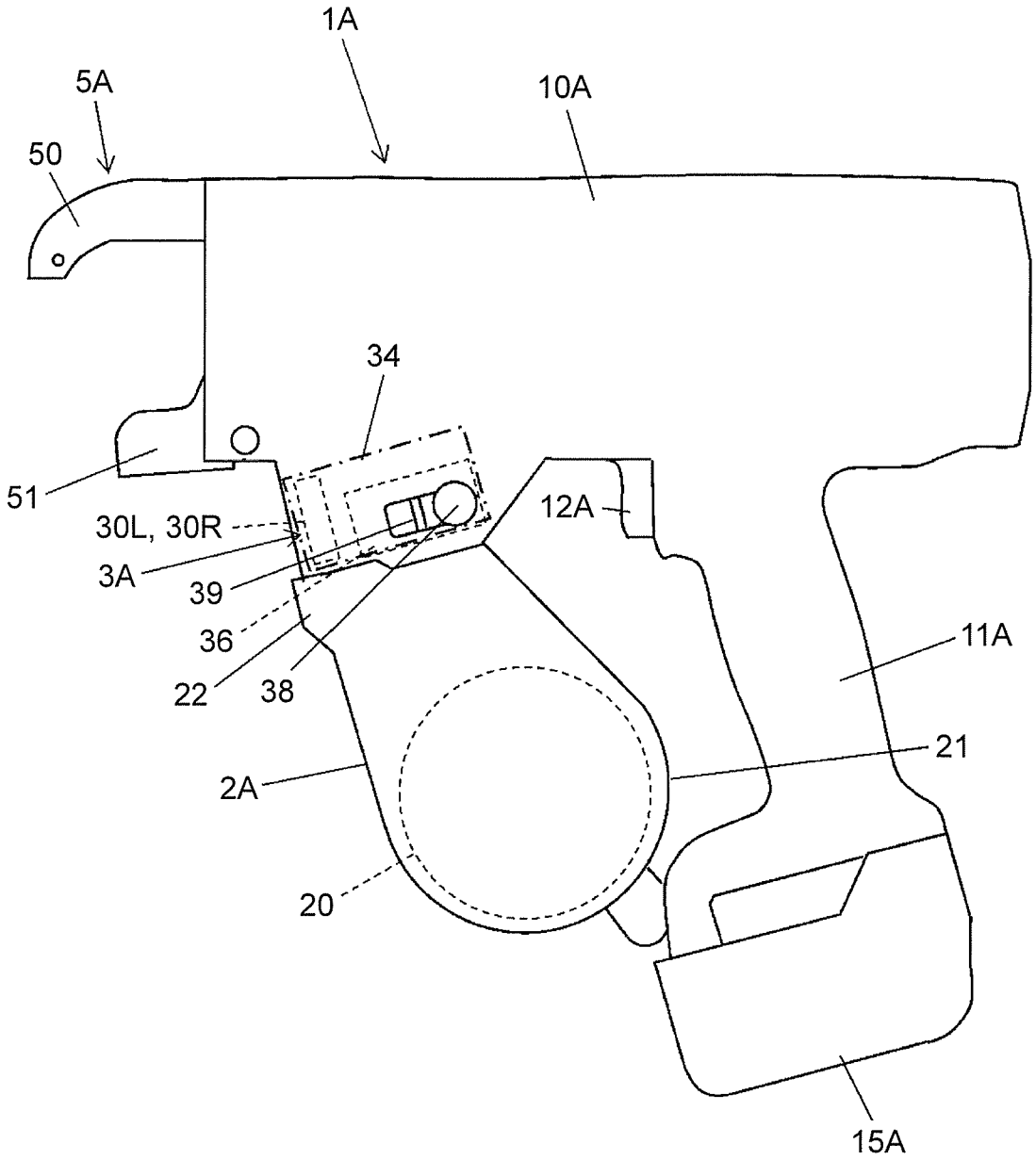
FIG. 12 is an external view illustrating an example of the reinforcing bar binding machine of the present embodiment.

FIG. 12 is an external view illustrating an example of the reinforcing bar binding machine of the present embodiment. The reinforcing bar binding machine 1A according to the present embodiment has a form used by a worker in hand and includes a main body 10A and a handle portion 11A. As illustrated in FIG. 1 and the like, the reinforcing bar binding machine 1A incorporates a binding unit 7A and a binding unit driving mechanism 8A in the main body 10A and has a curl guide unit 5A at one end side of the main body 10A in the longitudinal direction (first direction Y1). Further, the handle portion 11A is provided so as to protrude from the other end side in the longitudinal direction of the main body 10A to one direction (second direction Y2) substantially orthogonal (intersecting) with the longitudinal direction. Further, the wire feeding unit 3A is provided on the side along the second direction Y2 with respect to the binding unit 7A, the displacement unit 34 is provided on the other side along the first direction Y1 with respect to the wire feeding unit 3A, that is, on the side of the handle portion 11A with respect to the wire feeding unit 3A in the main body 10A, and the magazine 2A is provided on the side along the second direction Y2 with respect to the wire feeding unit 3A.

Therefore, the handle portion 11A is provided on the other side along the first direction Y1 with respect to the magazine 2A. In the following description, in the first direction Y1 along the direction in which the magazine 2A, the wire feeding unit 3A, the displacement unit 34, and the handle portion 11A are arranged, the side on which the magazine 2A is provided is called a front side, and the side on which the handle portion 11A is provided is called a back side. In the displacement unit 34, a second displacement member 36 is provided in a direction substantially orthogonal to the feeding direction of the wire W fed by the first feed gear 30L and the second feed gear 30R in the wire feeding unit 3A, behind the first feed gear 30L and the second feed gear 30R of the wire feeding unit 3A, and between the first feed gear 30L and the second feed gear 30R and the handle portion 11A. An operation button 38 for displacing the second displacement member 36, a release lever 39 for releasing locking and locking of the operation button 38 are provided between the first feed gear 30L and the second feed gear 30R and the handle portion 11A.

It is noted that a release function for releasing locking and locking may be mounted on the operation button 38 for displacing the second displacement member 36 (also serving as a release lever). That is, the displacement unit 34 includes the second displacement member 36 for displacing the first feed gear 30L and the second feed gear 30R of the wire feeding unit 3A toward and away from each other, and the operation button 38 which displaces the second displacement member 36 and protrudes outwardly from the main body 10A, and is positioned between the wire feeding unit 3A and the handle portion 11A in the main body 10A.

In this manner, by providing the mechanism for displacing the second feed gear 30R, between the second feed gear 30R and the handle portion 11A, behind the second feed gear 30R, as illustrated in FIG. 2, a mechanism for displacing the second feed gear 30R is not provided in the feed path of the wire W below the first feed gear 30L and the second feed gear 30R. In other words, the interior of the magazine 2A, which forms the feed path of the wire W, below the first feed gear 30L and the second feed gear 30R can be used as the wire loading space 22 which is the space for loading the wire W into the wire feeding unit 3A. That is, the wire loading space 22 for the wire feeding unit 3A can be formed inside the magazine 2A.

A trigger 12A is provided on the front side of the handle portion 11A, and the control unit 14A controls the feed motor 33*a* and the motor 80 according to the state of the switch 13A pressed by the operation of the trigger 12A. Further, a battery 15A is detachably attached to a lower portion of the handle portion H A.

<Example of Operation of Reinforcing Bar Binding Machine in the Embodiment>

Figure 19:
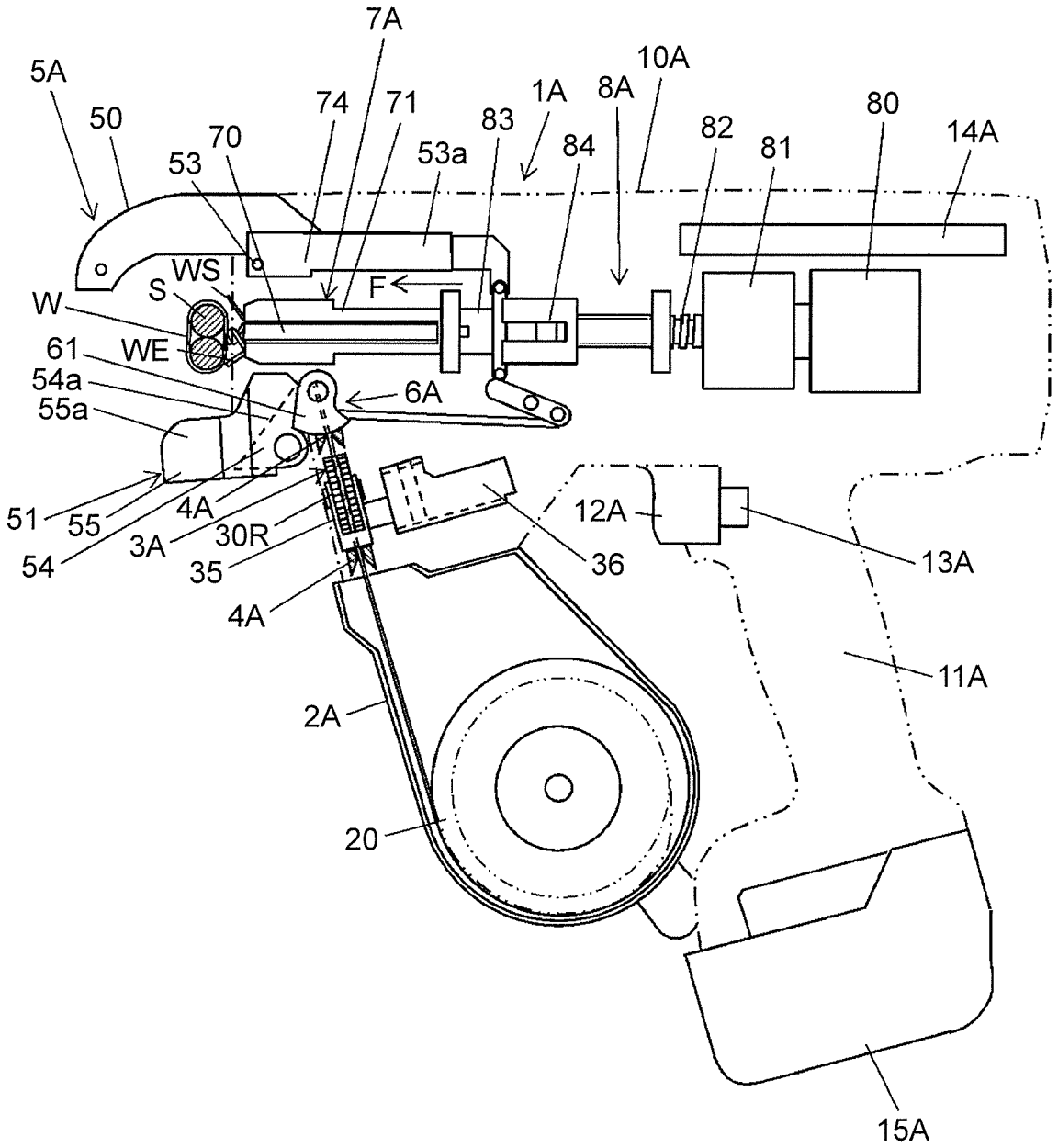
FIG. 19 is an explanatory view of an operation of the reinforcing bar binding machine of the embodiment.
Figure 20:
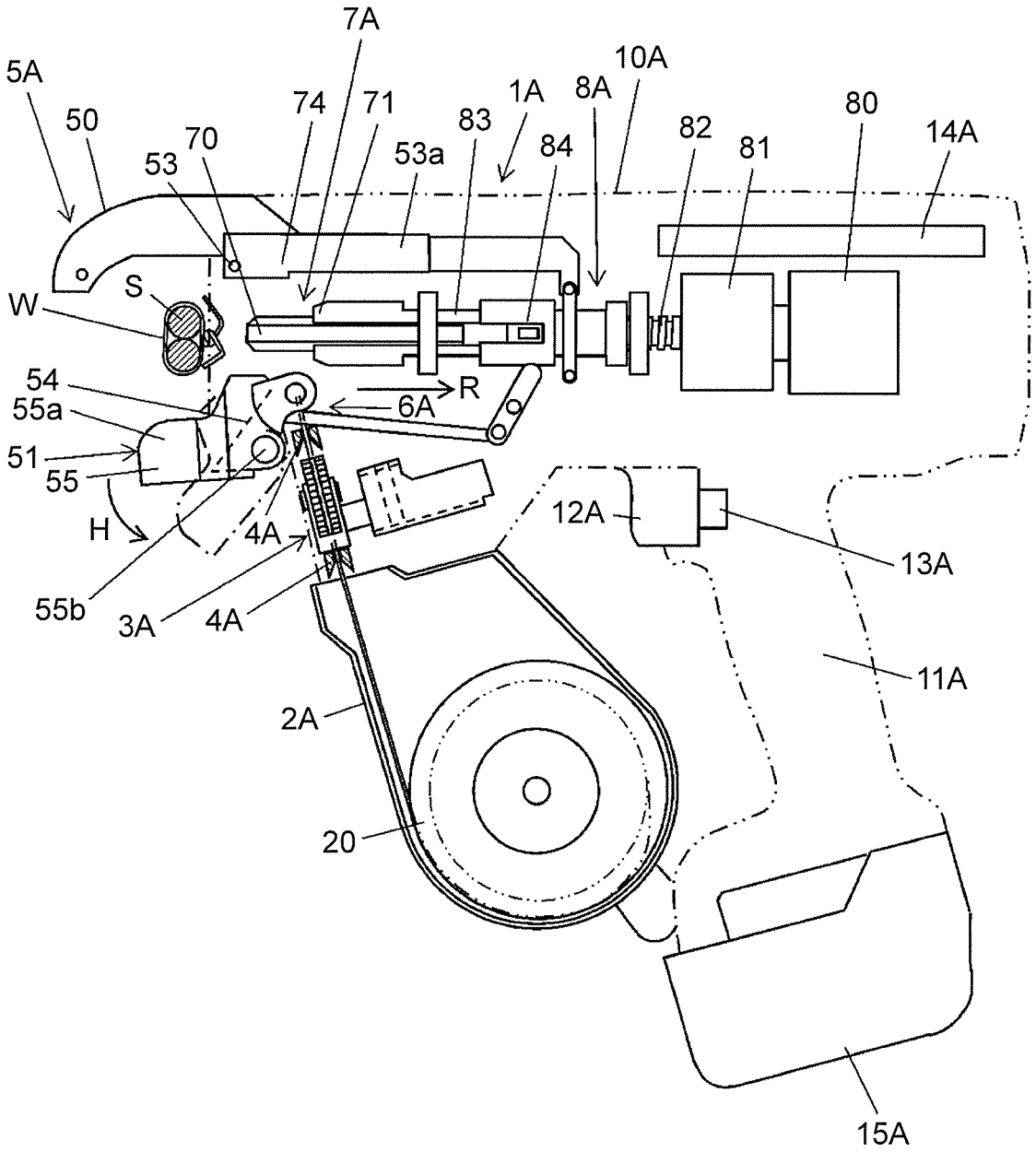
FIG. 20 is an explanatory view of an operation of the reinforcing bar binding machine of the present embodiment.
Figure 21A:
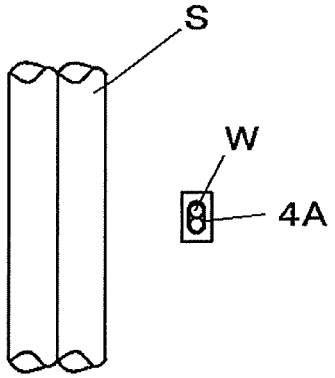
FIG. 21A is an explanatory view of an operation of winding a wire around a reinforcing bar.
Figure 21B:
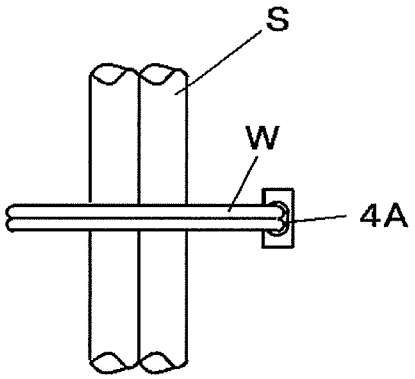
FIG. 21B is an explanatory view of an operation of winding a wire around a reinforcing bar.
Figure 21C:
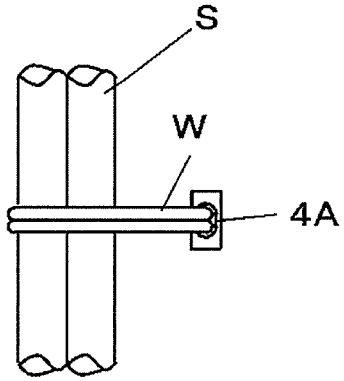
FIG. 21C is an explanatory view of an operation of winding a wire around a reinforcing bar.
Figure 22A:
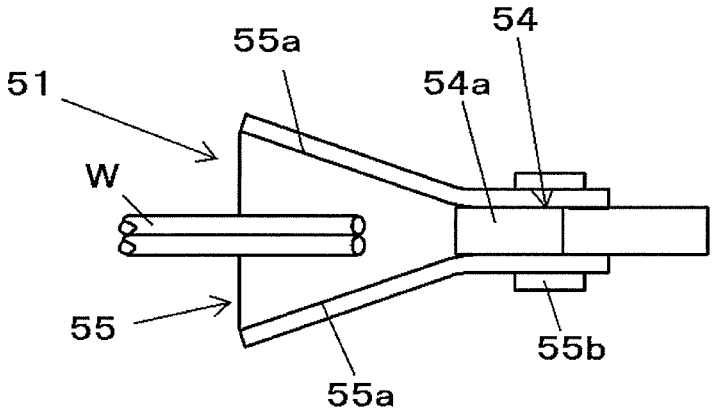
FIG. 22A is an explanatory view of an operation of forming a loop with a wire by a curl guide unit.
Figure 22B:
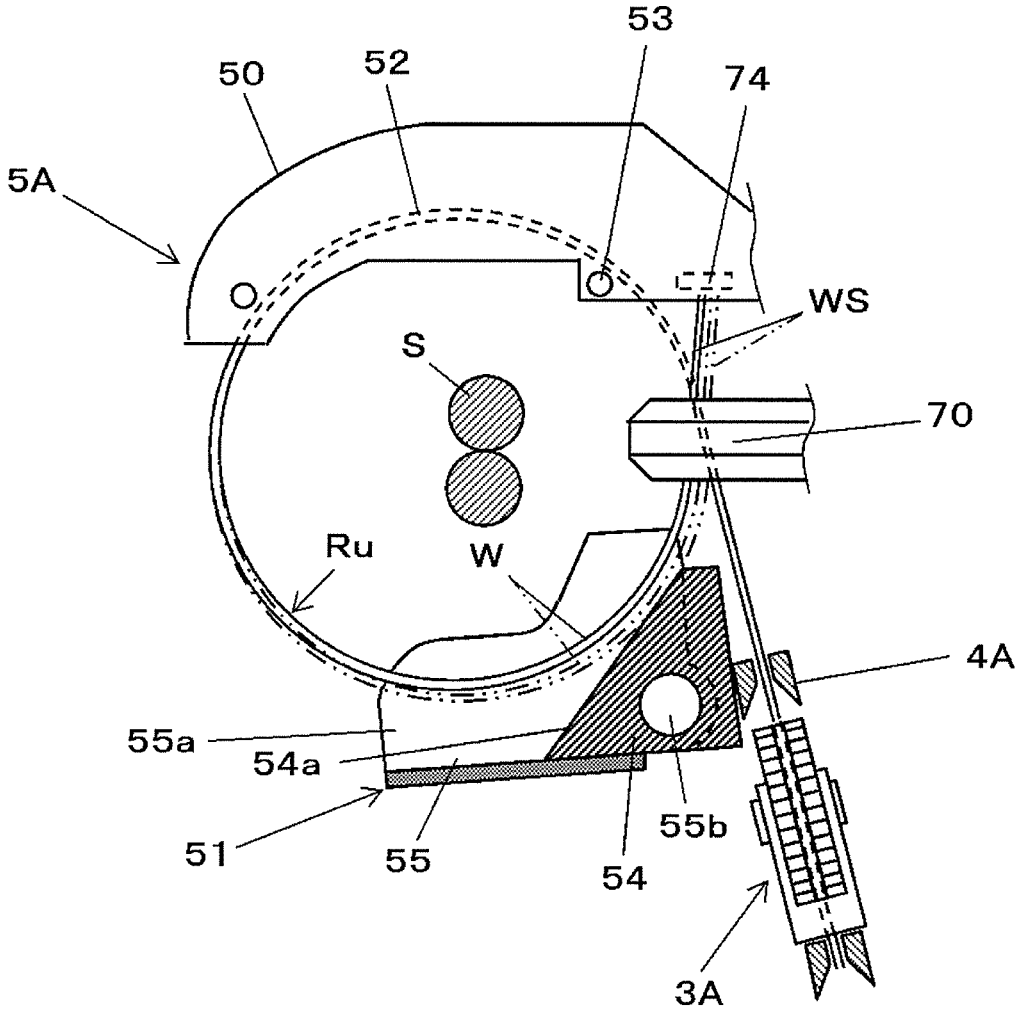
FIG. 22B is an explanatory view of an operation for forming a loop with a wire by a curl guide unit.
Figure 23A:
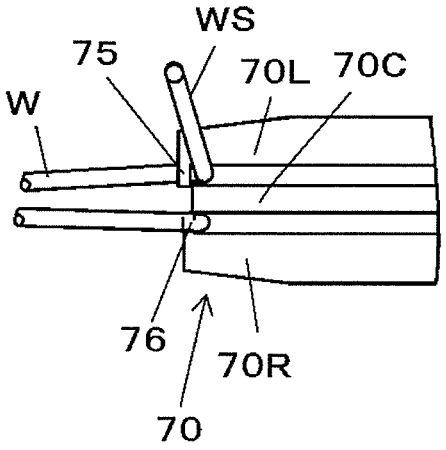
FIG. 23A is an explanatory view of an operation of bending a wire.
Figure 23B:
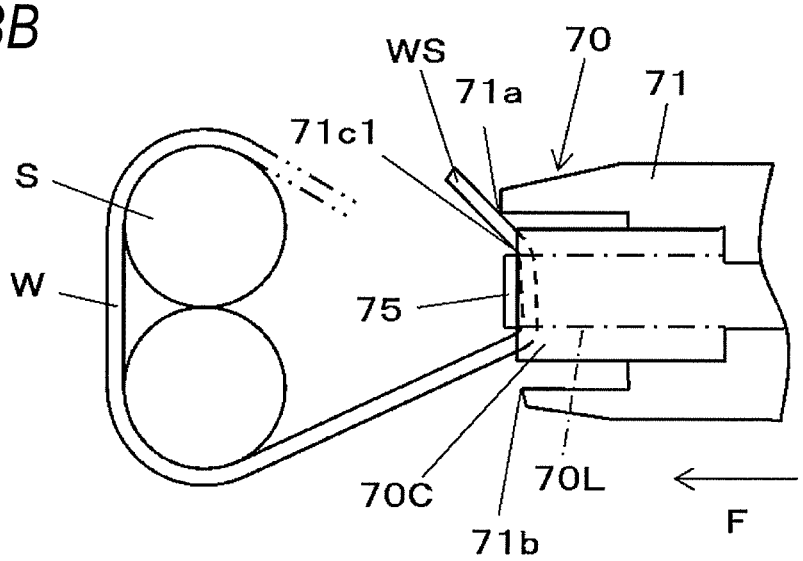
FIG. 23B is an explanatory view of an operation of bending the wire.
Figure 23C:
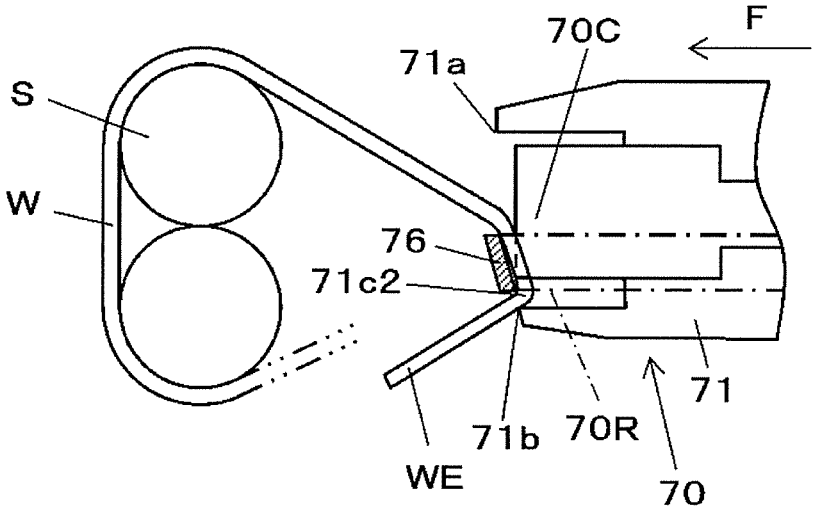
FIG. 23C is an explanatory view of an operation of bending the wire.

FIGS. 13 to 20 are diagrams for explaining the operation of the reinforcing bar binding machine 1A according to the present embodiment, and FIGS. 21A, 21B, and 21C are diagrams for explaining the operation of winding the wire around the reinforcing bar. FIGS. 22A and 22B are explanatory views of the operation of forming a loop with a wire by the curl guide unit, and FIGS. 23A, 23B, and 23C are explanatory views of the operation of bending the wire. Next, with reference to the drawings, the operation of binding the reinforcing bar S with the wire W by the reinforcing bar binding machine 1A of this embodiment will be described.

In order to load the wire W wound around the reel 20 housed in the magazine 2A, first, the operation button 38 in the wire feed position illustrated in FIG. 5A is pushed in the arrow T2 direction. When the operation button 38 is pushed in the direction of the arrow T2, the guide slope 39*c* of the release lever 39 is pushed, and the locking protrusion 39*a* comes off from the first locking recess 38*a*. As a result, the release lever 39 is displaced in the arrow U2 direction.

When the operation button 38 is pushed to the wire loading position, as illustrated in FIG. 5B, the release lever 39 is pushed by the spring 39*b* in the direction of the arrow U1, and the locking protrusion 39*a* is inserted into the second locking recess 38*b* of the operation button 38 and is locked. Therefore, the operation button 38 is held at the wire loading position.

When the operation button 38 is in the wire loading position, the second displacement member 36 is pressed by the operation button 38, and the second displacement member 36 displaces the second feed gear 30R about the shaft 36*a* as a fulcrum in a direction away from the first feed gear 30L. Therefore, the second feed gear 30R is separated from the first feed gear 30L, and the wire W can be inserted between the first feed gear 30L and the second feed gear 30R.

Figure 5C:
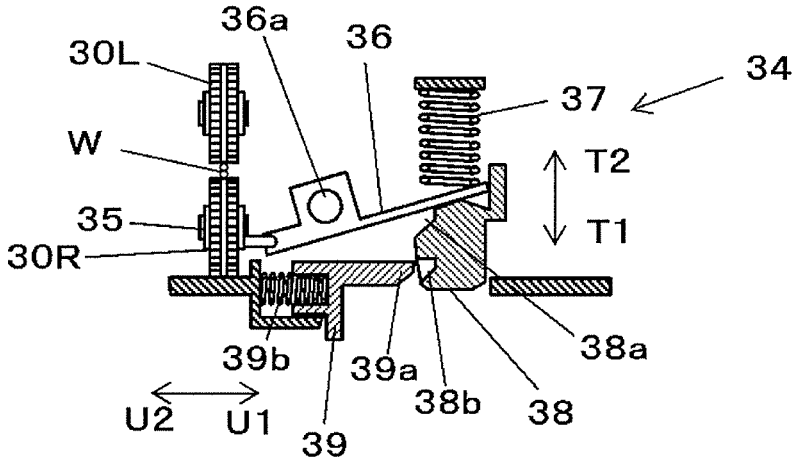
FIG. 5C is a view illustrating an example of a displacement unit according to the present embodiment.

After loading the wire W, as illustrated in FIG. 5C, by pushing the release lever 39 in the direction of the arrow U2, the locking protrusion 39*a* comes off from the second locking recess 38*b* of the operation button 38. As a result, the second displacement member 36 is pressed by the spring 37, and the second displacement member 36 is displaced in the direction to press the second feed gear 30R against the first feed gear 30L about the shaft 36*a* as a fulcrum. Therefore, the wire W is sandwiched between the first feed gear 30L and the second feed gear 30R.

When the operation button 38 is pushed in the direction of the arrow T1 by the second displacement member 36 and is displaced to the wire feed position as illustrated in FIG. 5A, the locking protrusion 39*a* of the release lever 39 is locked to the first locking recess 38*a* of the operation button 38, and the operation button 38 is held at the wire feed position.

Figure 13:
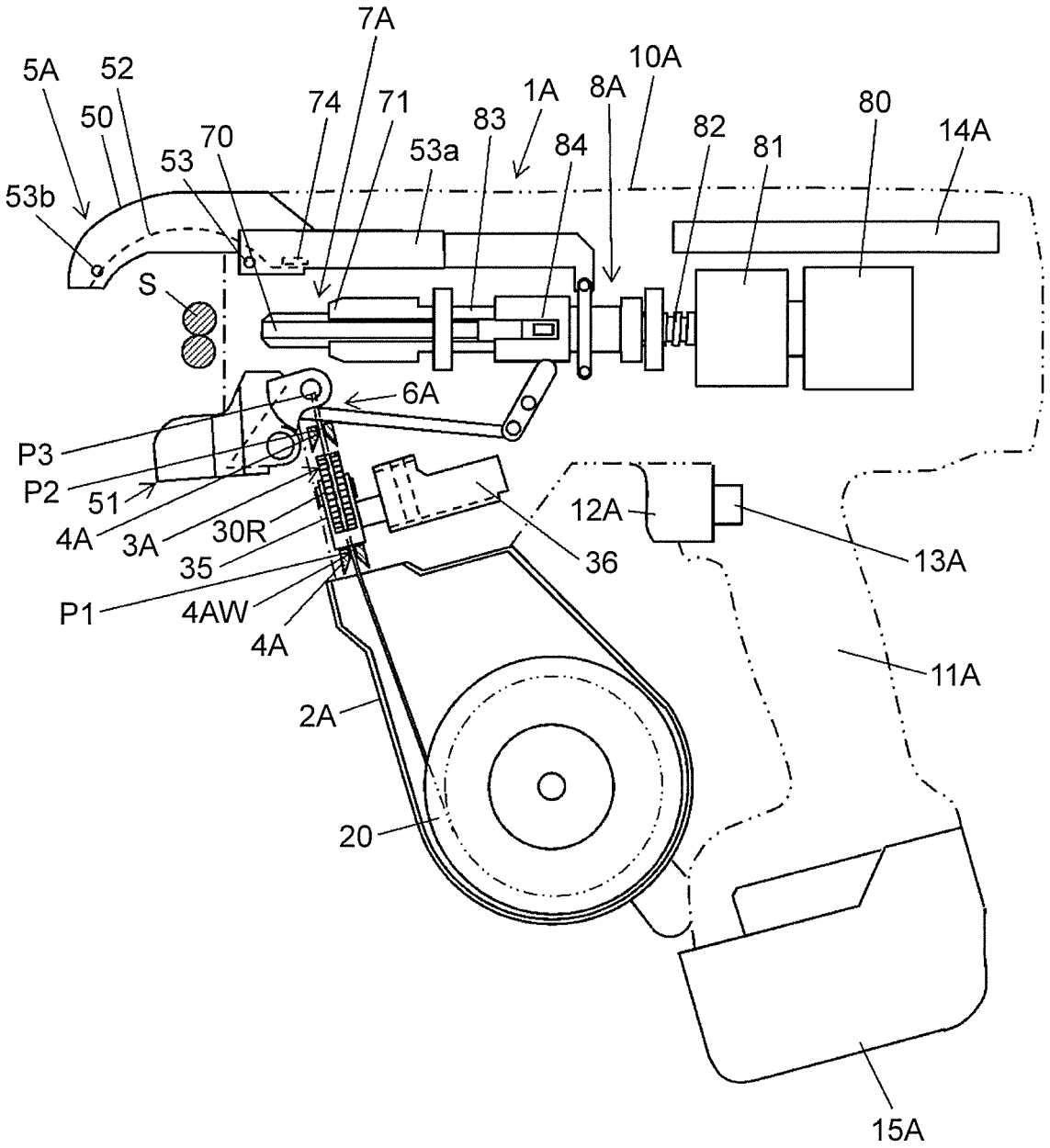
FIG. 13 is an explanatory view of an operation of the reinforcing bar binding machine of the present embodiment.

FIG. 13 illustrates the origin state, that is, the initial state in which the wire W has not yet been sent by the wire feeding unit 3A. In the origin state, the tip of the wire W stands by at the cutting discharge position P3. As illustrated in FIG. 21A, the wire W waiting at the cutting discharge position P3 is arranged in parallel in a predetermined direction by passing through the parallel guide 4A (fixed blade portion 60) in which the two wires W are provided at the cutting discharge position P3, in this example.

The wires W between the cutting discharge position P3 and the magazine 2A are arranged in parallel in a predetermined direction by the parallel guide 4A at the intermediate position P2, the parallel guide 4A at the introduction position P1, the first feed gear 30L and the second feed gear 30R.

Figure 14:
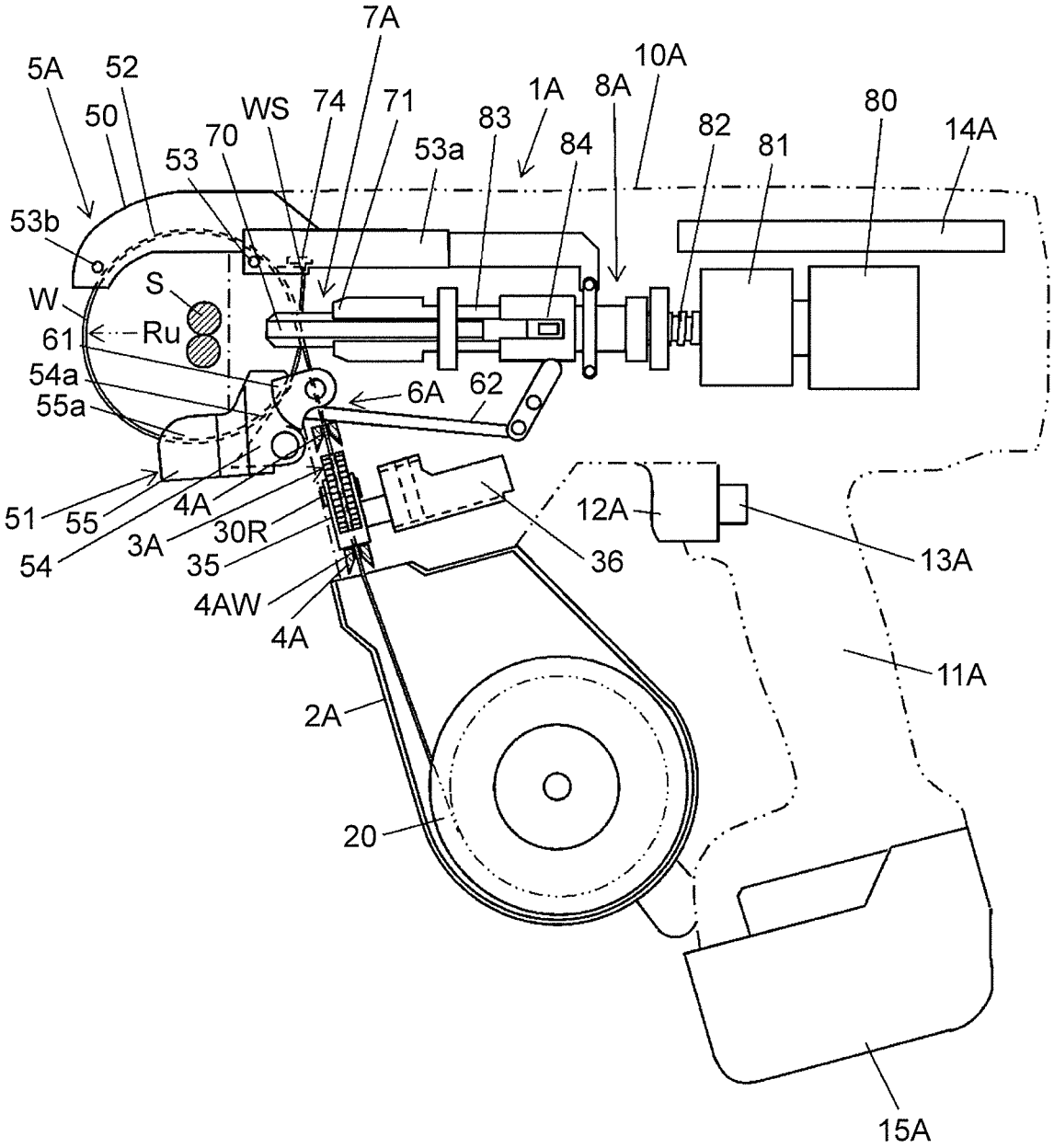
FIG. 14 is an explanatory view of an operation of a reinforcing bar binding machine according to the present embodiment.

FIG. 14 illustrates a state in which the wire W is wound around the reinforcing bar S. When the reinforcing bar S is inserted between the first guide unit 50 and the second guide unit 51 of the curl guide unit 5A and the trigger 12A is operated, the feed motor 33*a* is driven in the normal rotation direction, and thus the first feed gear 30L rotates in forward direction and the second feed gear 30R rotates in the forward direction while following the first feed gear 30L.

Therefore, the two wires W are fed in the forward direction by the frictional force generated between the first feed gear 30L and the one wire W1, the frictional force generated between the second feed gear 30R and the other wire W2, and the frictional force generated between the one wire W1 and the other wire W2.

Two wires W entering between the first feed groove 32L of the first feed gear 30L and the second feed groove 32R of the second feed gear 30R, and two wires W discharged from the first feed gear 30L and the second feed gear 30R are fed in parallel with each other in a predetermined direction by providing the parallel guides 4A on the upstream side and the downstream side of the wire feeding unit 3A with respect to the feeding direction of the wire W fed in the forward direction.

When the wire W is fed in the forward direction, the wire W passes between the fixed gripping member 70C and the second movable gripping member 70R and passes through the guide groove 52 of the first guide unit 50 of the curl guide unit 5A. As a result, the wire W is curled so as to be wound around the reinforcing bar S. The two wires W introduced into the first guide unit 50 are held in a state of being arranged in parallel by the parallel guide 4A at the cutting discharge position P3. Further, since the two wires W are fed in a state of being pressed against the outer wall surface of the guide groove 52, the wires W passing through the guide groove 52 are also held in a state of being arranged in parallel in a predetermined direction.

As illustrated in FIG. 22A, the wire W fed from the first guide unit 50 is restricted to move along the axial direction Ru1 of the loop Ru formed by the wire to be wound therearound by the movable guide unit 55 of the second guide unit 51, to be guided to the fixed guide unit 54 by the wall surface 55*a*. In FIG. 22B, the movement of the wire W along the radial direction of the loop Ru, which is guided to the fixed guide unit 54, is restricted by the wall surface 54*a* of the fixed guide unit 54, and the wire W is guided between the fixed gripping member 70C and the first movable gripping member 70L. Then, when the distal end of the wire W is fed to a position where it abuts against the length restricting unit 74, driving of the feed motor 33*a* is stopped.

A slight amount of wire W is fed in the forward direction until the distal end of the wire W abuts against the length restricting unit 74 and then the feeding is stopped, whereby the wire W wound around the reinforcing bar S is displaced from the state illustrated by the solid line in FIG. 22B in the direction expanding in the radial direction of the loop Ru as indicated by the two-dot chain line. When the wire W wound around the reinforcing bar S is displaced in the direction expanding in the radial direction of the loop Ru, one end WS side of the wire W guided between the fixed gripping member 70C and the first movable gripping member 70L by the gripping unit 70 is displaced backward. Therefore, as illustrated in FIG. 22B, the position of the wire W in the radial direction of the loop Ru is restricted by the wall surface 54*a* of the fixed guide unit 54, whereby the displacement of the wire W guided to the gripping unit 70 in the radial direction of the loop Ru is suppressed, and occurrence of gripping failure is suppressed. In the present embodiment, even when the one end WS side of the wire W guided between the fixed gripping member 70C and the first movable gripping member 70L is not displaced, and the wire W is displaced in a direction of spreading in the radial direction of the loop Ru, the displacement of the wire W in the radial direction of the loop Ru is suppressed by the fixed guide unit 54, thereby suppressing the occurrence of gripping failure.

As a result, the wire W is wound in a loop shape around the reinforcing bar S. At this time, as illustrated in FIG. 21B, the two wires W wound around the reinforcing bar S are held in a state in which they are arranged in parallel with each other without being twisted. When detecting that the movable guide unit 55 of the second guide unit 51 is opened by the output of the guide opening/closing sensor 56, the control unit 14A does not drive the feed motor 33*a* even when the trigger 12A is operated. Instead, notification is performed by a notifying unit (not illustrated) such as a lamp or a buzzer. This prevents occurrence of guidance failure of the wire W.

Figure 15:
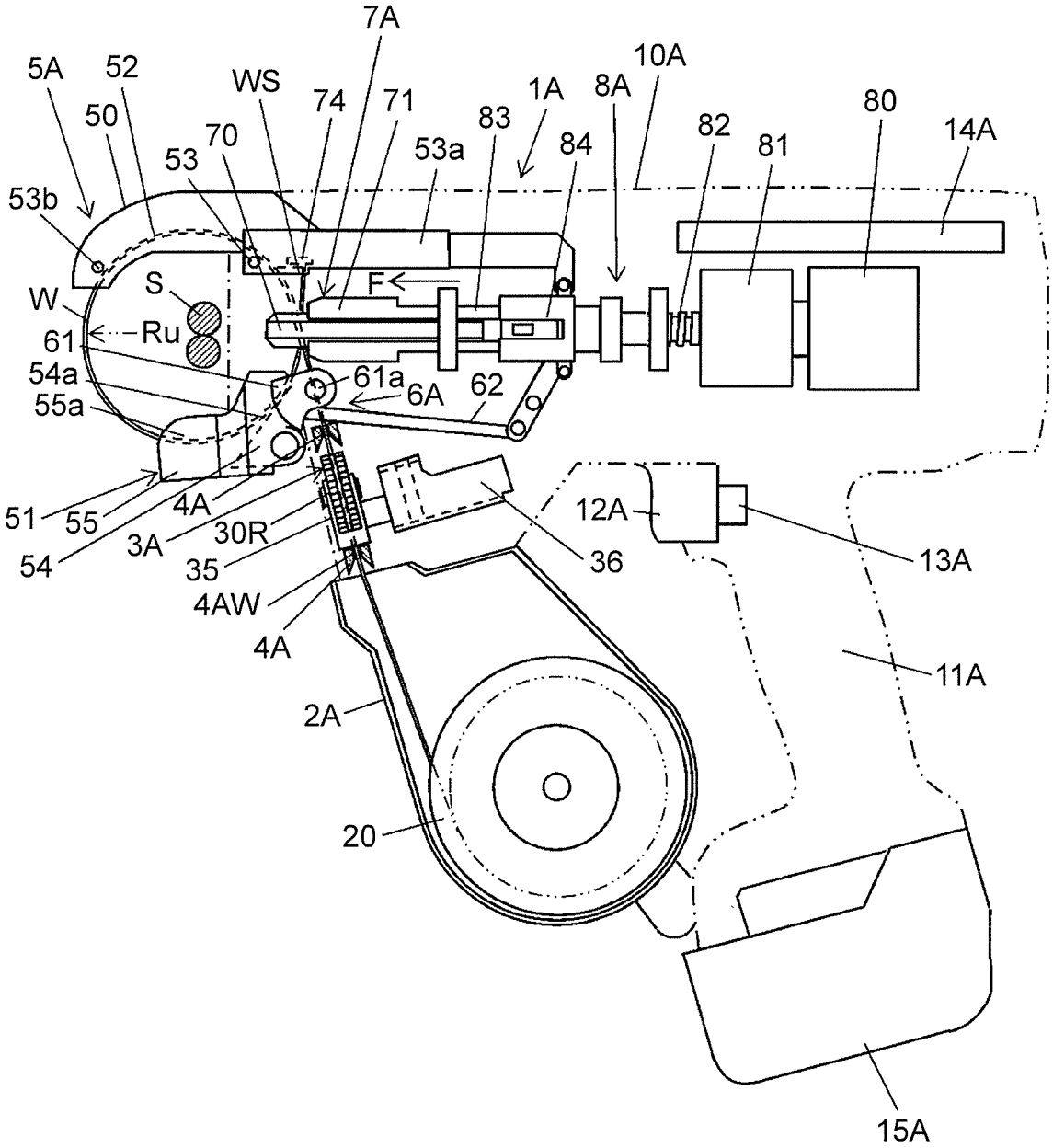
FIG. 15 is an explanatory view of an operation of the reinforcing bar binding machine of the present embodiment.

FIG. 15 illustrates a state where the wire W is gripped by the gripping unit 70. After stopping the feeding of the wire W, the motor 80 is driven in the normal rotation direction, whereby the motor 80 moves the movable member 83 in the direction of the arrow F which is the forward direction. That is, in the movable member 83, the rotation operation interlocked with the rotation of the motor 80 is restricted by the rotation restricting member 84, and the rotation of the motor 80 is converted into a linear movement. As a result, the movable member 83 moves in the forward direction. In conjunction with the operation of the movable member 83 moving in the forward direction, the first movable gripping member 70L is displaced in a direction approaching the fixed gripping member 70C, and one end WS side of the wire W is gripped.

Further, the operation of the movable member 83 moving in the forward direction is transmitted to the retreat mechanism 53*a*, and the guide pin 53 is retreated from the path through which the wire W moves.

Figure 16:
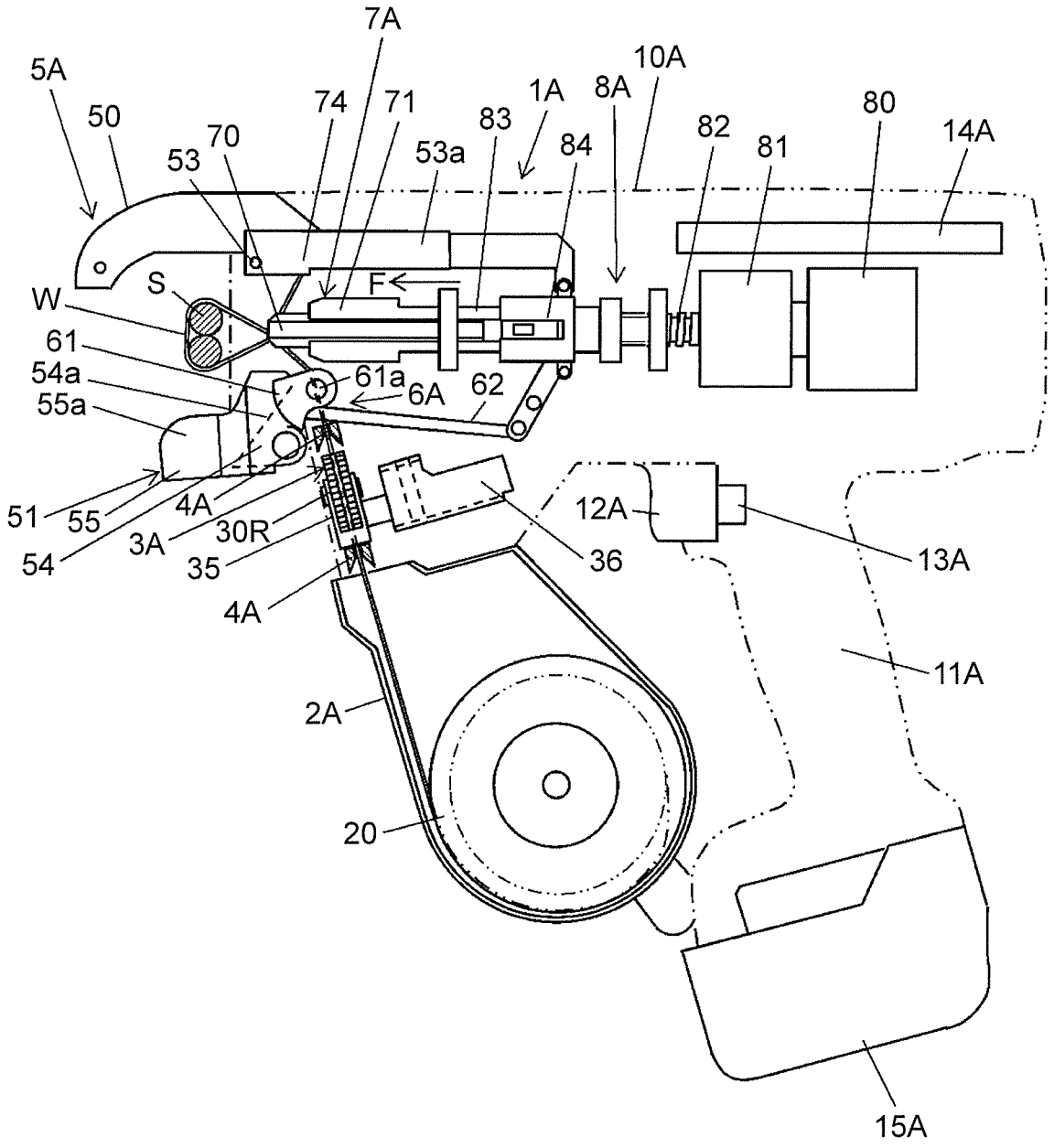
FIG. 16 is an explanatory view of an operation of the reinforcing bar binding machine of the present embodiment.

FIG. 16 illustrates a state where the wire W is wound around the reinforcing bar S. After the one end WS side of the wire W is gripped between the first movable gripping member 70L and the fixed gripping member 70C, and the feed motor 33*a* is driven in the reverse rotation direction, the first feed gear 30L rotates reversely and the second feed gear 30R rotates reversely following the first feed gear 30L.

Therefore, the two wires W are pulled back toward the magazine 2A and are fed in the opposite (backward) direction. In the operation of feeding the wire W in the backward direction, the wire W is wound so as to be in close contact with the reinforcing bar S. In this example, as illustrated in FIG. 21C, since two wires are arranged in parallel with each other, an increase in feed resistance due to twisting of the wires W in the operation of feeding the wire W in the opposite direction is suppressed. Further, in the case where the same binding strength is to be obtained between the case where the reinforcing bar S is bound with a single wire as in the conventional case and the case where the reinforcing bar S is bound with the two wires W as in this example, the diameter of each wire W can be made thinner by using two wires W. Therefore, it is easy to bend the wire W, and the wire W can be brought into close contact with the reinforcing bar S with a small force. Therefore, the wire W can be reliably wound around the reinforcing bar S in close contact with a small force. In addition, by using two thin wires W, it is easy to make the wire W in a loop shape, and it is also possible to reduce the load at the time of cutting the wire W. Along with this, it is possible to downsize each motor of the reinforcing bar binding machine 1A, and downsize the entire main body by downsizing the mechanical section. In addition, it is possible to reduce power consumption by reducing the size of the motor and reducing the load.

Figure 17:
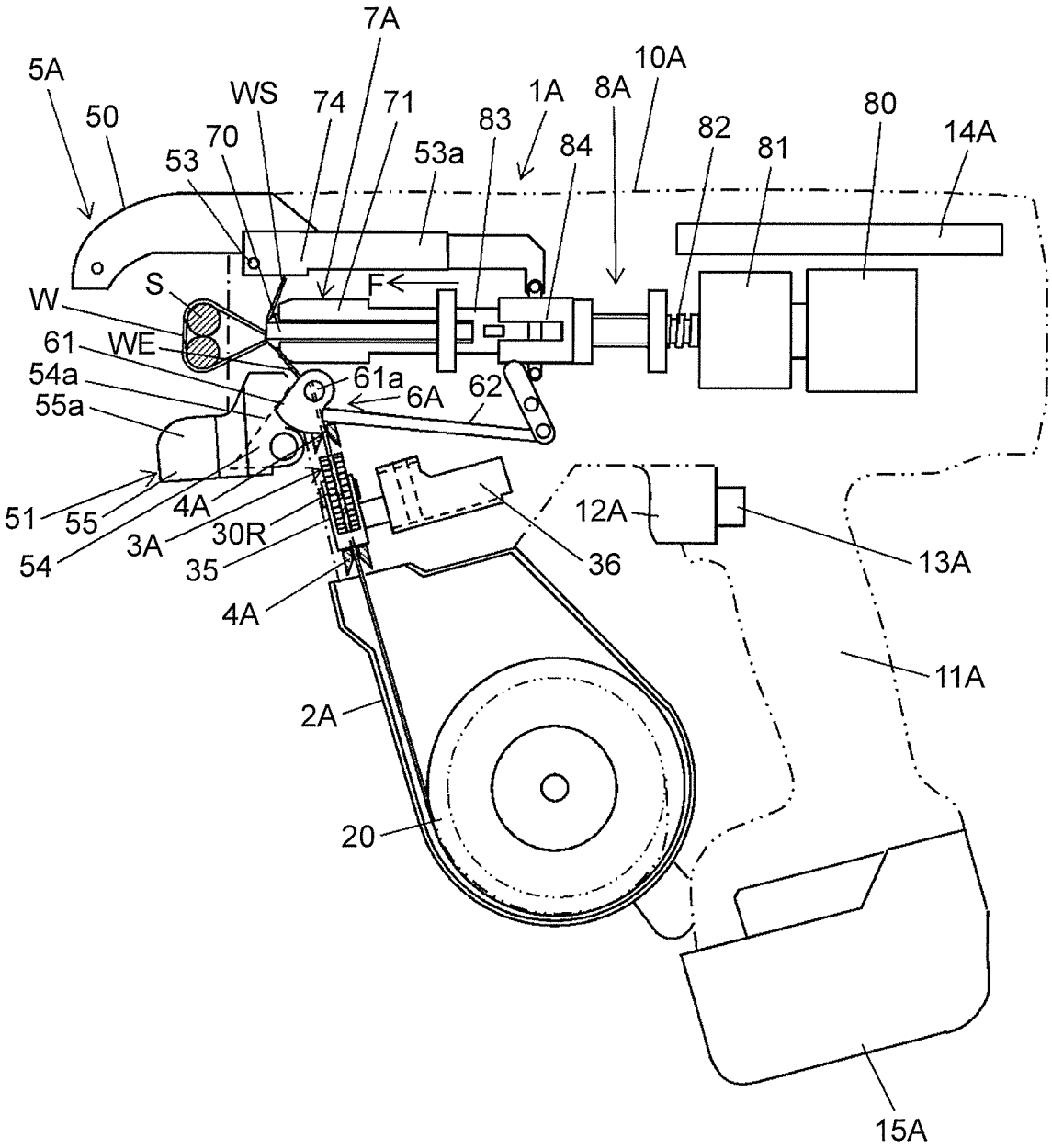
FIG. 17 is an explanatory view of an operation of the reinforcing bar binding machine of the present embodiment.

FIG. 17 illustrates a state in which the wire W is cut. After winding the wire W around the reinforcing bar S, and stopping the feeding of the wire W, the motor 80 is driven in the normal rotation direction, thereby moving the movable member 83 in the forward direction. In conjunction with the operation of the movable member 83 moving in the forward direction, the second movable gripping member 70R is displaced in a direction approaching the fixed gripping member 70C, and the wire W is gripped. In addition, the operation of the movable member 83 moving in the forward direction is transmitted to the cutting unit 6A by the transmission mechanism 62, and the other end WE side of the wire W gripped by the second movable gripping member 70R and the fixed gripping member 70C is cut by the operation of the rotary blade portion 61.

Figure 18:
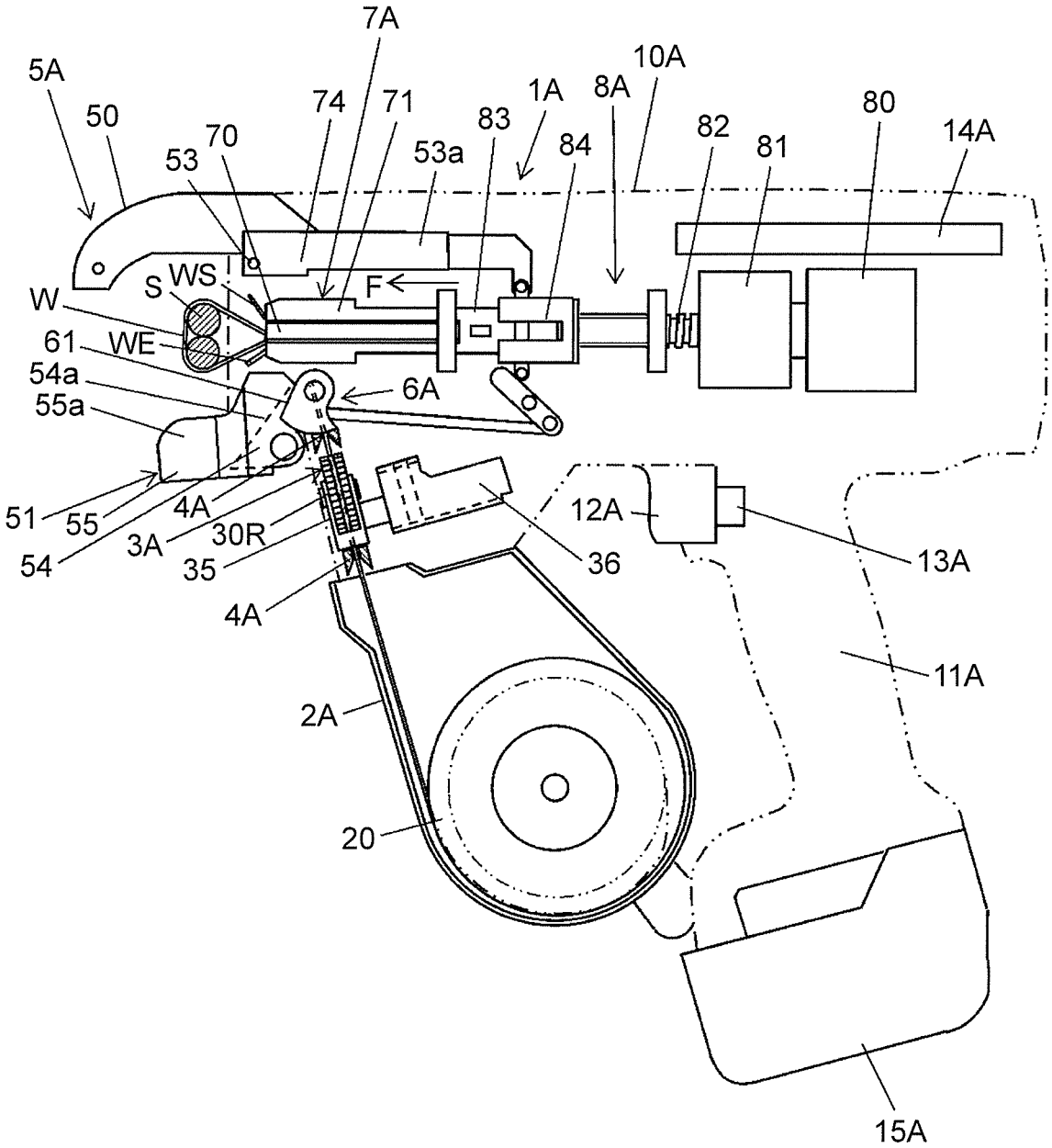
FIG. 18 is an explanatory view of an operation of the reinforcing bar binding machine of the present embodiment.

FIG. 18 illustrates a state in which the end of the wire W is bent toward the reinforcing bar S side. By moving the movable member 83 further in the forward direction after cutting the wire W, the bending portion 71 moves in the forward direction integrally with the movable member 83.

The bending portion 71 moves in the forward direction indicated by the arrow F, so that the one end WS side of the wire W gripped by the fixed gripping member 70C and the first movable gripping member 70L is bent toward the reinforcing bar S side with the gripping position as a fulcrum. Further, the bending portion 71 moves in the forward direction indicated by the arrow F, so that the other end WE side of the wire W gripped by the fixed gripping member 70C and the second movable gripping member 70R is bent with the gripping position as a fulcrum toward the reinforcing bar S side.

Specifically, as illustrated in FIGS. 23B and 23C, the bending portion 71 moves in a direction approaching the reinforcing bar S which is a forward direction indicated by an arrow F, so that the bending portion 71 includes a bending portion 71*a* which is brought into contact with one end WS side of the wire W gripped by the fixed gripping member 70C and the first movable gripping member 70L. Further, the bending portion 71 moves in the direction approaching the reinforcing bar S which is the forward direction indicated by the arrow F, so that the bending portion 71 includes a bending portion 71*b* which is brought in contact with the other end WE side of the wire W gripped by the fixed gripping member 70C and the second movable gripping member 70R.

By moving the bending portion 71 by a predetermined distance in the forward direction indicated by the arrow F, one end WS side of the wire W gripped by the fixed gripping member 70C and the first movable gripping member 70L is pressed by the bending portion 71*a* to the reinforcing bar S side and is bent toward the reinforcing bar S side with the gripping position as a fulcrum.

As illustrated in FIGS. 23A and 23B, the gripping unit 70 includes a slip preventing portion 75 (the protrusion portion 70Lb may also serve as the slip preventing portion 75) protruding toward the fixed gripping member 70C on the distal end side of the first movable gripping member 70L. One end WS side of the wire W gripped by the fixed gripping member 70C and the first movable gripping member 70L is bent toward the reinforcing bar S side with the slip preventing portion 75 as a fulcrum at the gripping position by the fixed gripping member 70C and the first movable gripping member 70L by moving the bending portion 71 in the forward direction indicated by the arrow F. In FIG. 23B, the second movable gripping member 70R is not illustrated.

Further, by moving the bending portion 71 by a predetermined distance in the forward direction indicated by the arrow F, the other end WE side of the wire W gripped by the fixed gripping member 70C and the second movable gripping member 70R is pressed to the reinforcing bar S side by the bending portion 71*b* and is bent toward the reinforcing bar S side with the gripping position as a fulcrum.

As illustrated in FIGS. 23A and 23C, the gripping unit 70 is provided with a slip preventing portion 76 protruding toward the fixed gripping member 70C at the distal end side of the second movable gripping member 70R. The bending portion 71 is moved in the forward direction indicated by the arrow F, so that the other end WE side of the wire W gripped by the fixed gripping member 70C and the second movable gripping member 70R is bent toward the reinforcing bar S side at the gripping position by the fixed gripping member 70C and the second movable gripping member 70R with the slip preventing portion 76 as a fulcrum. In FIG. 23C, the first movable gripping member 70L is not illustrated.

FIG. 19 illustrates a state in which the wire W is twisted. After the end of the wire W is bent toward the reinforcing bar S side, the motor 80 is further driven in the normal rotation direction, whereby the motor 80 further moves the movable member 83 in the direction of the arrow F which is the forward direction. When the movable member 83 moves to a predetermined position in the direction of the arrow F, the movable member 83 comes off from the locking of the rotation restricting member 84, and the regulation of rotation by the rotation restricting member 84 of the movable member 83 is released. As a result, the motor 80 is further driven in the normal rotation direction, whereby the gripping unit 70 gripping the wire W rotates and twists the wire W. The gripping unit 70 is biased backward by a spring (not illustrated), and twists the wire W while applying tension thereon. Therefore, the wire W is not loosened, and the reinforcing bar S is bound with the wire W.

FIG. 20 illustrates a state where the twisted wire W is released. After the wire W is twisted, the motor 80 is driven in the reverse rotation direction, so that the motor 80 moves the movable member 83 in the backward direction indicated by the arrow R. That is, in the movable member 83, the rotation operation interlocked with the rotation of the motor 80 is restricted by the rotation restricting member 84, and the rotation of the motor 80 is converted into a linear movement. As a result, the movable member 83 moves in the backward direction. In conjunction with the operation of the movable member 83 moving in the backward direction, the first movable gripping member 70L and the second movable gripping member 70R are displaced in a direction away from the fixed gripping member 70C, and the gripping unit 70 releases the wire W. When the binding of the reinforcing bar S is completed and the reinforcing bar S is pulled out from the reinforcing bar binding machine 1A, conventionally, the reinforcing bar S may be caught by the guide unit and it may be difficult to remove, which deteriorates workability in some cases. On the other hand, by configuring the movable guide unit 55 of the second guide unit 51 to be rotatable in the arrow H direction, when the reinforcing bar S is pulled out from the reinforcing bar binding machine 1A, the movable guide unit 55 of the second guide unit 51 does not catch the reinforcing bar S, and thus workability is improved.

<Example of Operational Effect of Reinforcing Bar Binding Machine of the Embodiment>

Figure 24A:
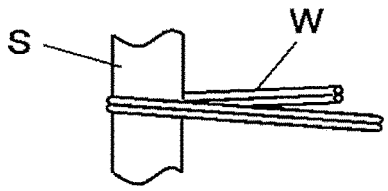
FIG. 24A is an operational effect example of the reinforcing bar binding machine of the present embodiment.
Figure 24B:
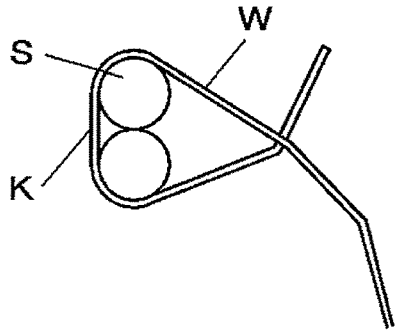
FIG. 24B is an operational effect example of the reinforcing bar binding machine of the present embodiment.
Figure 24C:
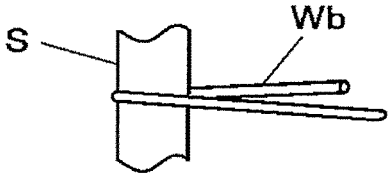
FIG. 24C is an example of the operation and problem of the reinforcing bar binding machine according to the related art.
Figure 24D:
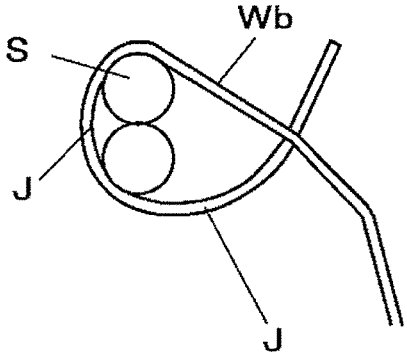
FIG. 24D is an example of the operation and problem of the reinforcing bar binding machine according to the related art.
Figure 25A:
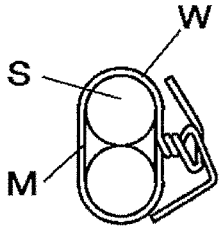
FIG. 25A is an operational effect example of the reinforcing bar binding machine of the present embodiment.
Figure 25B:
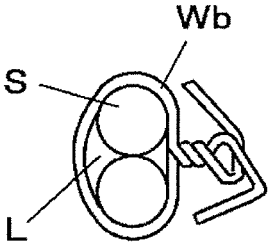
FIG. 25B is an example of the operation and problem of the reinforcing bar binding machine according to the related art.

FIGS. 24A, 24B, and 25A show examples of operational effects of the reinforcing bar binding machine of the present embodiment, and FIGS. 24C, 24D, and 25B are examples of the operation and problems of the conventional reinforcing bar binding machine (note that, for example in FIG. 25B, the lack of tightness that can be encountered with conventional arrangements is shown, however, 25B also shows an advantageous bending arrangement not present in conventional arrangements—in other words, the entirety of FIG. 25B is not prior art although FIG. 25B illustrates a looseness issue that can be encountered in prior arrangement). Hereinbelow, an example of the operational effects of the reinforcing bar binding machine according to the present embodiment as compared with the related art will be described with respect to the operation of binding the reinforcing bar S with the wire W.

As illustrated in FIG. 24C, in the conventional configuration in which one wire Wb having a predetermined diameter (for example, about 1.6 mm to 2.5 mm) is wound around the reinforcing bar S, as illustrated in FIG. 24D, since the rigidity of the wire Wb is high, unless the wire Wb is wound around the reinforcing bar S with a sufficiently large force, slack J occurs during the operation of winding the wire Wb, and a gap is generated between the wire and the reinforcing bar S.

On the other hand, as illustrated in FIG. 24A, in the present embodiment in which two wires W having a small diameter (for example, about 0.5 mm to 1.5 mm) are wound around the reinforcing bar S as compared with the conventional case, as illustrated in FIG. 24B, since the rigidity of the wire W is lower than that of the conventional wire, even if the wire W is wound around the reinforcing bar S with a lower force than the conventional case, slack in the wire W occurring during the operation of winding the wire W is suppressed, and the wire is surely wound around the reinforcing bar S at the linear portion K. Considering the function of binding the reinforcing bar S with the wire W, the rigidity of the wire W varies not only by the diameter of the wire W but also by the material thereof etc. For example, in the present embodiment, the wire W having a diameter of about 0.5 mm to 1.5 mm is described as an example. However, if the material of the wire W is also taken into consideration, between the lower limit value and the upper limit value of the diameter of the wire W, at least a difference of about tolerance may occur.

Further, as illustrated in FIG. 25B, in the conventional configuration in which one wire Wb having a predetermined diameter is wound around the reinforcing bar S and twisted, since the rigidity of the wire Wb is high, even in the operation of twisting the wire Wb, the slack of the wire Wb is not eliminated, and a gap L is generated between the wire and the reinforcing bar S.

On the other hand, as illustrated in FIG. 25A, in the present embodiment in which two wires W having a smaller diameter are wound around the reinforcing bar S and twisted as compared with the related art, the rigidity of the wire W is lower as compared with the conventional one, by the operation of twisting the wire W, the gap M between the reinforcing bar S and the wire can be suppressed small as compared with the conventional case, whereby the binding strength of the wire W is improved.

By using the two wires W, it is possible to equalize the reinforcing bar holding force as compared with the conventional case, and to suppress the deviation between the reinforcing bars S after the binding. In the present embodiment, two wires W are simultaneously (together) fed, and the reinforcing bars S are bound using the two wires W fed simultaneously. Feeding the two wires W at the same time means that when one wire W and the other wire W are fed at substantially the same speed, that is, when the relative speed of the other wire W to one wire W is substantially 0. In this example, the meaning is not necessarily limited to this meaning. For example, even when one wire W and the other wire W are fed at different speeds (timings), the two wires W are advanced in parallel in the feed path of the wire W in a state that the two wires W are arranged in parallel with each other, so, as long as the wire W is set to be wound around the reinforcing bar S in the parallel state, it means that two wires are fed at the same time. In other words, the total area of the cross-sectional area of each of the two wires W is a factor determining the reinforcing bar holding force, so even if the timings of feeding the two wires W are deviated, in terms of securing the reinforcing bar holding force, the same result can be obtained. However, compared to the operation of shifting the timing of feeding the two wires W, since it is possible to shorten the time required for feeding for the operation of simultaneously feeding the two wires W, it is preferable to feed the two wires W simultaneously, resulting in improvement of the binding speed. Therefore, the wire feeding unit feeds the two or more wires together.

Figure 26A:
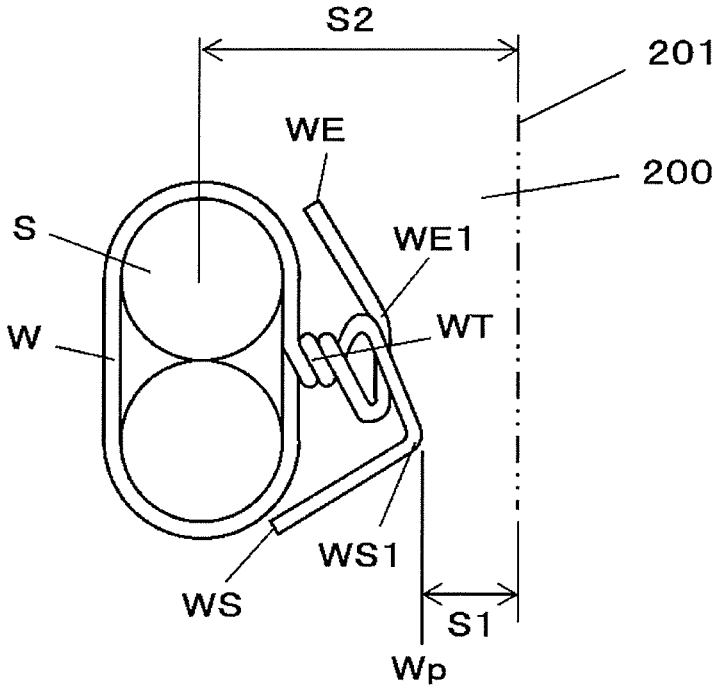
FIG. 26A is an operational effect example of the reinforcing bar binding machine of the present embodiment.
Figure 26B:
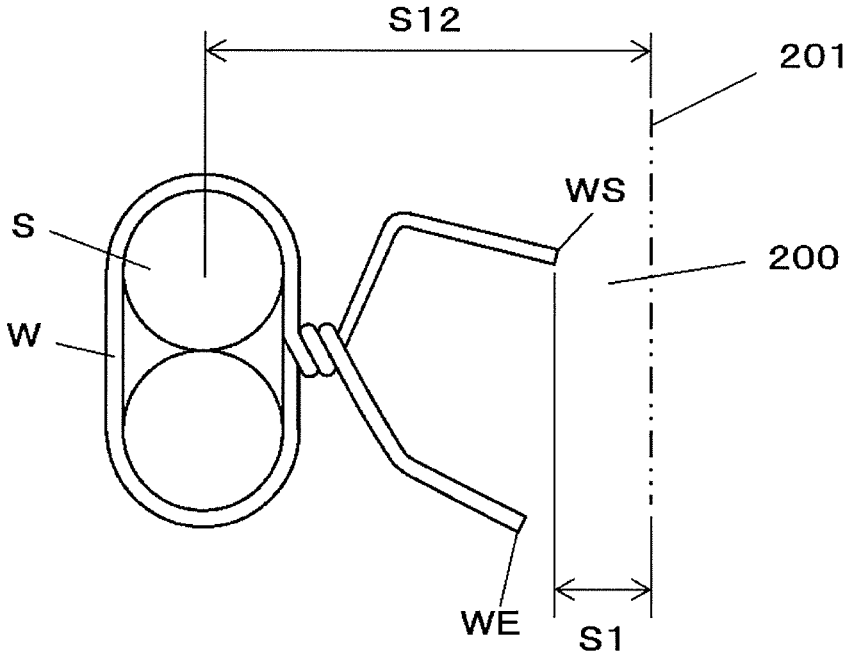
FIG. 26B is an example of the operation and problem of the reinforcing bar binding machine according to the related art.

FIG. 26A illustrates an example of the operational effect of the reinforcing bar binding machine of this embodiment, and FIG. 26B illustrates an example of an operation and a problem of the conventional reinforcing bar binding machine. Hereinbelow, an example of the operational effect of the reinforcing bar binding machine of the present embodiment as compared with the conventional one on the form of the wire W binding the reinforcing bar S will be described.

As illustrated in FIG. 26B, one end WS and the other end WE of the wire W are oriented in the opposite direction to the reinforcing bar S in the wire W bound to the reinforcing bar S in the conventional reinforcing bar binding machine. Therefore, one end WS and the other end WE of the wire W, which are the distal end side of the twisted portion of the wire W binding the reinforcing bar S largely protrude from the reinforcing bar S. If the distal end side of the wire W protrudes largely, there is a possibility that the protruding portion interferes with the operation and hinders work.

Also, after the reinforcing bars S are bound, the concrete 200 is poured into the place where the reinforcing bars S are laid. At this time, in order to prevent the one end WS and the other end WE of the wire W from protruding from the concrete 200, the thickness from the tip of the wire W bound to the reinforcing bar S, in the example of FIG. 26B, the thickness from the one end WS of the wire W to the surface 201 of the concrete 200 that has been poured is necessarily kept at a predetermined dimension S1. Therefore, in a configuration in which the one end WS and the other end WE of the wire W face the direction opposite to the reinforcing bar S, the required thickness S12 from the laying position of the reinforcing bar S to the surface 201 of the concrete 200 becomes large.

On the other hand, in the reinforcing bar binding machine 1A of the present embodiment, the wire W is bent by the bending portion 71 such that one end WS of the wire W wound around the reinforcing bar S is located closer to the reinforcing bar S than the first bent portion WS1 which is a bent portion of the wire W, and the other end WE of the wire W wound around the reinforcing bar S is located closer to the reinforcing bar S than the second bent portion WE1 which is a bent portion of the wire W. In the reinforcing bar binding machine 1A of the present embodiment, the wire W is bent by the bending portion 71 such that one of (i) the bent portion bent by the preliminary bending portion 72 in the operation of gripping the wire W by the first movable gripping member 70L and the fixed gripping member 70C and (ii) the bent portion bent by the fixed gripping member 70C and the second movable gripping member 70R in the operation of binding the wire W around the reinforcing bar S, becomes the top portion of the wire W. The top portion is the most protruding portion in the direction in which the wire W is separated from the reinforcing bar S and the highest vertical position.

As a result, as illustrated in FIG. 26A, the wire W bound to the reinforcing bar S in the reinforcing bar binding machine 1A according to the present embodiment has the first bent portion WS1 between the twisted portion WT and one end WS, and one end WS side of the wire W is bent toward the reinforcing bar S side so that one end WS of the wire W is located closer to the reinforcing bar S than the first bent portion WS1 and at a lower vertical position. The second bent portion WE1 is formed between the twisted portion WT and the other end WE of the wire W. The other end WE side of the wire W is bent toward the reinforcing bar S side so that the other end WE of the wire W is located closer to the reinforcing bar S side than the second bent portion WE1 and at a lower vertical position.

In the example illustrated in FIG. 26A, two bent portions, in this example, the first bent portion WS1 and the second bent portion WE1, are formed on the wire W. Of the two, in the wire W bound to the reinforcing bar S, the first bent portion WS1 protruding most in the direction away from the reinforcing bar S (the direction opposite to the reinforcing bar S) is the top portion Wp. Both of the one end WS and the other end WE of the wire W are bent so as not to protrude beyond the top portion Wp in the direction opposite to the reinforcing bar S.

In this manner, by setting one end WS and the other end WE of the wire W so as not to protrude beyond the top portion Wp constituted by the bent portion of the wire W in the direction opposite to the reinforcing bar S, it is possible to suppress a decrease in workability due to the protrusion of the end of the wire W. Since one end WS side of the wire W is bent toward the reinforcing bar S side and the other end WE side of the wire W is bent toward the reinforcing bar S side, the amount of protrusion on the distal end side from the twisted portion WT of the wire W is less than the conventional case. Therefore, the thickness S2 from the laying position of the reinforcing bar S to the surface 201 of the concrete 200 can be made thinner than the conventional one. Therefore, it is possible to reduce the amount of concrete to be used.

In the reinforcing bar binding machine 1A of the present embodiment, the wire W is wound around the reinforcing bar S by feeding in the forward direction, and one end WS side of the wire W wound and attached around the reinforcing bar S by feeding the wire W in the opposite direction is bent toward the reinforcing bar S side by the bedding portion 71 in a state of being gripped by the fixed gripping member 70C and the first movable gripping member 70L. Further, the other end WE side of the wire W cut by the cutting unit 6A is bent toward the reinforcing bar S side by the bending portion 71 in a state of being gripped by the fixed gripping member 70C and the second movable gripping member 70R.

As a result, as illustrated in FIG. 23B, the gripping position by the fixed gripping member 70C and the first movable gripping member 70L is taken as a fulcrum 71*c*1, and as illustrated in FIG. 23C, the gripping position by the fixed gripping member 70C and the second movable gripping member 70R is taken as a fulcrum 71*c*2, the wire W can be bent. In addition, the bending portion 71 can apply a force that presses the wire W in the direction of the reinforcing bar S by displacement in a direction approaching the reinforcing bar S.

As described above, in the reinforcing bar binding machine 1A of the present embodiment, since the wire W is gripped securely at the gripping position and the wire W is bent with the fulcrums 71*c*1 and 71*c*2, it is possible that the force pressing the wire W is reliably applied to a desired direction (the reinforcing bar S side) without being dispersed to the other direction, thereby reliably bending the ends WS and WE sides of the wire W in the desired direction (the reinforcing bar S side).

On the other hand, for example, in the conventional binding machine that applies a force in a direction in which the wire W is twisted in a state where the wire W is not gripped, the end of the wire W can be bent in a direction that twists the wire W, but a force to bend the wire W is applied in the state where the wire W is not gripped, so that the direction of bending the wire W is not fixed and the end of the wire W may face outward opposite to the reinforcing bar S in some cases.

However, in the present embodiment, as described above, since the wire W is firmly gripped at the gripping position and the wire W is bent with the fulcrums 71*c*1 and 71*c*2, the ends WS and WE sides of the wire W can reliably be directed to the reinforcing bar S side.

Further, if the end of the wire W is to be bent toward the reinforcing bar S side after twisting the wire W to bind the reinforcing bar S, there is a possibility that the binding place where the wire W is twisted is loosened and the binding strength decreases. Furthermore, when twisting the wire W to bind the reinforcing bar S and then trying to bend the wire end by applying a force in a direction in which the wire W is twisted further, there is a possibility that the binding place where the wire W is twisted is damaged.

On the other hand, in the present embodiment, one end WS side and the other end WE side of the wire W are bent toward the reinforcing bar S side before twisting the wire W to bind the reinforcing bar S, so that the binding place where the wire W is twisted does not become loosened and the binding strength does not decrease. Also, after twisting the wire W to bind the reinforcing bar S, no force is applied in the direction of twisting the wire W, so that the binding place where the wire W is twisted is not damaged.

Figure 27A:
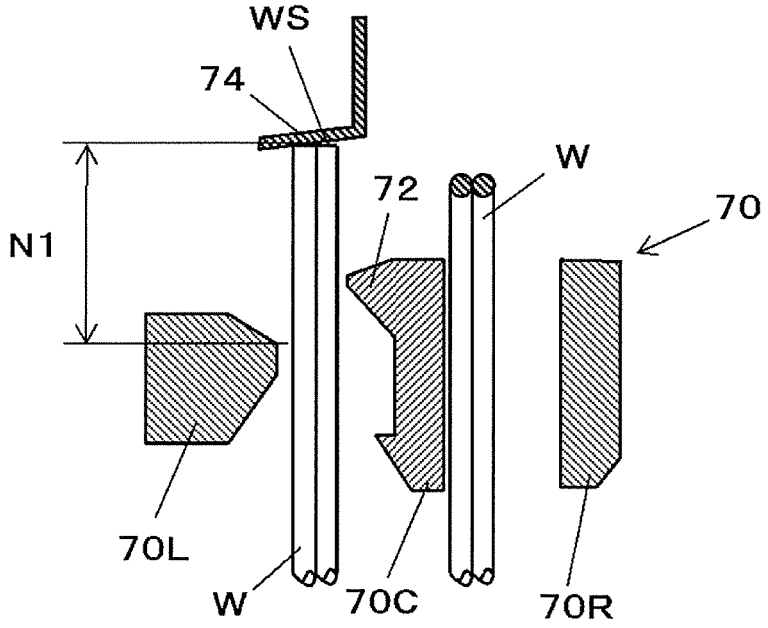
FIG. 27A is an operational effect example of the reinforcing bar binding machine of the present embodiment.
Figure 27B:
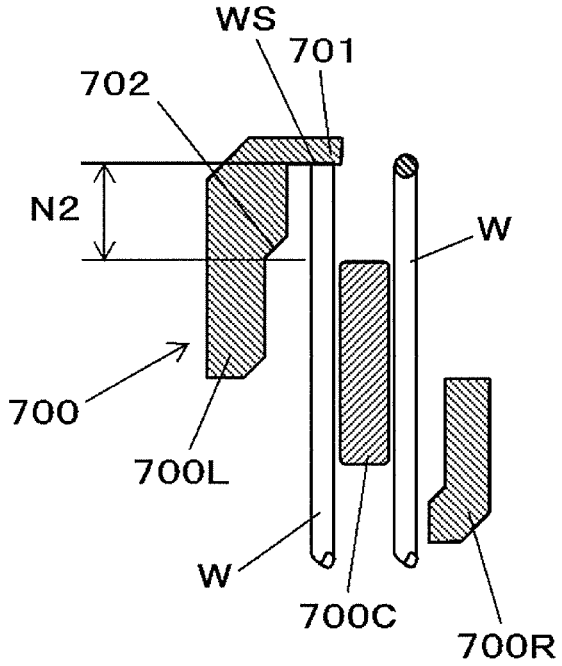
FIG. 27B is an example of the operation and problem of the reinforcing bar binding machine according to the related art.
Figure 28A:
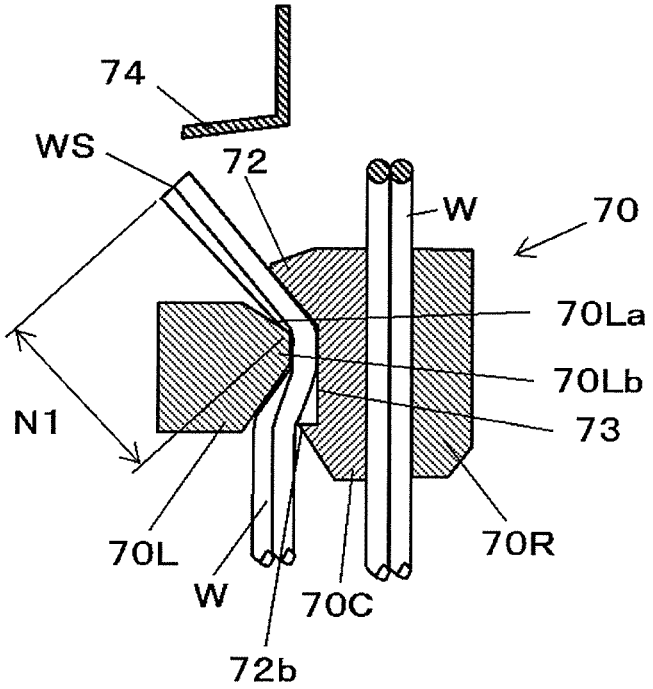
FIG. 28A is an operational effect example of the reinforcing bar binding machine of the present embodiment.
Figure 28B:
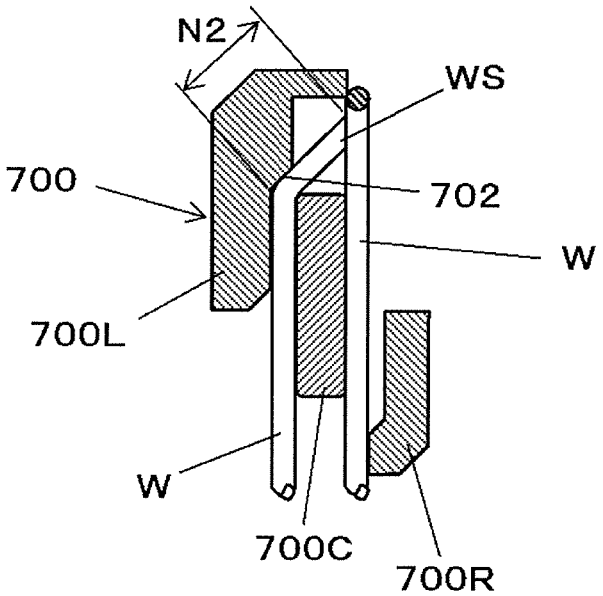
FIG. 28B is an example of the operation and problem of the reinforcing bar binding machine according to the related art.

FIGS. 27A and 28A show examples of operational effects of the reinforcing bar binding machine according to the present embodiment, and FIGS. 27B and 28B show examples of the operations and problems of the conventional reinforcing bar binding machine. Hereinbelow, an example of the operational effect of the reinforcing bar binding machine according to the present embodiment as compared with the conventional one will be described in terms of prevention of the wire W coming out from the gripping unit in the operation of winding the wire W around the reinforcing bar S.

As illustrated in FIG. 27B, the conventional gripping unit 700 of the reinforcing bar binding machine includes a fixed gripping member 700C, a first movable gripping member 700L, and a second movable gripping member 700R, and a length restricting unit 701 against which the wire W wound around the reinforcing bar S abuts is provided in the first movable gripping member 700L.

In the operation of feeding the wire W in the backward direction (pulling back) and winding it around the reinforcing bar S and the operation of twisting the wire W by the gripping unit 700, the wire W gripped by the fixed gripping member 700C and the first movable gripping member 700L is likely to come off when the distance N2 from the gripping position of the wire W by the fixed gripping member 700C and the first movable gripping member 700L to the length restricting unit 701 is short.

In order to make it difficult for the gripped wire W to come off, it is simply necessary to lengthen the distance N2. However, for this purpose, it is necessary to lengthen the distance from the gripping position of the wire W in the first movable gripping member 700L to the length restricting unit 701.

However, if the distance from the gripping position of the wire W in the first movable gripping member 700L to the length restricting unit 701 is increased, the size of the first movable gripping member 700L is increased. Therefore, in the conventional configuration, it is not possible to lengthen the distance N2 from the gripping position of the wire W by the fixed gripping member 700C and the first movable gripping member 700L to one end WS of the wire W.

On the other hand, as illustrated in FIG. 27A, in the gripping unit 70 of the present embodiment, the length restricting unit 74 where the wire W abuts is set to be a separate component independent from the first movable gripping member 70L.

This makes it possible to lengthen the distance N1 from the gripping position of the wire W in the first movable gripping member 70L to the length restricting unit 74 without increasing the size of the first movable gripping member 70L.

Therefore, even if the first movable gripping member 70L is not enlarged, it is possible to prevent the wire W gripped by the fixed gripping member 70C and the first movable gripping member 70L from coming off during the operation of feeding the wire W in the backward direction to wind around the reinforcing bar S and the operation of twisting the wire W by the gripping unit 70.

As illustrated in FIG. 28B, the conventional gripping unit 700 of the reinforcing bar binding machine is provided with, on the surface of the first movable gripping member 700L facing the fixed gripping member 700C, a protrusion protruding toward the fixed gripping member 700C and a recess into which the fixed gripping member 700C is inserted, thereby forming a preliminary bending portion 702.

As a result, in the operation of gripping the wire W by the first movable gripping member 700L and the fixed gripping member 700C, one end WS side of the wire W protruding from the gripping position by the first movable gripping member 700L and the fixed gripping member 700C is bent, and in the operation of feeding the wire W in the backward direction to wind around the reinforcing bar S and the operation of twisting the wire W by the gripping unit 700, the effect of preventing the wire W from coming off can be obtained.

However, since one end WS side of the wire W is bent inward toward the wire W passing between the fixed gripping member 700C and the second movable gripping member 700R, the bent one end WS side of the wire W may be caught in contact with the wire W to be fed in the backward direction for winding around the reinforcing bar S.

When the bent one end WS side of the wire W is caught by the wire W that is fed in the backward direction for winding around the reinforcing bar S, there is a possibility that the winding of the wire W becomes insufficient or the twisting of the wire W is insufficient.

On the other hand, in the gripping unit 70 of the present embodiment, as illustrated in FIG. 28A, on the surface facing the first movable gripping member 70L of the fixed gripping member 70C, a protrusion protruding toward the first movable gripping member 70L and a recess into which the first movable gripping member 70L is inserted are provided to form the preliminary bending portion 72.

Therefore, in the operation of gripping the wire W by the first movable gripping member 70L and the fixed gripping member 70C, one end WS side of the wire W protruding from the gripping position by the first movable gripping member 70L and the fixed gripping member 70C is bent, and in the operation of feeding the wire W in the backward direction to wind around the reinforcing bar S, and the operation of twisting the wire W by the gripping unit 70, the effect of preventing the wire W from coming off can be obtained.

One end WS side of the wire W is bent to the outside opposite to the wire W passing between the fixed gripping member 70C and the second movable gripping member 70R, so that it is suppressed that the bent one end WS side of the wire W is in contact with the wire W fed in the backward direction to wind around the reinforcing bar S.

Thus, in the operation of feeding the wire W in the backward direction to wind around the reinforcing bar S, it is prevented that the wire W comes off from the gripping unit 70, thereby surely winding the wire W, and in the operation of twisting the wire W, it is possible to reliably perform the binding of the wire W.

Figure 29A:
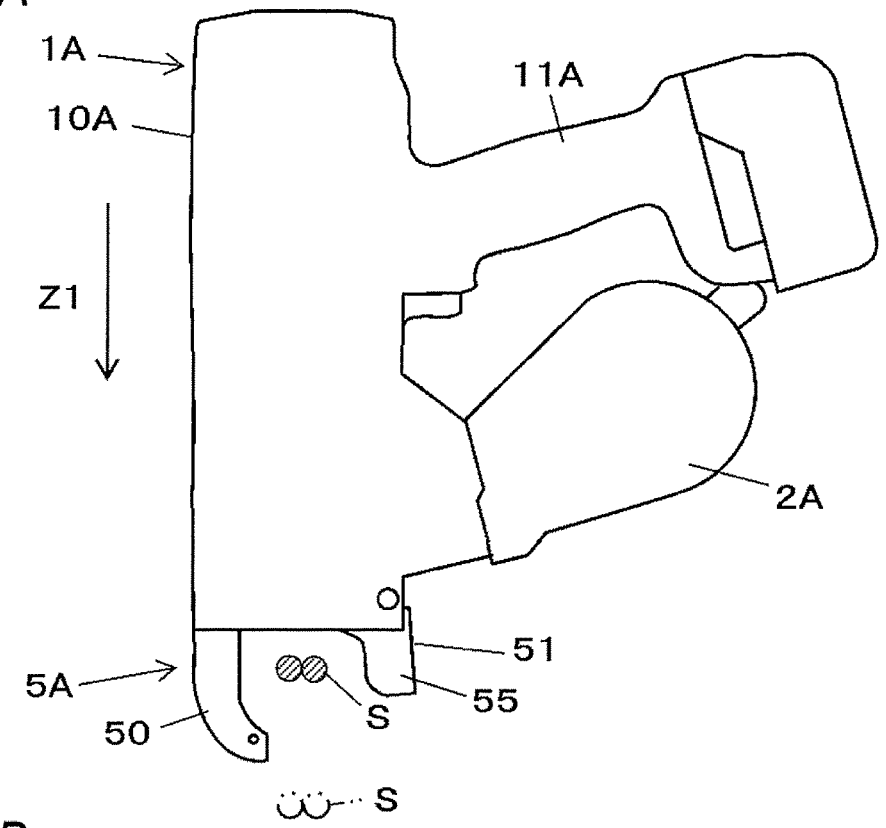
FIG. 29A is an operational effect example of the reinforcing bar binding machine of the present embodiment.
Figure 29B:
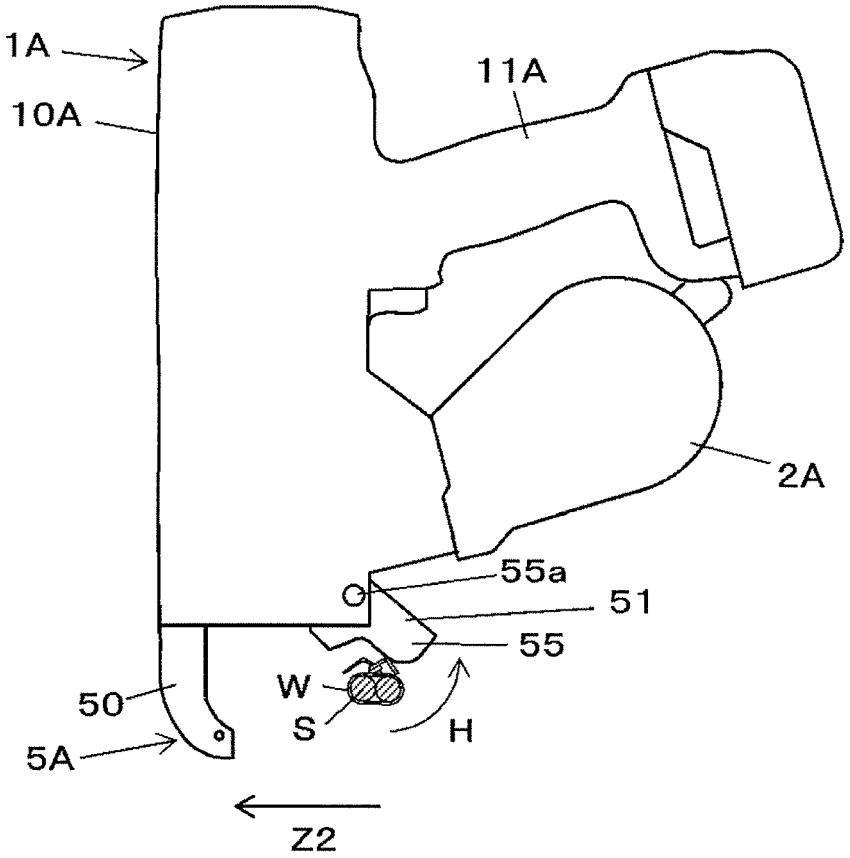
FIG. 29B is an operational effect example of the reinforcing bar binding machine of the present embodiment.

FIGS. 29A and 29B are examples of the operational effects of the reinforcing bar binding machine of the present embodiment. Hereinbelow, examples of the operational effects of the reinforcing bar binding machine of this embodiment with respect to the operation of inserting the reinforcing bars into the curl guide unit and the operation of pulling the reinforcing bar from the curl guide unit will be described. For example, in the case of binding the reinforcing bars S constituting the base with the wire W, in the work using the reinforcing bar binding machine 1A, the opening between the first guide unit 50 and the second guide unit 51 of the curl guide unit 5A faces downward.

When performing a binding operation, the opening between the first guide unit 50 and the second guide unit 51 is directed downward, and the reinforcing bar binding machine 1A is moved downward as indicated by an arrow Z1 as illustrated in FIG. 29A, the reinforcing bar S enters the opening between the first guide unit 50 and the second guide unit 51.

When the binding operation is completed and the reinforcing bar binding machine 1A is moved in the lateral direction indicated by the arrow Z2 as illustrated in FIG. 29B, the second guide unit 51 is pressed against the reinforcing bar S bound by the wire W, and the movable guide unit 55 on the distal end side of the second guide unit 51 rotates in the direction of the arrow H around the shaft 55*b* as a fulcrum.

Therefore, every time the wire W is bound to the reinforcing bar S, the binding work can be performed successively only by moving the reinforcing bar binding machine 1A in the lateral direction without lifting the reinforcing bar binding machine 1A every time. Therefore, (since it is sufficient to simply move the reinforcing bar binding machine 1A in the lateral direction as compared with moving the reinforcing bar binding machine 1A once upward and moving it downward) it is possible to reduce restrictions on the moving direction and the movement amount of the reinforcing bar binding machine 1A in the operation of pulling out the reinforcing bar S bound to the wire W, thereby improving working efficiency.

In addition, as illustrated in FIG. 22B, the fixed guide unit 54 of the second guide unit 51 is fixed without being displaced and capable of restricting the position in the radial direction of the wire W in the binding operation described above. Accordingly, in the operation of winding the wire W around the reinforcing bar S, the position in the radial direction of the wire W can be restricted by the wall surface 54*a* of the fixed guide unit 54, and the displacement in the direction of the wire W guided to the gripping unit 70 can be suppressed, thereby suppressing occurrence of gripping failure.

In the following, an example of the operational effect of the reinforcing bar binding machine of the present embodiment with respect to the displacement unit 34 will be described. In the reinforcing bar binding machine 1A of the present embodiment, as illustrated in FIG. 2, the displacement unit 34 includes a second displacement member 36 in a direction substantially orthogonal to the feeding direction of the wire W, on the back side of the first feed gear 30L and the second feed gear 30R, that is, between the first feed gear 30L and the second feed gear 30R and the handle portion 11A. An operation button 38 for displacing the second displacement member 36, a release lever 39 for locking and unlocking the operation button 38 are provided between the first feed gear 30L and the second feed gear 30R and the handle portion 11A.

In this way, by providing the mechanism for displacing the second feed gear 30R between the second feed gear 30R and the handle portion 11A on the back side of the second feed gear 30R, there is no need to provide a mechanism for displacing the second feed gear 30R in the feed path of the wire W that is below the first feed gear 30L and the second feed gear 30R.

This makes it possible to dispose the magazine 2A close to the wire feeding unit 3A as compared with a configuration in which a mechanism for displacing a pair of feed gears is provided between the wire feeding unit and the magazine, thereby reducing the size of the device. Further, since the operation button 38 is not provided between the magazine 2A and the wire feeding unit 3A, the magazine 2A can be disposed close to the wire feeding unit 3A.

Furthermore, since the magazine 2A can be disposed close to the wire feeding unit 3A, as illustrated in FIG. 12, in the magazine 2A housing the cylindrical reel 20, a protrusion portion 21 which protrudes in accordance with the shape of the reel 20 can be disposed above the mounting position of the battery 15A. Therefore, the protrusion portion 21 can be disposed close to the handle portion 11A, and the size of the device can be reduced.

In addition, since a mechanism for displacing the second feed gear 30R is not provided in the feed path of the wire W below the first feed gear 30L and the second feed gear 30R, a wire loading space 22 for the wire feeding unit 3A is formed in the magazine 2A, and there is no constituent element which obstructs loading of the wire W, whereby loading of the wire W can be carried out easily.

In the wire feeding unit configured by a pair of feed gears, a displacement member for separating one feed gear from the other feed gear, and a holding member that holds the displacement member in a state in which one feed gear is separated from the other feed gear. In such a configuration, when one feed gear is pushed in a direction away from the other feed gear due to deformation of the wire W or the like, there is a possibility that the displacement member may be locked to the holding member so that one feed gear is held in a state separated from the other feed gear.

If one feed gear is held in a state separated from the other feed gear, the wire W cannot be pinched by the pair of feed gears, and the wire W cannot be fed.

On the other hand, in the reinforcing bar binding machine 1A of the present embodiment, as illustrated in FIG. 5A, the first displacement member 35 and the second displacement member 36 which are displacement members for separating the second feed gear 30R from the first feed gear 30L and the operation button 38 and the release lever 39 for releasing locking and unlocking in the state where the second feed gear 30R is separated from the first feed gear 30L are made independent components.

Figure 5D:
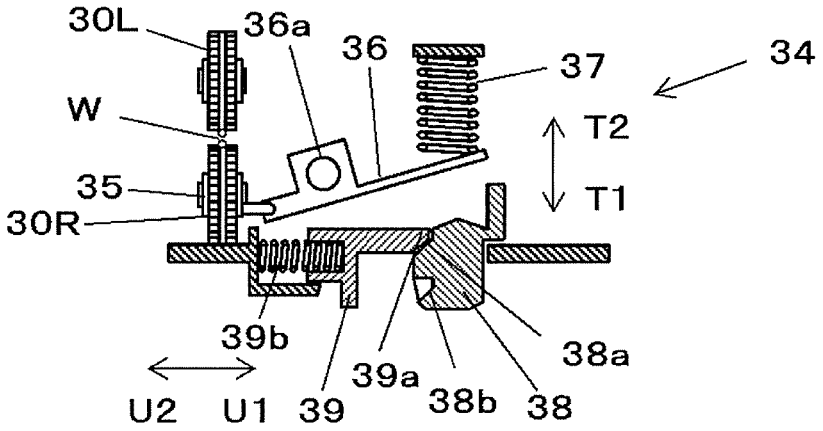
FIG. 5D is a view illustrating an example of a displacement unit of the present embodiment.

Accordingly, as illustrated in FIG. 5D, when the second feed gear 30R is pushed in a direction away from the first feed gear 30L due to deformation of the wire W or the like, the second displacement member 36 presses the spring 37 to be displaced, but it is not locked. Therefore, the second feed gear 30R can always be pressed in the direction of the first feed gear 30L by the force of the spring 37, and even if the second feed gear 30R is temporarily separated from the first feed gear 30L, the state in which the wire W is pinched by the first feed gear 30L and the second feed gear 30R can be restored, and the feeding of the wire W can be continued.

<Example of Operational Effect of Reel and Wire of the Embodiment>

As illustrated in FIG. 3, in the reel 20 of the present embodiment, two wires W are wound so as to be drawable. Then, the two wires W wound around the reel 20 are joined at a part (joint part 26) on the distal end side.

By joining the two wires W on the distal end side, it is easy to pass the two wires W through the parallel guide 4A when the wire W is loaded for the first time. In the example illustrated in the figure, the position separated by a predetermined distance from the distal end of the wire W is the joint part 26, but the distal end may be joined (that is, the distal end is the joint part 26), and the joint part 26 may be provided not only at a part of the distal end side of the wire W but also intermittently at several places. In the present embodiment, since the two wires W are joined by twisting as the joint part 26, an auxiliary member for joining is unnecessary. Furthermore, since the twisted wire is molded in conformity with the parallel guide 4, and the twisted portion is crushed, so that the number of twisting is not increased, that is, the length of the twisted portion is not increased, whereby it is possible to increase the bonding strength.

<Modified Example of Reinforcing Bar Binding Machine in the Embodiment>

FIGS. 30A, 30B, 30C, 30D, and 30E are diagrams illustrating modified examples of the parallel guide of the present embodiment. In the parallel guide 4B illustrated in FIG. 30A, the cross-sectional shape of the opening 4BW, that is, the cross-sectional shape of the opening 4BW in a direction orthogonal to the feeding direction of the wire W is formed in a rectangular shape, and the longitudinal direction and the lateral direction of the opening 4BW are formed in a straight shape. In the parallel guide 4B, the length L1 in the longitudinal direction of the opening 4BW is slightly twice or more times longer than the diameter r of the wire W in a form in which the wires W are arranged in parallel along the radial direction, and the length L2 in the lateral direction is slightly longer than the diameter r of one wire W. In the parallel guide 4B in this example, the length L1 of the opening 4BW in the longitudinal direction is slightly twice longer than the diameter r of the wire W.

Figure 30A:
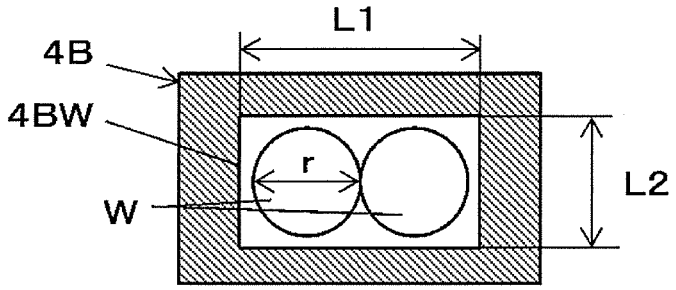
FIG. 30A is a view illustrating a modified example of the parallel guide of the present embodiment.
Figure 30B:
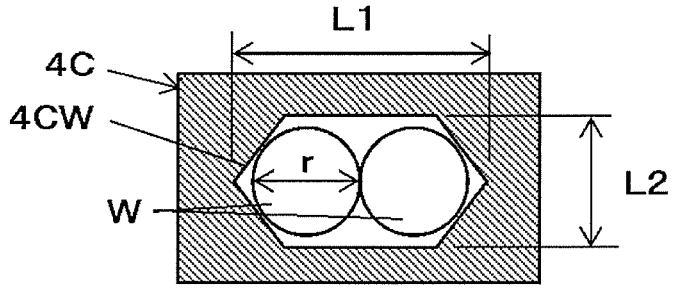
FIG. 30B is a view illustrating a modified example of the parallel guide of the present embodiment.

In the parallel guide 4C illustrated in FIG. 30B, the longitudinal direction of the opening 4CW is formed in a straight shape and the lateral direction is formed in a triangular shape. In the parallel guide 4C, in order that a plurality of wires W are arranged in parallel in the longitudinal direction of the opening 4CW and the wire W can be guided by an inclined plane in the lateral direction, the longitudinal length L1 of the opening 4CW is slightly twice or more times longer than the diameter r of the wire W in the form in which the wires W are arranged along the radial direction, and the lateral length L2 is slightly longer than the diameter r of one wire W.

Figure 30C:
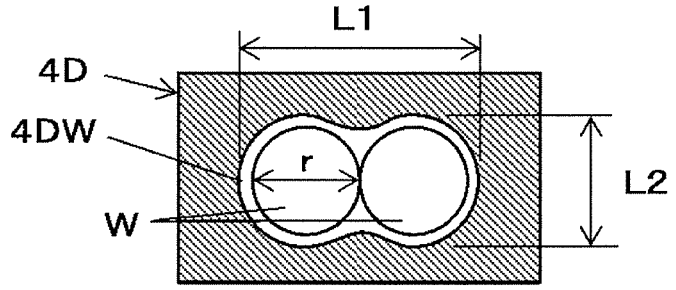
FIG. 30C is a view illustrating a modified example of the parallel guide of the present embodiment.

In the parallel guide 4D illustrated in FIG. 30C, the longitudinal direction of the opening 4DW is formed in a curved shape which is curved inward in a convex shape and the lateral direction is formed in a circular arc shape. That is, the opening shape of the opening 4DW is formed in a shape that conforms to the outer shape of the parallel wires W. In the parallel guide 4D, the length L1 in the longitudinal direction of the opening 4DW is slightly twice or more times longer than the diameter r of the wire W in the form in which the wires W are arranged along the radial direction, the length L2 in the lateral direction is slightly longer than the diameter r of one wire W. In the parallel guide 4D, in the present example, the length L1 in the longitudinal direction has a length slightly twice longer than the diameter r of the wire W.

Figure 30D:
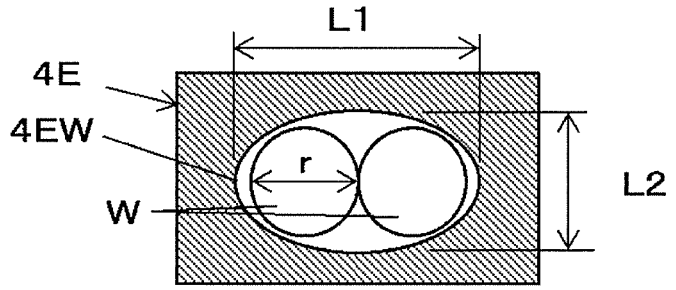
FIG. 30D is a view illustrating a modified example of the parallel guide of the present embodiment.

In the parallel guide 4E illustrated in FIG. 30D, the longitudinal direction of the opening 4EW is formed in a curved shape curved outward in a convex shape, and the lateral direction is formed in a circular arc shape. That is, the opening shape of the opening 4EW is formed in an elliptical shape. The parallel guide 4E has a length L1 in the longitudinal direction of the opening 4EW which is slightly twice or more times longer than the diameter r of the wire W in the form in which the wires W are arranged along the radial direction, and a length L2 in the lateral direction is slightly longer than the diameter r of one wire W. In this example, the parallel guide 4E has a length L1 in the longitudinal direction slightly twice longer than the diameter r of the wire W.

Figure 30E:
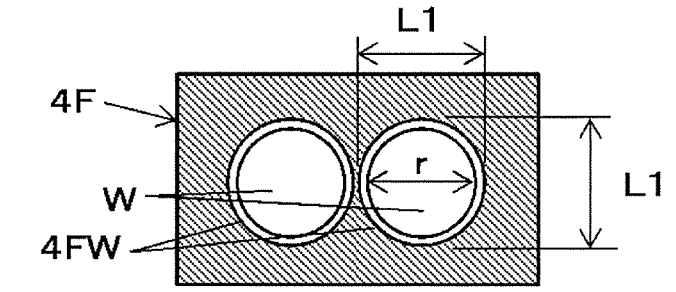
FIG. 30E is a view illustrating a modified example of the parallel guide of the present embodiment.

The parallel guide 4F illustrated in FIG. 30E includes a plurality of openings 4FW matching the number of wires W. Each wire W is passed through another opening 4FW one by one. In the parallel guide 4F, each opening 4FW has a diameter (length) L1 slightly longer than the diameter r of the wire W, and by the direction in which the openings 4FW are arranged, the direction in which a plurality of wires W are arranged in parallel is restricted.

Figure 31:
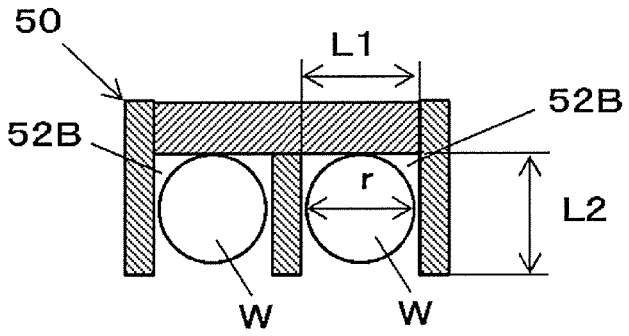
FIG. 31 is a view illustrating a modified example of the guide groove of the present embodiment.

FIG. 31 is a diagram illustrating a modified example of the guide groove of this embodiment. The guide groove 52B has a width (length) L1 and a depth L2 slightly longer than the diameter r of the wire W. Between one guide groove 52B through which one wire W passes and the other guide groove 52B through which the other wire W passes, a section wall portion is formed along the feeding direction of the wire W. The first guide unit 50 restricts the direction in which a plurality of wires are arranged in parallel with each other by the direction in which the plurality of guide grooves 52B are arranged.

Figure 32A:
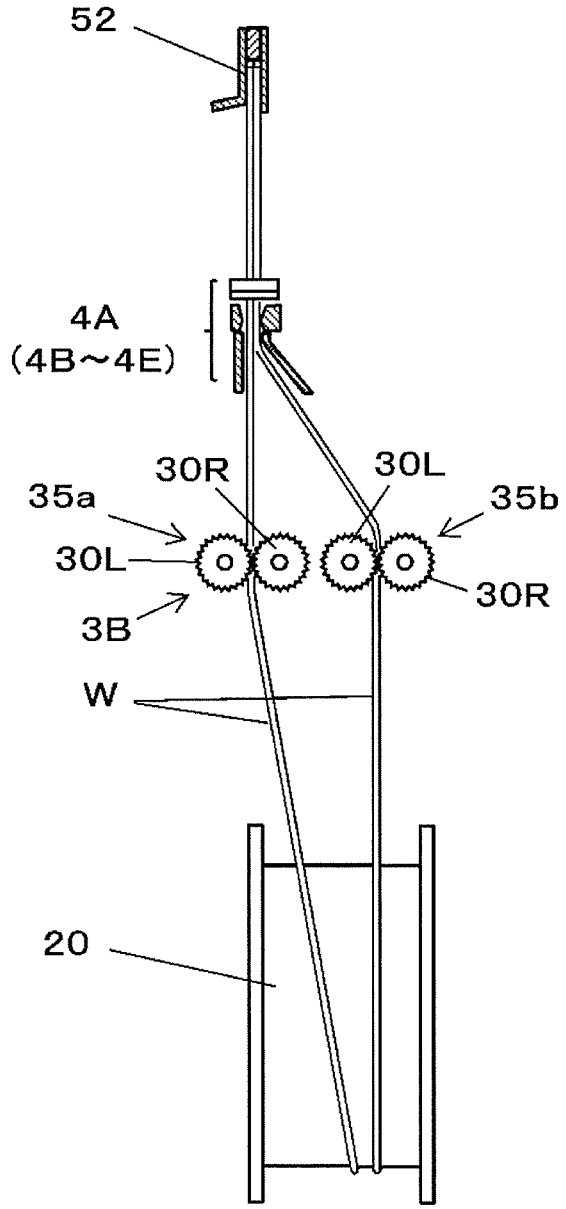
FIG. 32A is a view illustrating a modified example of the wire feeding unit according to the present embodiment.
Figure 32B:
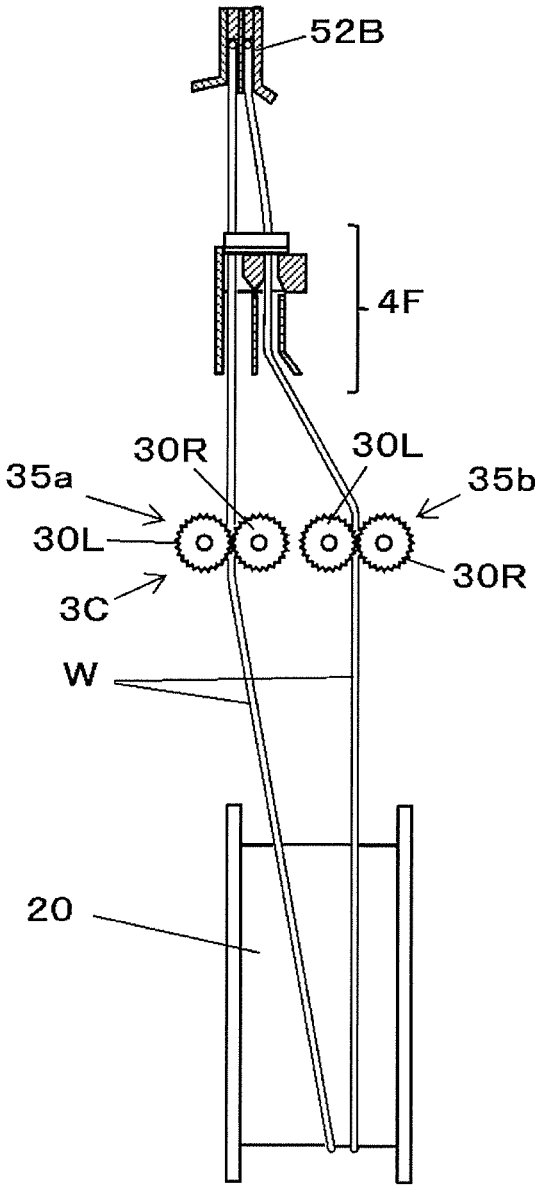
FIG. 32B is a view illustrating a modified example of the wire feeding unit according to the present embodiment.

FIGS. 32A and 32B are diagrams illustrating modified examples of the wire feeding unit according to the present embodiment. The wire feeding unit 3B illustrated in FIG. 32A includes a first wire feeding unit 35*a* and a second wire feeding unit 35*b* that feed the wires W one by one. The first wire feeding unit 35*a* and the second wire feeding unit 35*b* are provided with a first feed gear 30L and a second feed gear 30R, respectively.

Each wire W fed one by one by the first wire feeding unit 35*a* and the second wire feeding unit 35*b* is arranged in parallel in a predetermined direction by the parallel guide 4A illustrated in FIG. 6A, 6B, or 6C, or the parallel guides 4B to 4E illustrated in FIG. 30A, 30B, 30C, or 30D, and the guide groove 52 illustrated in FIG. 7.

The wire feeding unit 3C illustrated in FIG. 32B includes a first wire feeding unit 35*a* and a second wire feeding unit 35*b* that feed the wires W one by one. The first wire feeding unit 35*a* and the second wire feeding unit 35*b* are provided with a first feed gear 30L and a second feed gear 30R, respectively.

Each of the wires W fed one by one by the first wire feeding unit 35*a* and the second wire feeding unit 35*b* is arranged in parallel in a predetermined direction by the parallel guide 4F illustrated in FIG. 30E and the guide groove 52B illustrated in FIG. 32B. In the wire feeding unit 30C, since the two wires W are independently guided, if the first wire feeding unit 35*a* and the second wire feeding unit 35*b* can be independently driven, it is also possible to shift the timing to feed the two wires W. Even if the operation of winding the reinforcing bar S is performed by starting the feeding of the other wire W from the middle of the operation of winding the reinforcing bar S with one of the two wires W, the two wires W are regarded to be fed at the same time. Also, although feeding of two wires W is started at the same time, when the feeding speed of one wire W is different from the feeding speed of the other wire W, the two wires W are regarded to be simultaneously fed as well.

Figure 33:
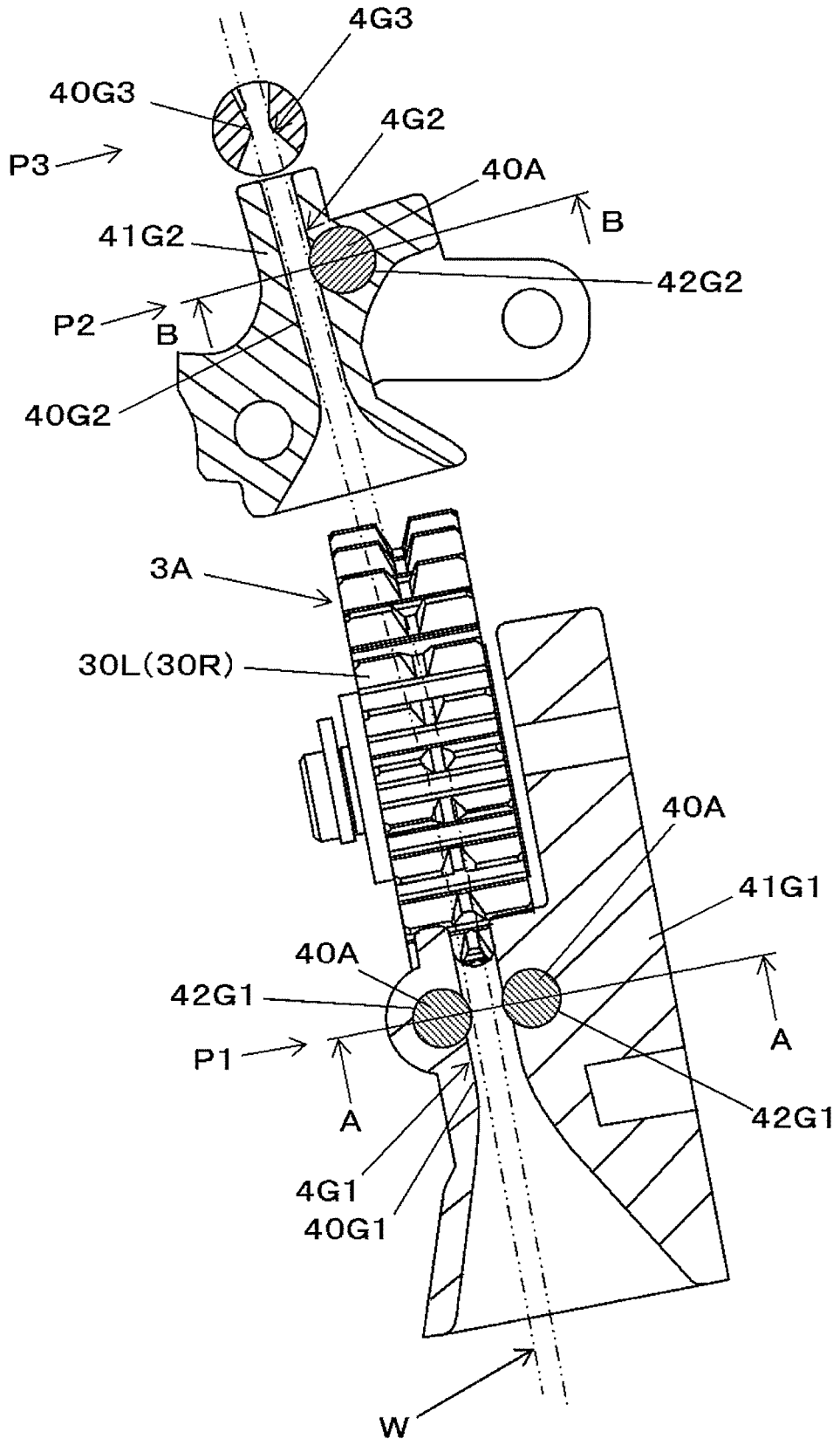
FIG. 33 is a view illustrating an example of a parallel guide according to another embodiment.
Figure 34A:
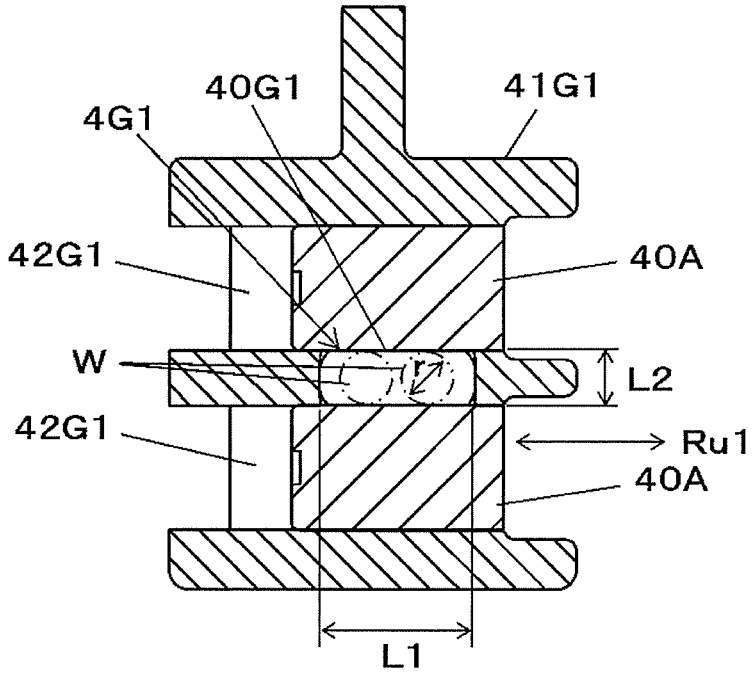
FIG. 34A is a view illustrating an example of a parallel guide according to another embodiment.
Figure 34B:
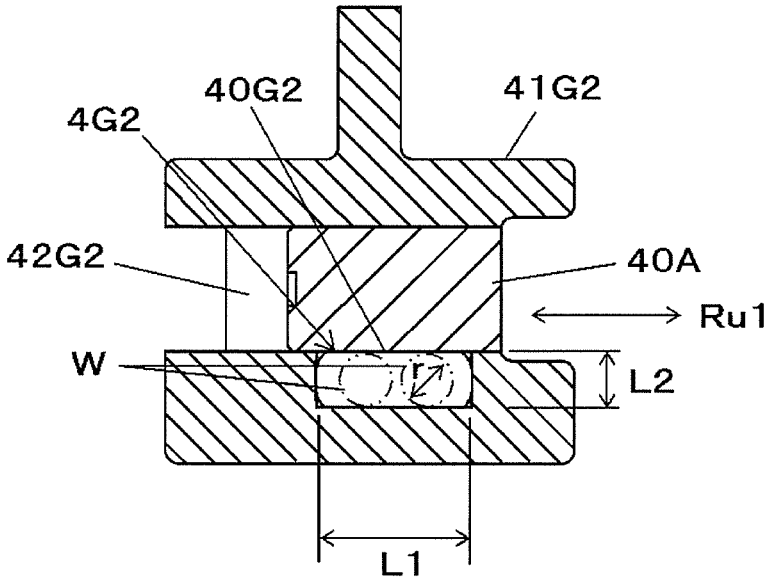
FIG. 34B is a view illustrating an example of a parallel guide according to another embodiment.
Figure 35:
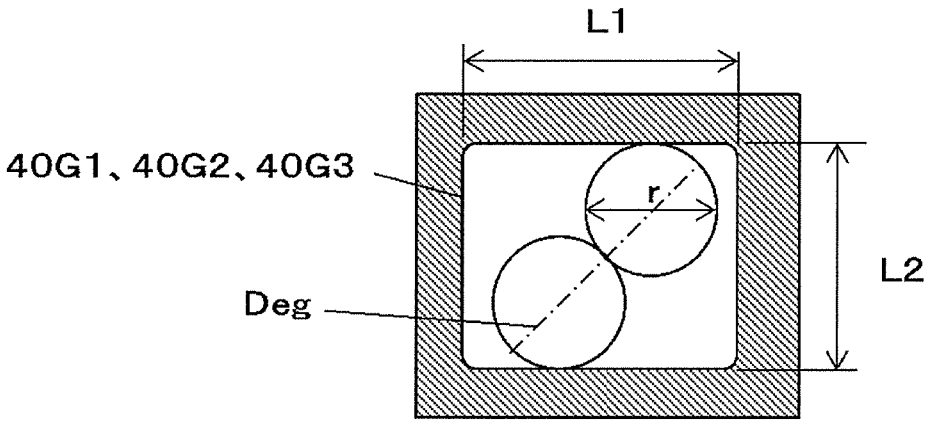
FIG. 35 is a view illustrating an example of a parallel guide according to another embodiment.
Figure 36:
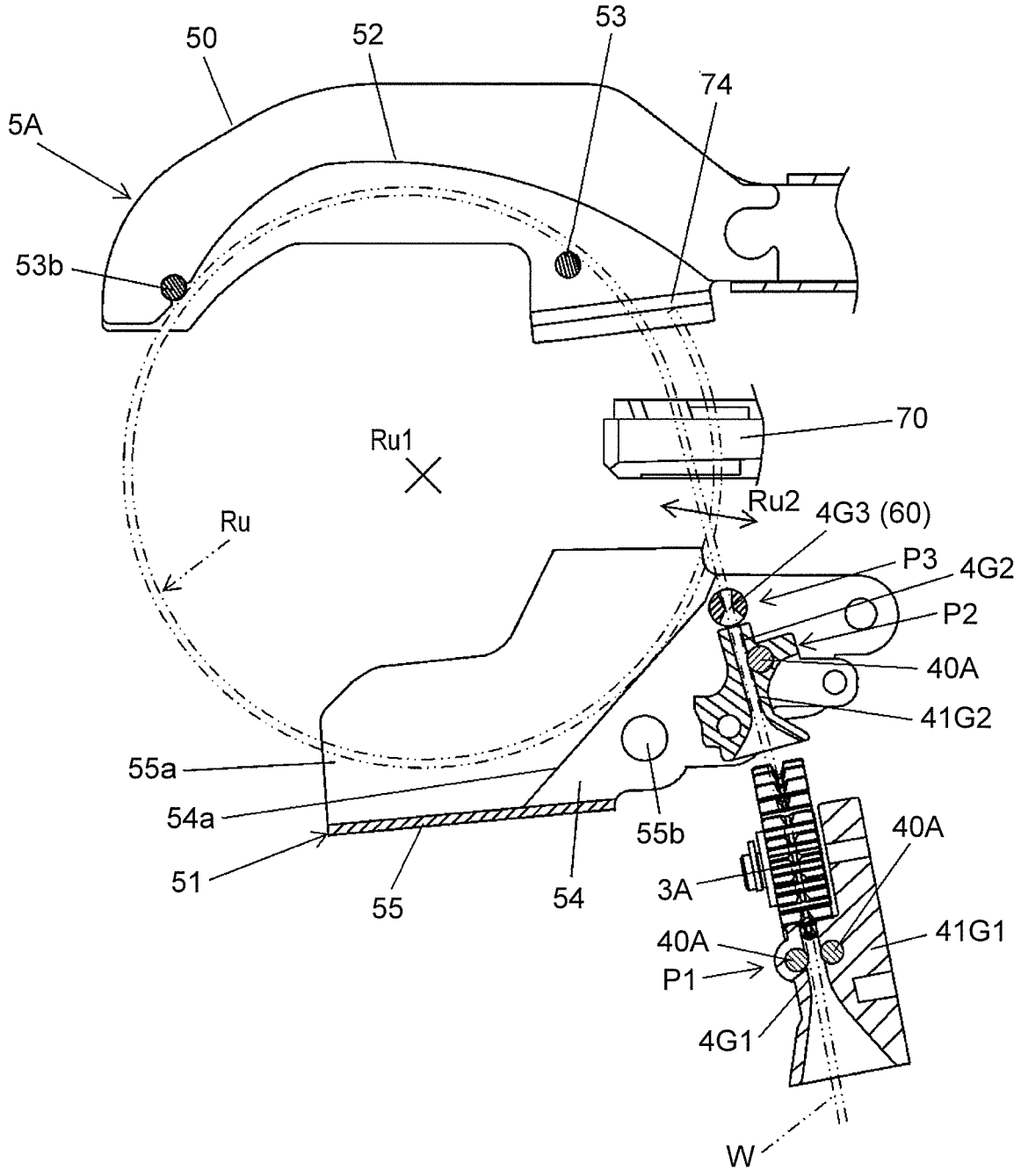
FIG. 36 is an explanatory view illustrating an example of an operation of a parallel guide according to another embodiment.

FIGS. 33, 34A, 34B, and 35 are diagrams illustrating an example of a parallel guide according to another embodiment, FIG. 34A is a cross sectional view taken along the line A-A in FIG. 33, FIG. 34B is a cross sectional view taken along line B-B in FIG. 33, and FIG. 35 is a modified example of the parallel guide of another embodiment. Further, FIG. 36 is an explanatory view illustrating an example of the operation of the parallel guide of another embodiment.

The parallel guide 4G1 provided at the introduction position P1 and the parallel guide 4G2 provided at the intermediate position P2 are provided with a sliding member 40A that suppresses wear due to sliding of the wire W when the wire W passes through the guide. The parallel guide 4G3 provided at the cutting discharge position P3 has no sliding member 40A.

The parallel guide 4G1 is an example of a restricting unit constituting the feeding unit and is constituted by an opening (wire restricting unit) 40G1 penetrating along the feeding direction of the wire W. In order to restrict the radial direction orthogonal to the feeding direction of the wire W, as illustrated in FIGS. 34A, 34B, and 35, the parallel guide 4G1 has the opening 40G1 having a shape in which a length L1 in one direction orthogonal to the feeding direction of the wire W is longer than a length L2 in the other direction orthogonal to the feeding direction of the wire W and the one direction.

In order to set the two wires W in a form of being arranged along the radial direction and restrict the direction in which the two wires W are arranged, the parallel guide 4G1 is configured such that the length L1 in the longitudinal direction of the opening 40G1 orthogonal to the feeding direction of the wire W is twice longer than the diameter r of the wire W and the length L2 in the lateral direction has a length slightly longer than the diameter r of one wire W. The parallel guide 4G1 is configured such that the longitudinal direction of the opening 40G1 is straight and the lateral direction is arcuate or straight.

The wire W shaped in a circular arc shape by the first guide unit 50 of the curl guide unit 5A is curled such that positions of two outside points and one inside point of the circular arc are restricted at three points of the parallel guide 4G2 provided at the intermediate position P2 and the guide pins 53 and 53*b* of the first guide unit 50, thereby forming a substantially circular loop Ru.

When the axial direction Ru1 of the loop Ru illustrated in FIG. 36, which is formed by the wire W, is taken as a reference (in the direction of L1 in FIG. 35), as indicated by a one-dot chain line Deg (extending through the axes of the wires) in FIG. 35, two wires W are fed when the inclination in the direction in which two wires W passing through the opening 40G1 of the parallel guide 4G1 are arranged (the inclination of the direction in which two wires W are arranged with respect to the longitudinal direction L1) extending in the axial direction Ru1 of the loop Ru of the opening 40G1) exceeds 45 degrees, and thus there is a possibility that the wires W are twisted and intersect each other during feeding of the two wires.

Therefore, in parallel guide 4G1, in order to make the inclination of the direction in which the two wires W passing through the opening 40G1 of the parallel guide 4G1 are arranged be 45 degrees or less with respect to the axial direction Ru1 of the loop Ru formed by the wire W, the ratio of the length L2 in the lateral direction and the length L1 in the longitudinal direction of the opening 40G1 is determined. In this example, the ratio of the length L2 in the lateral direction and the length L1 in the longitudinal direction of the opening 40G1 is configured to be 1:1.2 or more. Considering the diameter r of the wire W, the length L2 in the lateral direction of the opening 40G1 of the parallel guide 4G1 exceeds 1 time the diameter r of the wire W and is configured with a length of 1.5 times or less. Note that the inclination of the direction in which the two wires W are arranged is more preferably 15 degrees or less.

Figure 37:
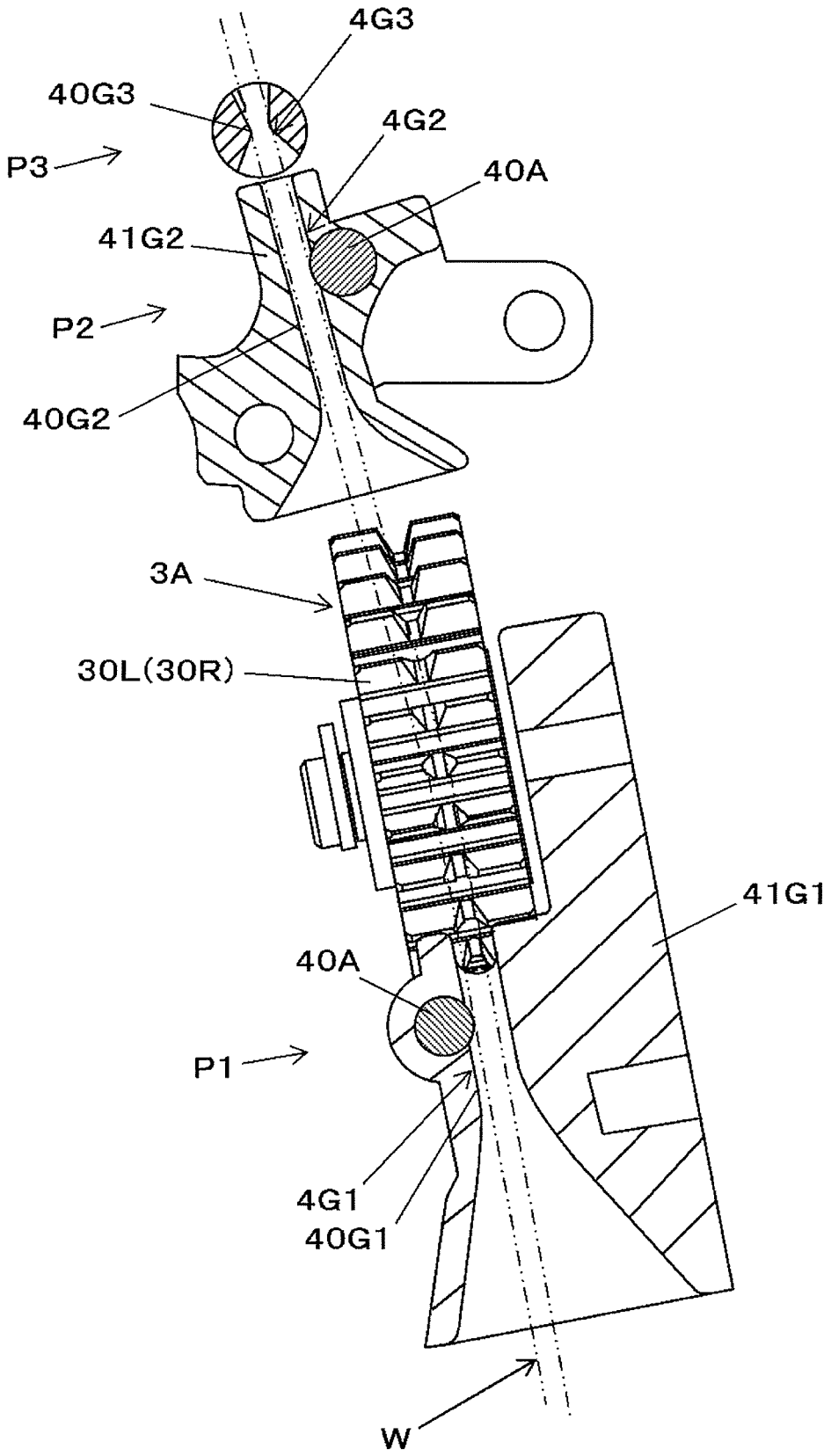
FIG. 37 is a view illustrating a modified example of a parallel guide according to another embodiment.

The parallel guide 4G2 is an example of a restricting unit constituting the feeding unit and is constituted by an opening (wire restricting unit) 40G2 penetrating along the feeding direction of the wire W. As illustrated in FIG. 37, the parallel guide 4G2, in order to restrict the direction of the wire W in the radial direction orthogonal to the feeding direction, is the opening 40G2 having a shape in which the length L1 in one direction orthogonal to the feeding direction of the wire W is longer than the length L2 in the other direction orthogonal to the feeding direction of the wire W and the one direction.

In order to set the two wires W in the form of being arranged along the radial direction and restrict the direction in which the two wires W are arranged, the parallel guide 4G2 is configured such that the length L1 in the longitudinal direction of the opening 40G2 orthogonal to the feeding direction of the wire W is twice longer than the diameter r of the wire W and the length L2 in the lateral direction has a length slightly longer than the diameter r of one wire W. In addition, the parallel guide 4G2 is configured such that the longitudinal direction of the opening 40G2 is straight, the lateral direction is arcuate or straight.

Even in the parallel guide 4G2, the ratio of the length L2 in the lateral direction and the length L1 in the longitudinal direction of the opening 40G2 is configured to 1:1.2 or more so that the inclination of the direction in which the two wires W are arranged is 45 degrees or less, preferably 15 degrees or less. Considering the diameter r of the wire W, the length L2 in the lateral direction of the opening 40G2 of the parallel guide 4G2 is configured to be greater than 1 time the diameter r of the wire W and 1.5 times or less.

The parallel guide 4G3 is an example of a restricting unit constituting the feeding unit and constitutes the fixed blade portion 60. Similarly to the parallel guide 4G1 and the parallel guide 4G2, the parallel guide 4G3 is an opening (wire restricting unit) 40G3 having a shape in which a length in the longitudinal direction orthogonal to the feeding direction of the wire W is twice longer than the diameter r of the wire W, and a length in the lateral direction is slightly longer than the diameter r of one wire W.

The parallel guide 4G3 has a ratio of 1:1.2 or more (one length is at least 1.2 times that of the other length) between a length of at least one part in the lateral direction of the opening 40G3 and a length of at least one part in the longitudinal direction of the opening 40G3 so that the inclination of the direction in which the two wires W are arranged is 45 degrees or less, preferably 15 degrees or less. Considering the diameter r of the wire W, the length in the lateral direction of the opening 40G3 of the parallel guide 4G3 is configured to be greater than 1 time of the diameter r of the wire W and 1.5 times or less, and the parallel guide 4G3 restricts the direction in which the two wires W are arranged.

The sliding member 40A is an example of a sliding unit. The sliding member 40A is made of a material called cemented carbide. The cemented carbide has higher hardness than the material constituting the guide main body 41G1 provided with the parallel guide 4G1 and the material constituting the guide main body 41G2 provided with the parallel guide 4G2. As a result, the sliding member 40A has higher hardness than the guide main body 41G1 and the guide main body 41G2. The sliding member 40A is constituted by a member called a cylindrical pin in this example.

The guide main body 41G1 and the guide main body 41G2 are made of iron. The hardness of the guide main body 41G1 and the guide main body 41G2 subjected to general heat treatment is about 500 to 800 in Vickers hardness. On the other hand, the hardness of the sliding member 40A made of cemented carbide is about 1500 to 2000 in terms of Vickers hardness.

In the sliding member 40A, a part of the circumferential surface is perpendicular to the feeding direction of the wire W at the opening 40G1 of the parallel guide 4G1 and is exposed from the inner surface in the longitudinal direction along the direction in which the two wires W are arranged. In the sliding member 40A, a part of the circumferential surface is perpendicular to the feeding direction of the wire W at the opening 40G2 of the parallel guide 4G2 and is exposed from the inner surface in the longitudinal direction along the direction in which the two wires W are arranged. The sliding member 40A is perpendicular to the feeding direction of the wire W and extends along the direction in which two wires W are arranged. It suffices for the sliding member 40A to have a part of the circumferential surface exposed on the same surface where there is no difference in level with the inner surface of the opening 40G1 of the parallel guide 4G1 in the longitudinal direction and the inner surface of the opening 40G2 of the parallel guide 4G2 in the longitudinal direction. Preferably, a part of the circumferential surface of the sliding member 40A protrudes from the inner surface in the longitudinal direction of the opening 40G1 of the parallel guide 4G1 and the inner surface in the longitudinal direction of the opening 40G2 of the parallel guide 4G2 and is exposed.

The guide main body 41G1 is provided with a hole portion 42G1 having a diameter to which the sliding member 40A is fixed by press fitting. The hole portion 42G1 is provided at a predetermined position where a part of the circumferential surface of the sliding member 40A press-fitted into the hole portion 42G1 is exposed on the longitudinal inner surface of the opening 40G1 of the parallel guide 4G1. The hole portion 42G1 extends orthogonally to the feeding direction of the wire W and along the direction in which the two wires W are arranged.

The guide main body 41G is provided with a hole portion 42G2 having a diameter to which the sliding member 40A is fixed by press fitting. The hole portion 42G2 is provided at a predetermined position where a part of the circumferential surface of the sliding member 40A press-fitted into the hole portion 42G2 is exposed on the inner surface of the opening 40G2 of the parallel guide 4G2 in the longitudinal direction. The hole portion 42G2 extends orthogonally to the feeding direction of the wire W and along the direction in which the two wires W are arranged.

The wire W, in which the loop Ru illustrated in FIG. 36 is formed by the curl guide unit 5A, can be moved in the radial direction Ru2 of the loop Ru by the operation fed by the wire feeding unit 3A. In the reinforcing bar binding machine 1A, the direction in which the wire W formed in the loop shape by the curl guide unit 5A is fed (the winding direction of the wire W wound around the reinforcing bar S in the curl guide unit 5A) and the direction in which the wire W is wound around the reel 20 are oriented to opposite. Therefore, the wire W can move in the radial direction Ru2 of the loop Ru by the operation fed by the wire feeding unit 3A. The radial direction Ru2 of the loop Ru is one direction orthogonal to the feeding direction of the wire W and orthogonal to the direction in which the two wires W are arranged. When the diameter of the loop Ru increases, the wire W moves outward with respect to the radial direction Ru2 of the loop Ru. When the diameter of the loop Ru becomes small, the wire W moves inward with respect to the radial direction Ru2 of the loop Ru.

The parallel guide 4G1 is configured such that the wire W drawn out of the reel 20 illustrated in FIG. 1 or the like passes through the opening 40G1. For this reason, the wire W passing through the parallel guide 4G1 slides on the inner surface of the opening 40G1 corresponding at the outer and inner positions with respect to the radial direction Ru2 of the loop Ru of the wire W illustrated in FIG. 36. When the outer surface and the inner surface of the inner surface of the opening 40G1 of the parallel guide 4G1 wear due to the sliding of the wire W, the wire W passing through the parallel guide 4G1 moves in the radial direction Ru2 of the loop Ru.

As a result, the wire W guided to the wire feeding unit 3A is moved away from between the first feed groove 32L of the first feed gear 30L and the second feed groove 32R of the second feed gear 30R, and it is difficult to guide the wire to the wire feeding unit 3A as illustrated in FIG. 4.

Therefore, in the parallel guide 4G1, a sliding member 40A is provided at a predetermined position on the outer surface and the inner surface of the inner surface of the opening 40G1 with respect to the radial direction Ru2 of the loop Ru by the wire W formed by the curl guide unit 5A. As a result, wear in the opening 40G1 is suppressed, and the wire W passing through the parallel guide 4G1 can be reliably guided to the wire feeding unit 3A.

Further, since the wire W, which is fed out from the wire feeding unit 3A and to which the loop Ru is formed by the curl guide unit 5A, passes through the parallel guide 4G2, the wire W slides mainly on the outer surface of the inner surface of the opening 40G2 with respect to the radial direction Ru2 of the loop Ru by the wire W formed by the curl guide unit 5A. When the outer surface of the inner surface of the opening 40G1 of the parallel guide 4G2 wears due to the sliding of the wire W, the wire W passing through the parallel guide 4G2 moves toward the outside of the radial direction Ru2 of the loop Ru. With this, it is difficult to guide the wire W to the parallel guide 4G3.

Therefore, the parallel guide 4G2 is provided with a sliding member 40A at a predetermined position on the outer surface with respect to the radial direction Ru2 of the loop Ru by the wire W formed by the curl guide unit 5A on the inner surface of the opening 40G2. As a result, wear at the predetermined position affecting the guidance of the wire W to the parallel guide 4G3 is suppressed, and the wire W passing through the parallel guide 4G2 can be reliably guided to the parallel guide 4G3.

When the sliding member 40A has the same surface shape with no difference in level as the inner surface of the opening 40G1 of the parallel guide 4G1 and the inner surface of the opening 40G2 of the parallel guide 4G2, it is considered that the inner surface of the opening 40G1 of the parallel guide 4G1 and the inner surface of the opening 40G2 of the parallel guide 4G2 may be slightly worn out. However, the sliding member 40A does not wear and remains as it is, and protrudes from the inner surface of the opening 40G1 and the inner surface of the opening 40G2 and is exposed. As a result, further wear of the inner surface of the opening 40G1 of the parallel guide 4G1 and the inner surface of the opening 40G2 of the parallel guide 4G2 is suppressed.

FIG. 37 is a diagram illustrating a modified example of the parallel guide of another embodiment. As illustrated in FIG. 1, the winding direction of the wire W on the reel 20 is different from the winding direction of the loop Ru by the wire W formed by the curl guide unit 5A. Therefore, in the parallel guide 4G1, the sliding member 40A may be provided only at a predetermined position on the inner surface of the inner surface of the opening 40G1 with respect to the radial direction Ru2 of the loop Ru by the wire W formed by the curl guide unit 5A.

Figure 38:
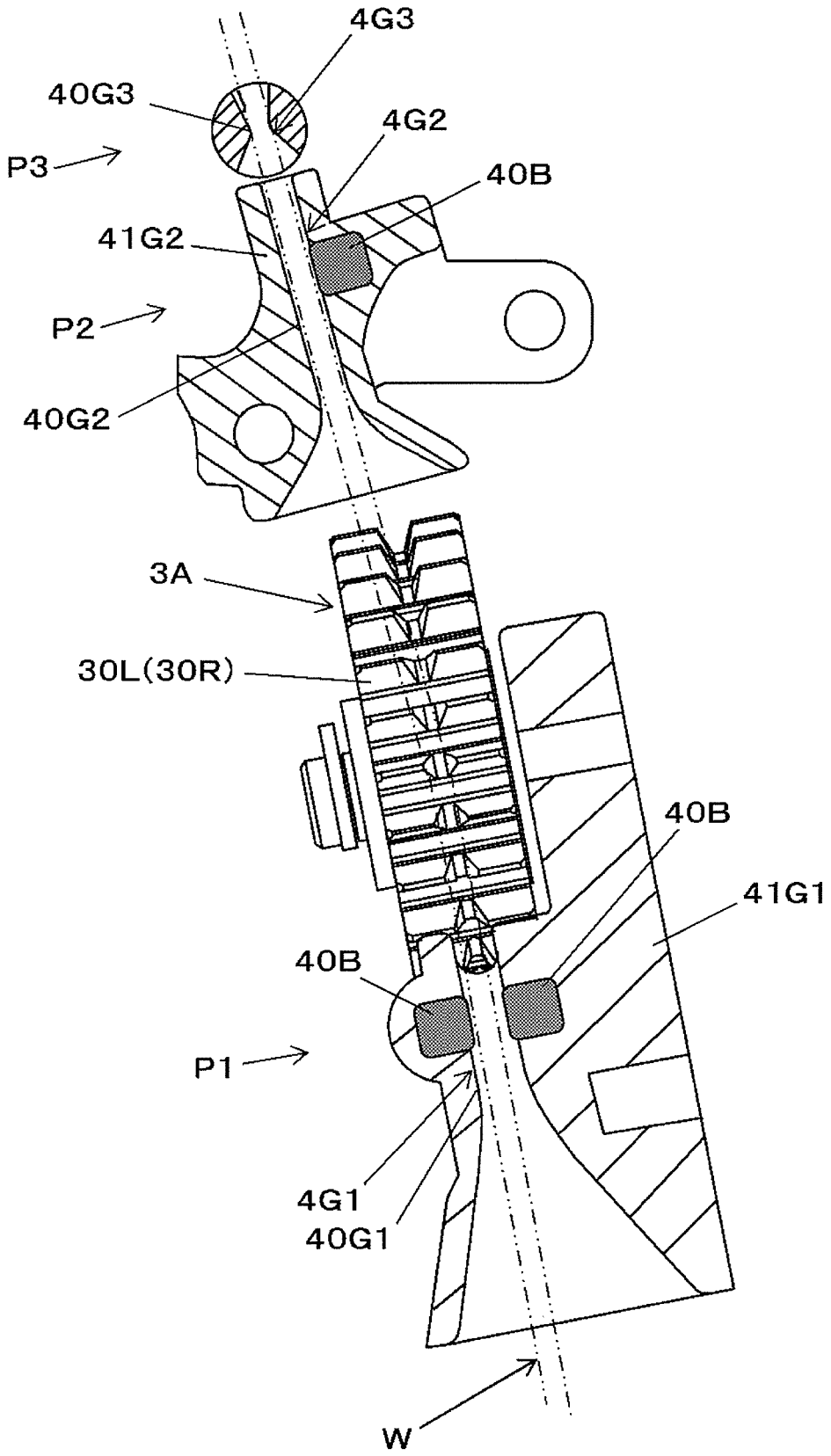
FIG. 38 is a view illustrating a modified example of a parallel guide according to another embodiment.

FIGS. 38 to 43 are diagrams illustrating modified examples of the parallel guide according to another embodiment. As illustrated in FIG. 38, the sliding unit is not limited to the above-described pin-shaped sliding member 40A having a circular cross section, but may be a sliding member 40B including a member having a polygonal cross section such as a rectangular parallelepiped shape, a cubic shape, or the like.

Figure 39:
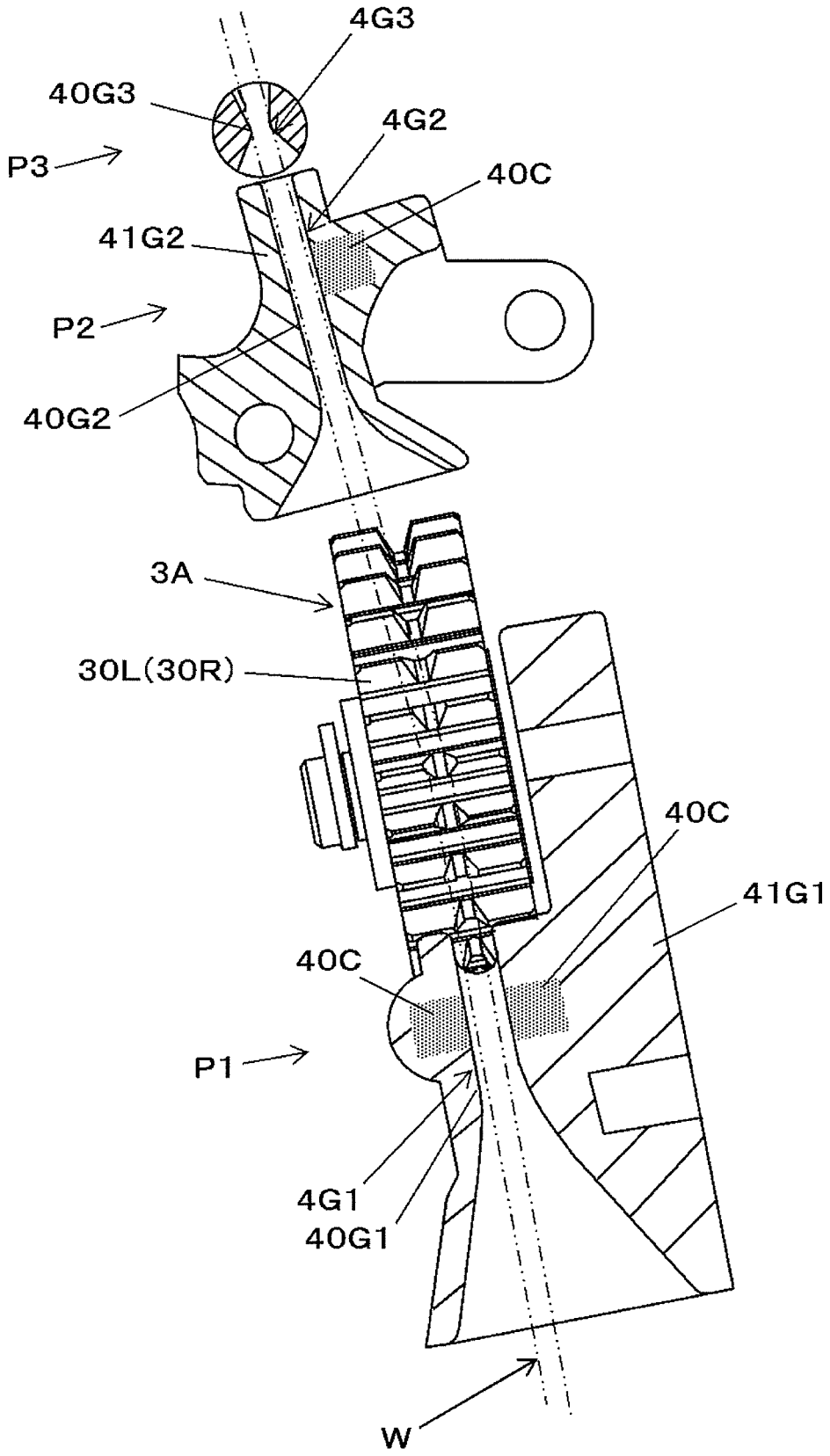
FIG. 39 is a view illustrating a modified example of a parallel guide according to another embodiment.
Figure 40:
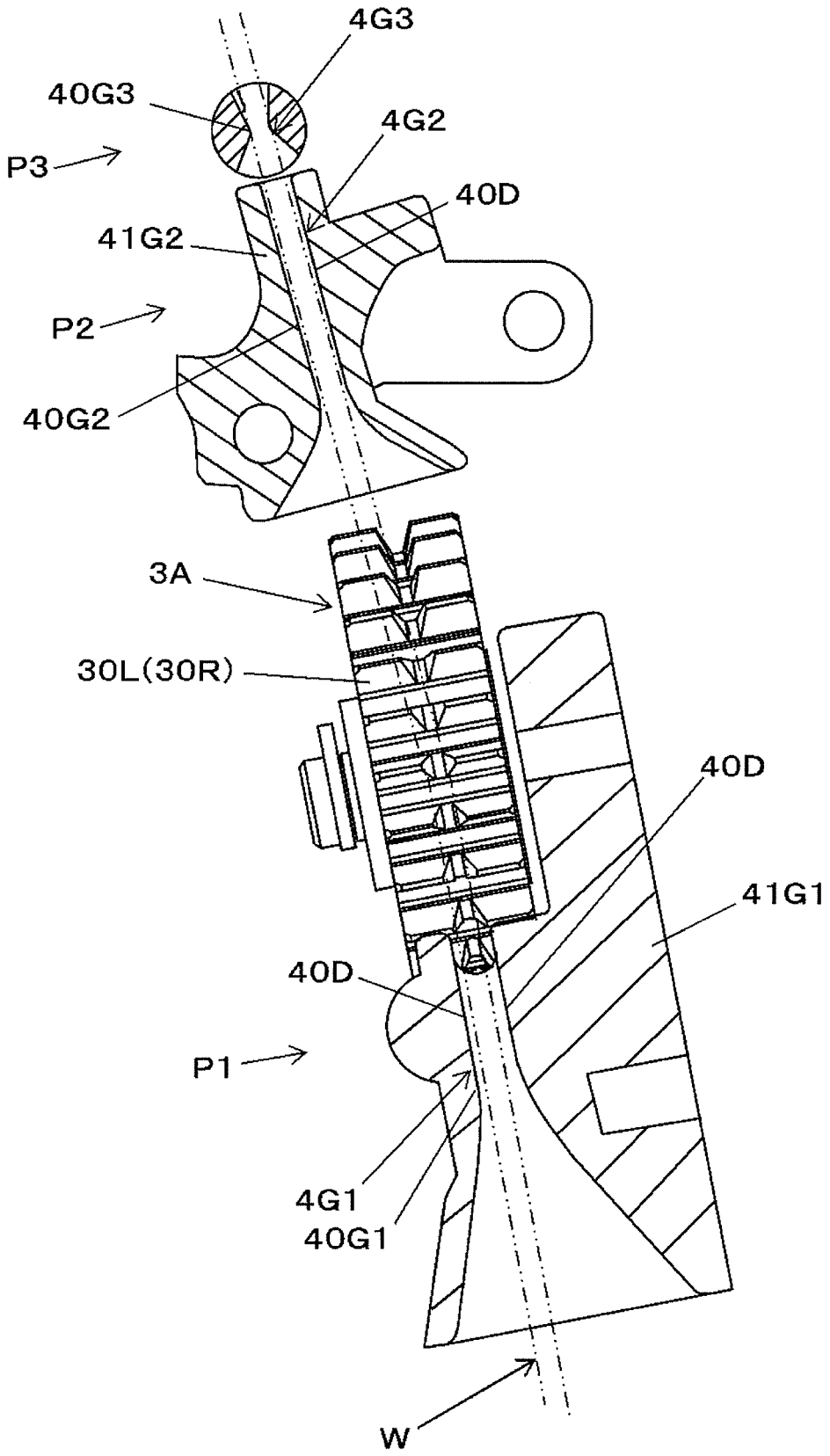
FIG. 40 is a view illustrating a modified example of a parallel guide according to another embodiment.

Further, as illustrated in FIG. 39, predetermined positions of the inner surface of the opening 40G1 of the parallel guide 4G1 and the inner surface of the opening 40G2 of the parallel guide 4G2 may be further hardened by quenching or the like than other positions so that the sliding unit 40C is configured. Further, the guide main body 41G1 constituting the parallel guide 4G1 and the guide main body 41G2 constituting the parallel guide 4G2 are made of a material having higher hardness than the parallel guide 4G3, or the like, and as illustrated in FIG. 40, the parallel guide 4G1 and the parallel guide 4G2 may be the sliding unit 40D as a whole.

Figure 41:
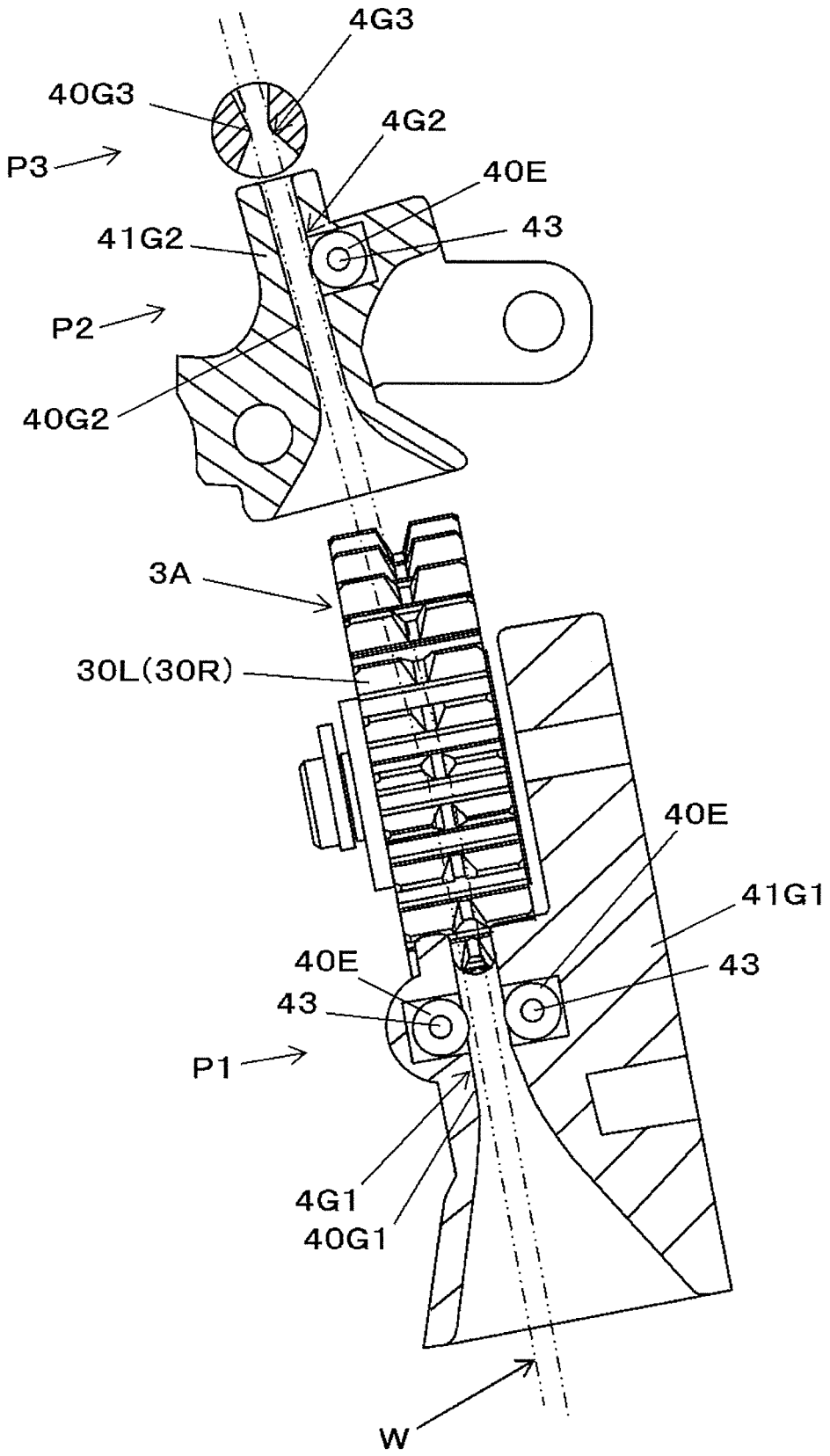
FIG. 41 is a view illustrating a modified example of a parallel guide according to another embodiment.

Further, as illustrated in FIG. 41, a roller 40E having a shaft 43 orthogonal to the feeding direction of the wire W and rotatable following the feeding of the wire W may be provided instead of the sliding unit. The roller 40E is rotated along with the feeding of the wire W, and the contact point with the wire W is changed, so that wear is suppressed.

Figure 42:
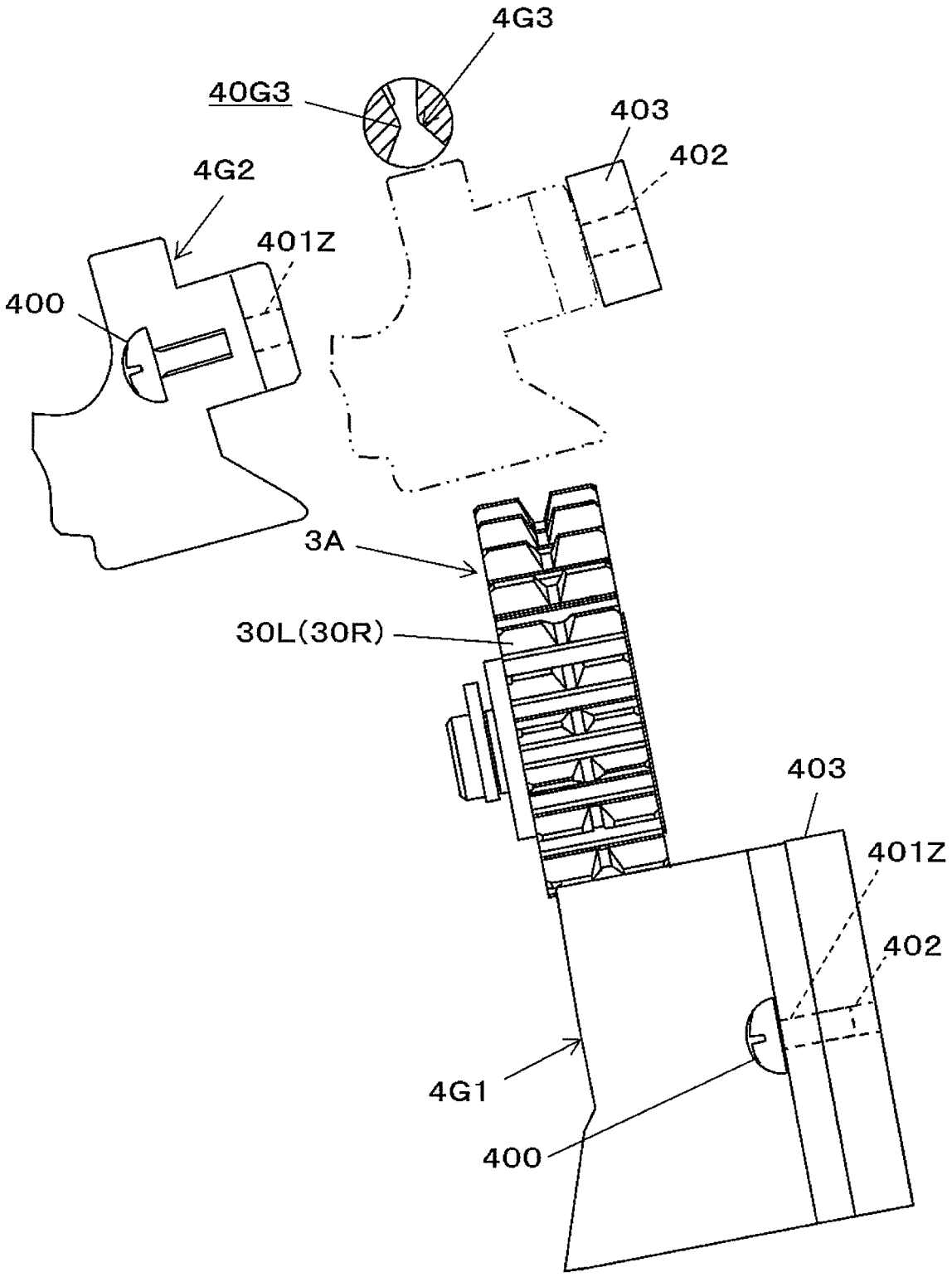
FIG. 42 is a view illustrating a modified example of a parallel guide according to another embodiment.

Further, as illustrated in FIG. 42, the parallel guide 4G1 and the parallel guide 4G2 are provided with hole portions 401Z into which the screws 400 as an example of detachable members are inserted. Further, the reinforcing bar binding machine 1A illustrated in FIG. 1 or the like includes a mounting base 403 having a screw hole 402 to which the screw 400 is fastened. The parallel guide 4G1 and the parallel guide 4G2 may be detachable by fixing and fixing releasing by fastening and removing the screw 400. Thus, even when the parallel guide 4G1 and the parallel guide 4G2 are worn out, replacement is possible.

Figure 43:
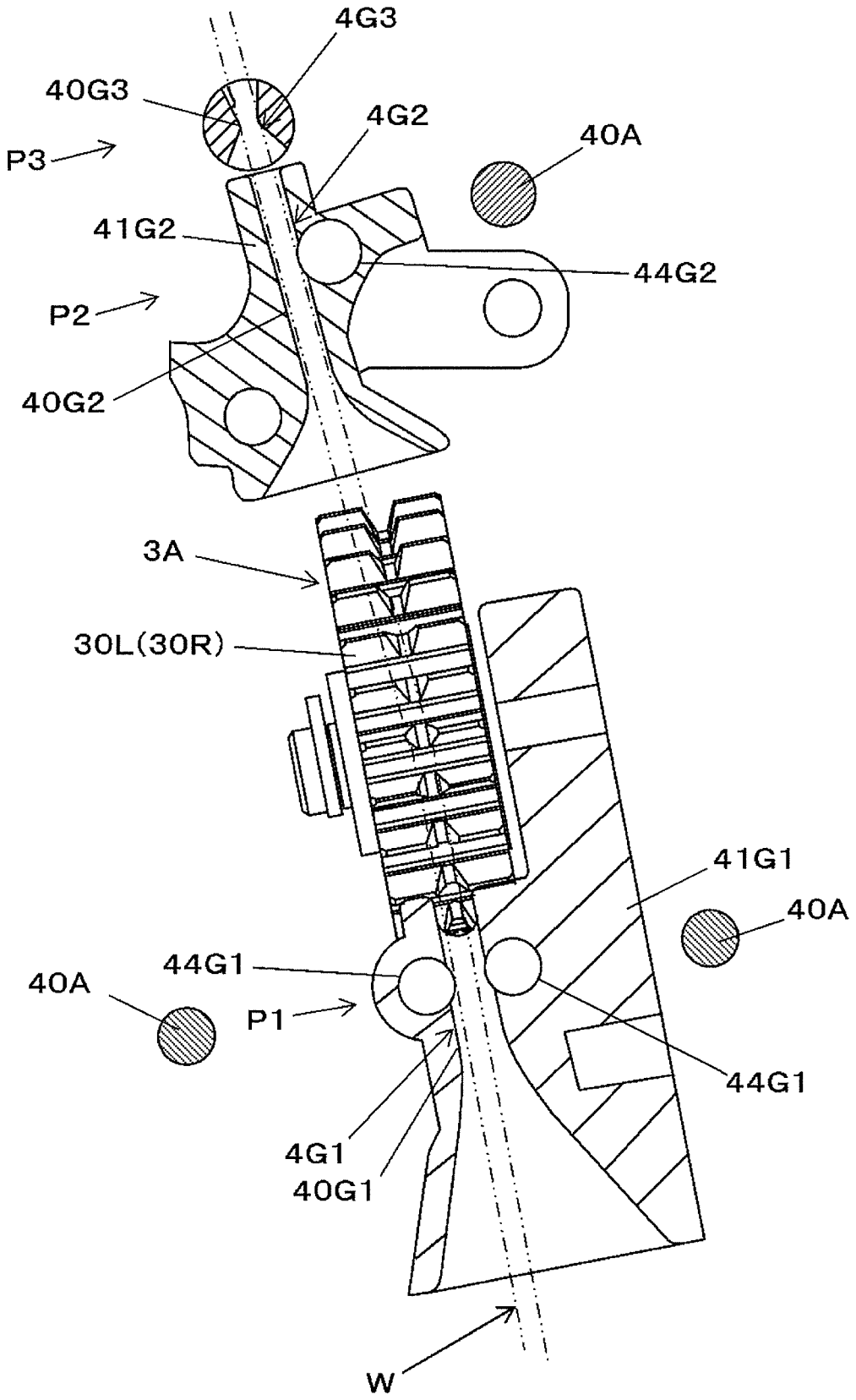
FIG. 43 is a view illustrating a modified example of a parallel guide according to another embodiment.

As illustrated in FIG. 43, in the guide main body 41G1, a mounting hole 44G1 to which the sliding member 40A is detachably fixed is provided at a predetermined position where a part of the circumferential surface of the sliding member 40A is exposed on the inner surface in the longitudinal direction of the opening 40G1 of the parallel guide 4G1. In the guide main body 41G2, a mounting hole 44G2 to which the sliding member 40A is detachably fixed is provided at a predetermined position where a part of the circumferential surface of the sliding member 40A is exposed on the inner surface in the longitudinal direction of the opening 40G2 of the parallel guide 4G2. As a result, even when the sliding member 40A is worn out, replacement is possible.

Figure 44:
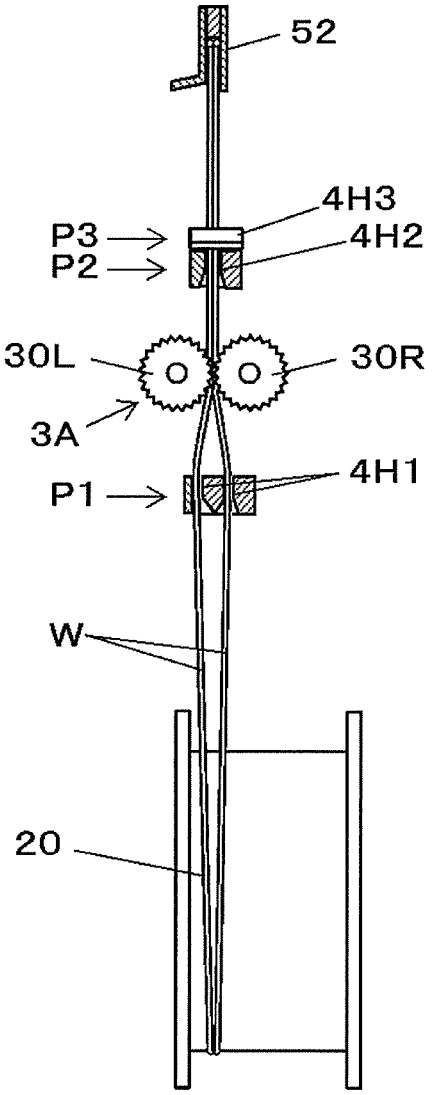
FIG. 44 is a view illustrating a modified example of a parallel guide according to another embodiment.

FIG. 44 is a diagram illustrating a modified example of the parallel guide of another embodiment. The parallel guide 4H1 provided at the introduction position P1 is provided with two hole portions (openings) matching the number of the wires W, and restricts the direction in which the wires W are arranged in parallel with each other in the arrangement direction of the hole portions. The parallel guide 4H1 may include any one of a sliding member 40A illustrated in FIGS. 33, 34A, 34B, and 37, a sliding member 40B illustrated in FIG. 38, a sliding unit 40C illustrated in FIG. 39, a sliding unit 40D illustrated in FIG. 40, or the roller 40E illustrated in FIG. 41.

The parallel guide 4H2 provided at the intermediate position P2 corresponds to any one of the parallel guide 4A illustrated in FIG. 6A and the like, the parallel guide 4B illustrated in FIG. 30A, the parallel guide 4C illustrated in FIG. 30B, the parallel guide 4D illustrated in FIG. 30C, or the parallel guide 4E illustrated in FIG. 30D.

Further, the parallel guide 4H2 may be a parallel guide 4G2 having the sliding member 40A illustrated in FIGS. 33, 34A, 34B, and 37 as an example of the sliding unit. Further, the parallel guide 4H2 may be any one of a parallel guide 4G2 having the sliding member 40B illustrated in FIG. 38 as a modified example of the sliding unit, a parallel guide 4G2 having the sliding unit 40C illustrated in FIG. 39, a parallel guide 4G2 having the sliding unit 40D illustrated in FIG. 40, or a parallel guide 4G2 having the roller 40E illustrated in FIG. 41.

The parallel guide 4H3 provided at the cutting discharge position P3 is any one of the parallel guide 4A illustrated in FIG. 6A and the like, the parallel guide 4B illustrated in FIG. 30A, the parallel guide 4C illustrated in FIG. 30B, the parallel guide 4D illustrated in FIG. 30C, or the parallel guide 4E illustrated in FIG. 30D.

Figure 45:
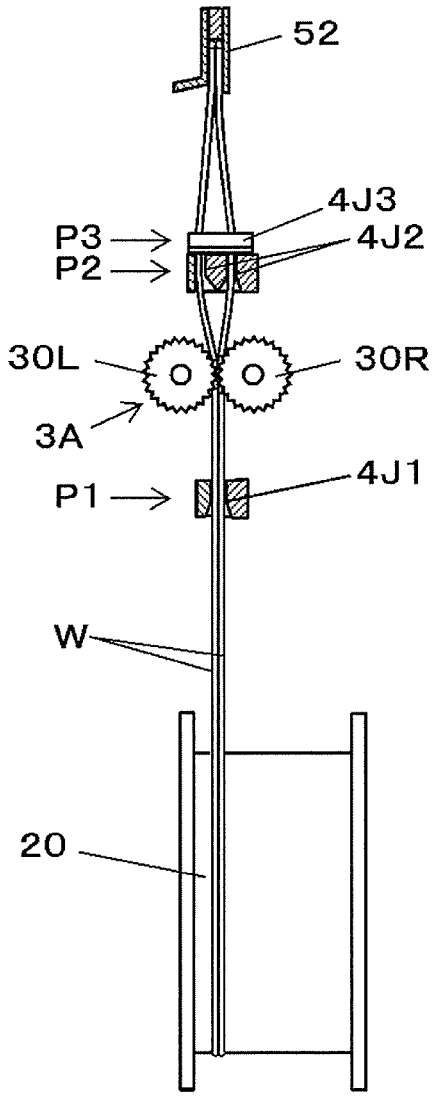
FIG. 45 is a view illustrating a modified example of a parallel guide according to another embodiment.

FIG. 45 is a diagram illustrating a modified example of the parallel guide of another embodiment. A parallel guide 4J1 provided at the introduction position P1 is any one of the parallel guide 4A illustrated in FIG. 6A and the like, the parallel guide 4B illustrated in FIG. 30A, the parallel guide 4C illustrated in FIG. 30B, the parallel guide 4D illustrated in FIG. 30C, or the parallel guide 4E illustrated in FIG. 30D.

Further, the parallel guide 4J1 may be a parallel guide 4G2 having the sliding member 40A illustrated in FIGS. 33, 34A, 34B, and 37 as an example of a sliding unit. Further, the parallel guide 4J1 may be any one of a parallel guide 4G2 having the sliding member 40B illustrated in FIG. 38 as a modified example of the sliding unit, a parallel guide 4G2 having the sliding unit 40C illustrated in FIG. 39, a parallel guide 4G2 having the sliding unit 40D illustrated in FIG. 40, or a parallel guide 4G2 having the roller 40E illustrated in FIG. 41.

A parallel guide 4J2 provided at the intermediate position P2 is configured by two hole portions matching the number of the wires W, and restricts the direction in which the wires W are arranged in parallel with each other in the arrangement direction of the parallel guide 4J2. The parallel guide 4J2 may include any one of the sliding member 40A illustrated in FIGS. 33, 34A, 34B, and 37, the sliding member 40B illustrated in FIG. 38, the sliding unit 40C illustrated in FIG. 39, the sliding unit 40D illustrated in FIG. 40, or the roller 40E illustrated in FIG. 41.

A parallel guide 4J3 provided at the cutting discharge position P3 is any one of the parallel guide 4A illustrated in FIG. 6A and the like, the parallel guide 4B illustrated in FIG. 30A, the parallel guide 4C illustrated in FIG. 30B, the parallel guide 4D illustrated in FIG. 30C, or the parallel guide 4E illustrated in FIG. 30D.

Figure 46A:
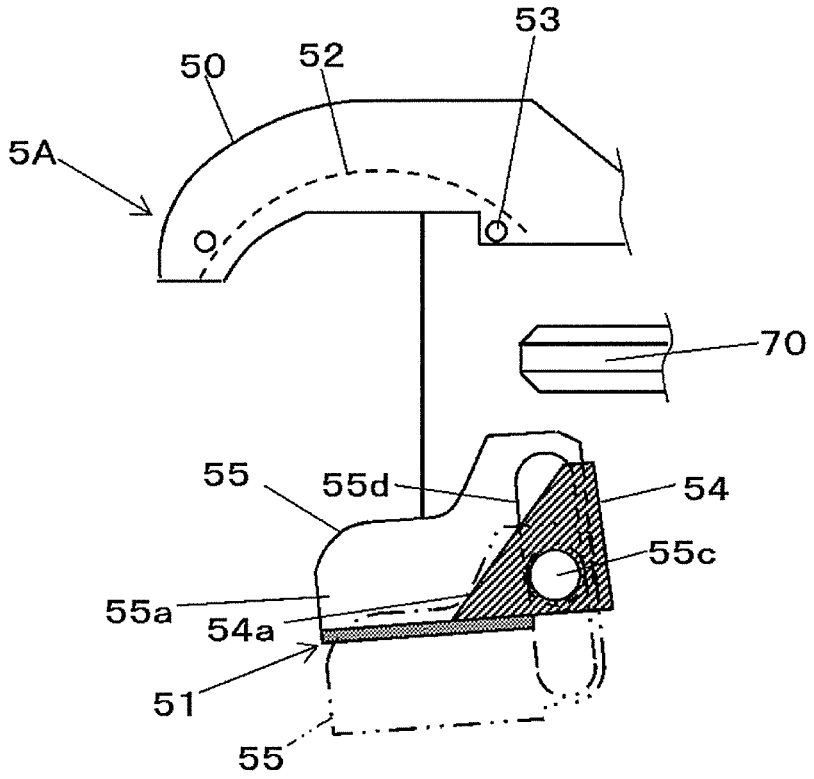
FIG. 46A is a view illustrating a modified example of the second guide unit of the present embodiment.
Figure 46B:
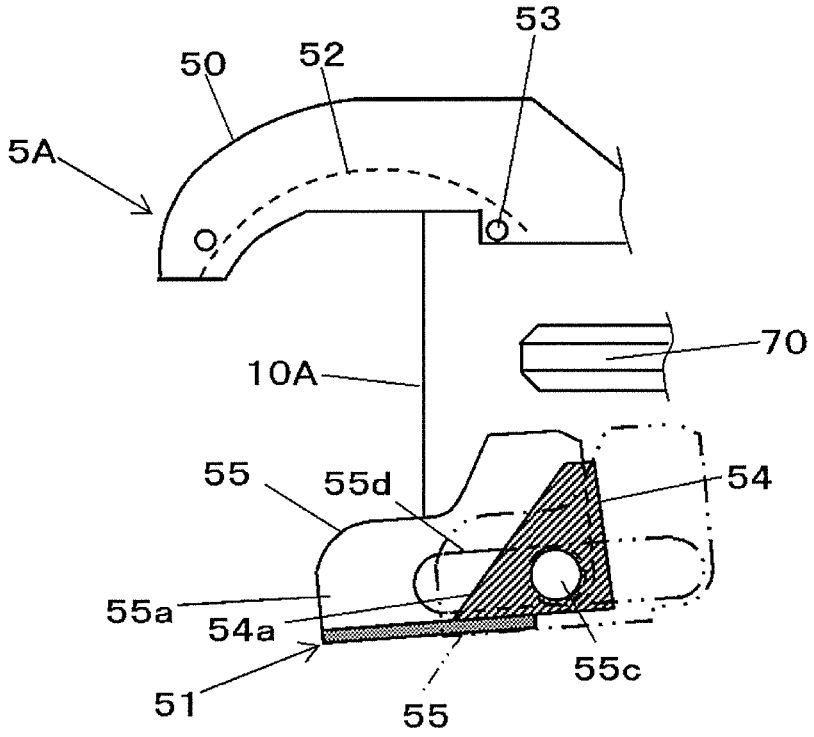
FIG. 46B is a view illustrating a modified example of the second guide unit of the present embodiment.

FIGS. 46A and 46B are diagrams illustrating modified examples of the second guide unit of the present embodiment. The displacement direction of the movable guide unit 55 of the second guide unit 51 is restricted by the guide shaft 55*c* and the guide groove 55*d* along the displacement direction of the movable guide unit 55. For example, as illustrated in FIG. 46A, the movable guide unit 55 includes the guide groove 55*d* extending along the direction in which the movable guide unit 55 moves with respect to the first guide unit 50, that is, the direction in which the movable guide unit 55 moves closer to and away from the first guide unit 50. The fixed guide unit 54 includes the guide shaft 55*c* which is inserted into the guide groove 55*d* and is movable in the guide groove 55*d*. Consequently, the movable guide unit 55 is displaced from the guide position to the retreated position by the parallel movement in the direction in which the movable guide unit 55 comes into contact with and separates from the first guide unit 50 (up and down direction in FIG. 46A).

Further, as illustrated in FIG. 46B, a guide groove 55*d* extending in the forward and backward direction may be provided in the movable guide unit 55. As a result, the movable guide unit 55 is displaced from the guide position to the retreated position by movement in the forward and backward direction in which protruding from the front end, which is one end of the main body 10A, and retreating to the inside of the main body 10A are performed. The guide position in this case is a position where the movable guide unit 55 protrudes from the front end of the main body 10A so that the wall surface 55*a* of the movable guide unit 55 exists at a position where the wire W forming the loop Ru passes. The retreated position is a state in which all or a part of the movable guide unit 55 has entered the inside of the main body 10A. Further, a configuration may be adopted in which the movable guide unit 55 is provided with a guide groove 55*d* extending in an oblique direction along the direction of contacting and separating from the first guide unit 50 and in the forward and backward direction. The guide groove 55*d* may be formed in a straight line shape or a curved line shape such as a circular arc.

In the present embodiment, the configuration using two wires W has been described as an example, but a configuration using two or more wires W may be used.

Further, a magazine for housing a short wire W may be provided, and a plurality of wires W may be supplied.

Further, the magazine may not be provided in the main body, but the wire may be supplied from a supply portion of an independent wire.

Further, in the reinforcing bar binding machine 1A of the present embodiment, the length restricting unit 74 is provided in the first guide unit 50 of the curl guide unit 5A, but may be provided in the first movable gripping member 70L or the like, or another location, as long as it is a component independent of the gripping unit 70, for example, a structure that supports the gripping unit 70.

Further, before the operation of bending the one end WS side and the other end WE side of the wire W toward the reinforcing bar S side by the bending portion 71 is completed, the rotation operation of the gripping unit 70 may be started, and thus the operation of twisting the wire W may be started. Further, after starting the operation of twisting the wire W by starting the rotation operation of the gripping unit 70, before the operation of twisting the wire W is completed, the operation of bending the one end WS side and the other end WE side toward the reinforcing bar S side by the bending portion 71 may be started and completed.

In addition, although the bending portion 71 is formed integrally with the movable member 83 as a bending unit, the gripping unit 70 and the bending portion 71 may be driven by an independent driving unit such as a motor. Further, instead of the bending portion 71, as a bending unit, a bending portion formed in a concave-convex shape, or the like may be provided in any of the fixed gripping member 70C, the first movable gripping member 70L, and the second movable gripping member 70R to apply a bending force by which the wire W is bent toward the reinforcing bar S in the operation of gripping the wire W.

It is noted that the present invention can also be applied to a binding machine that binds pipes or the like as a binding object with a wire.

<Modified Example of Reel and Wire of the Embodiment>

Figure 47A:
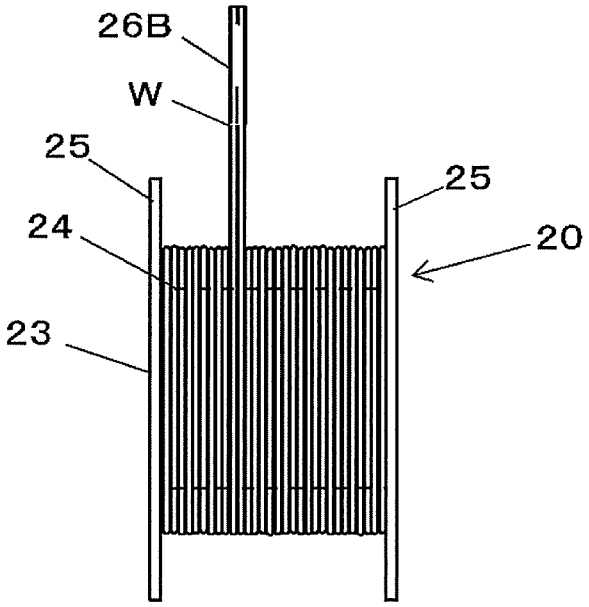
FIG. 47A is a view illustrating a modified example of the reel and the wire of the present embodiment.
Figure 47B:
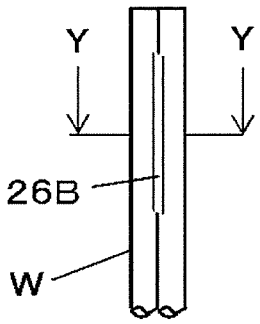
FIG. 47B is a plan view illustrating a modified example of the joint unit of the wire.
Figure 47C:
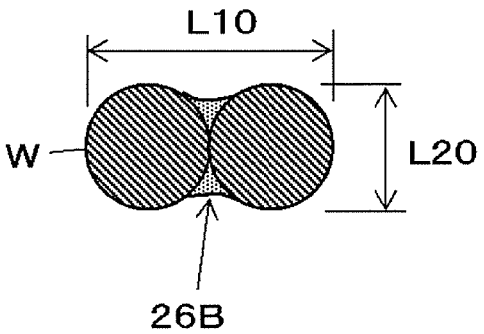
FIG. 47C is a cross-sectional view illustrating a modified example of the joint unit of the wire.

FIG. 47A is a diagram illustrating a modified example of the reel and the wire according to the present embodiment, FIG. 47B is a plan view illustrating a modified example of the joint unit of the wire, and FIG. 47C is a sectional view illustrating an example of the joint unit of the wire, and FIG. 47C is a sectional view taken along the line Y-Y in FIG. 47B. The wire W wound around the reel 20 is wound to be fed in a state that a plurality of wires W, in this example, two wires W are arranged in parallel in a direction along the axial direction of the core portion 24. The two wires W are provided with a joint part 26B in which a part of the tip on the side of being fed out from the reel 20 is joined.

The joint part 26B is formed by integrating two wires W by welding, soldering, adhesion with an adhesive, curable resin or the like, pressure welding, ultrasonic welding or the like. In this example, as illustrated in FIG. 47C, the joint part 26B has a length L10 in the longitudinal direction substantially equal to the diameter r of the two wires W in a configuration in which the two wires W are arranged along the cross-sectional direction and a length L20 in the lateral direction substantially equal to the diameter r of one wire W.

Some or all of the above embodiments can be described as follows.

(Additional Note 1)

A binding machine comprising:

a housing (magazine) that is capable of drawing out two or more wires, a wire feeding unit that is configured to feeds the two or more wires drawn out of the housing unit, a curl guide unit that curls the two or more wires fed out by the wire feeding unit and winds around a binding object, a binding unit that is configured to grips and twists the two or more wires wound around the binding object by the curl guide unit.

(Additional Note 2)

The binding machine according to (1), further comprising a parallel guide that is located between the housing and the curl guide unit and that arranges the two or more wires in parallel.

(Additional Note 3)

The binding machine according to (2), wherein the parallel guide arranges the two or more wires fed therein in parallel and feeds the two or more wires.

(Additional Note 4)

The binding machine according to (3), wherein the parallel guide includes a wire restricting unit restricts a directions of the two or more wires which fed therein so as to arranges the two or more wires in parallel.

(Additional Note 5)

The binding machine according to (4), wherein the wire restricting unit is an opening which arranges the two or more wires in parallel.

(Additional Note 6)

The binding machine according to (4), wherein the wire restricting unit is a guide groove which arranges the two or more wires in parallel.

(Additional Note 7)

The binding machine according to (5), wherein the parallel guide includes a guide main body, and the opening is formed so as to penetrate through the guide main body along a feeding direction of the wire drawn out of the housing and fed by the wire feeding unit, and to have a length in one direction orthogonal to the feeding direction longer than a length in the other direction which is orthogonal to the feeding direction and orthogonal to the one direction.

(Additional Note 8)

The binding machine according to (7), wherein the length of the opening in the one direction is n times longer than a length of the diameter of the wire passing through the opening when n wires are inserted the opening, and the length of the opening in the other direction is larger than the diameter of the wire and is smaller than twice the diameter of the wire.

(Additional Note 9)

The binding machine according to (8), wherein the length of the opening in the other direction is larger then the diameter of the wire and is smaller than 1.5 times the diameter of the wire.

(Additional Note 10)

The binding machine according to any one of (7) to (9), wherein the ratio of the length of the opening in the other direction and the length of the opening in the one direction is 1:1.2 or more.

(Additional Note 11)

The binding machine according to any one of (7) to (10), wherein the opening is formed such that, when a plurality of wires are inserted therein, an inclination of a direction in which the plurality of wires arranged in parallel with each other in the opening are arranged is 45 degrees or less with respect to a side extending in the one direction of the opening.

(Additional Note 12)

The binding machine according to (11), wherein the inclination is formed to be 15 degrees or less.

(Additional Note 13)

The binding machine according to any one of (2) to (12), wherein the parallel guide is located between the housing and the wire feeding unit.

(Additional Note 14)

The binding machine according to any one of (2) to (13), wherein the parallel guide is located between the wire feeding unit and the curl guide unit.

(Additional Note 15)

The binding machine according to (14), further comprising:

a cutting unit that is located between the wire feeding unit and the curl guide unit and configured to cut the wires wound around the binding object, wherein the parallel guide is located between the wire feeding unit and the cutting unit.

(Additional Note 16)

The binding machine according to (14) or (15), further comprising:

a cutting unit that is located between the wire feeding unit and the curl guide unit and configured to cut the wires wound around the binding object, wherein the parallel guide is located in or near the cutting unit.

(Additional Note 17)

The binding machine according to any one of (14) to (16), further comprising:

a cutting unit that is located between the wire feeding unit and the curl guide unit and configured to cut the wires wound around the binding object, wherein the parallel guide is located between the cutting unit and the curl guide unit.

(Additional Note 18)

A reel capable of being housed in the housing according to (1), wherein the reel is wound by two or more wires.

(Additional Note 19)

The reel according to (18), wherein the two or more wires of which a part is joined are wound therearound.

(Additional Note 20)

The reel according to (19), wherein the two or more wires of which a part of the distal end side is joined are wound therearound.

(Additional Note 21)

The reel according to (19), wherein the two wires of which the part of the distal end side is twisted and joined are wound therearound.

Figure 48:
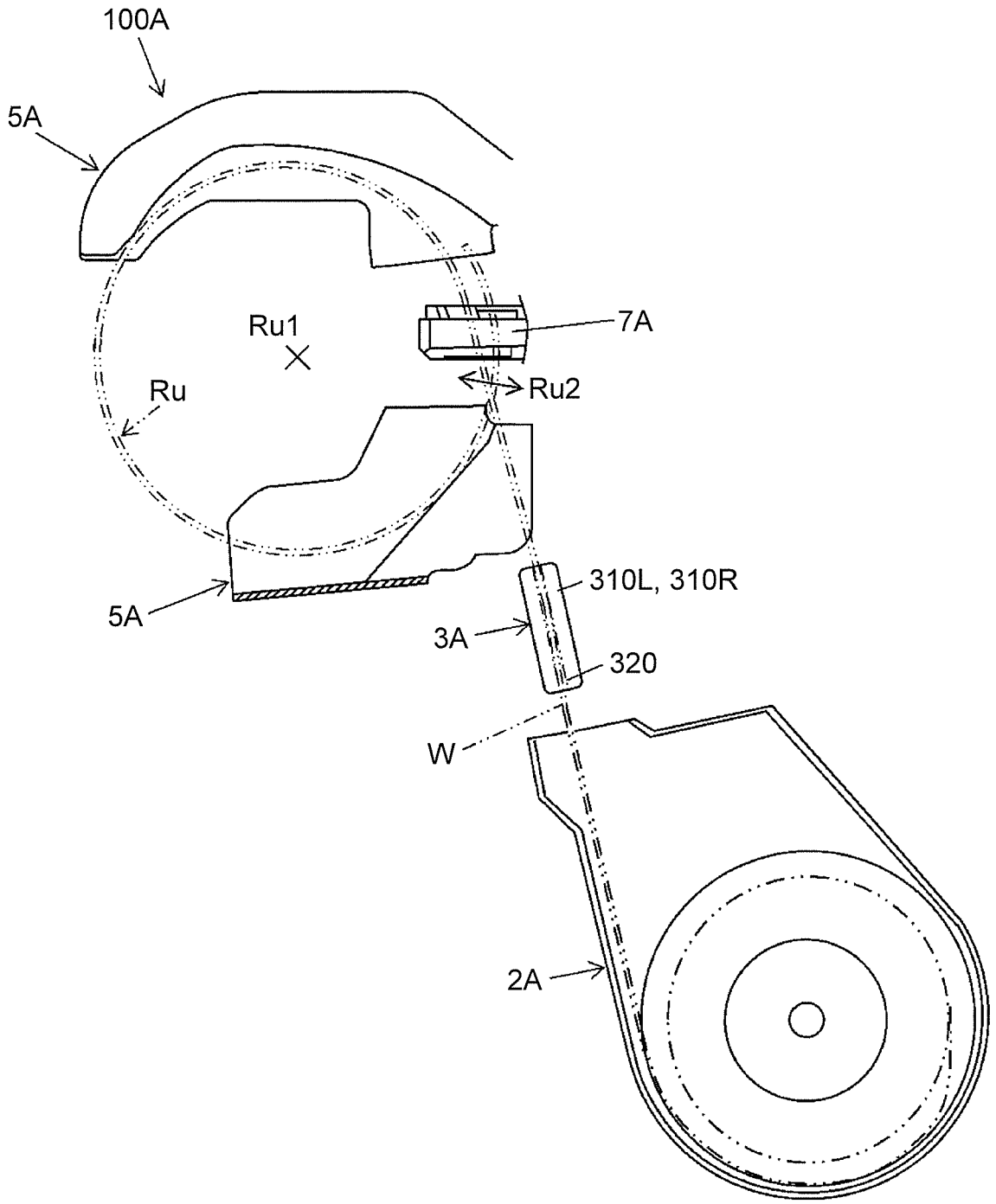
FIG. 48 is a view illustrating an example of a binding machine described in additional note 1.

Although the content described in the additional notes expresses a section or the whole of the above embodiment, supplementary explanation on the additional notes will be made below. FIG. 48 is a diagram illustrating an example of the binding machine described in additional note 1. The binding machine 100A includes a magazine (housing unit) 2A capable of drawing out two or more wires W, a wire feeding unit 3A that pinches and feeds the two or more wires W fed out from the magazine 2A, a curl guide unit 5A for curling the two or more wires W fed out by wire feeding unit 3A and winding around the binding object S1, and a binding unit 7A that grips and twists the two or more wires W wound around the binding object S1 by the curl guide unit 5A.

FIGS. 49A, 49B, 49C, and 49D are diagrams illustrating an example of the wire feeding unit described in additional note 1. The wire feeding unit 3A includes a pair of feeding members 310L and 310R. The pair of feeding members 310L and 310R are opposed to each other with the two or more parallel wires W interposed therebetween. The pair of feeding members 310L and 310R are provided with pinching portions 320 for pinching the two or more wires arranged in parallel between the pair of feeding members 310L and 310R on the outer circumferences of the pair of feeding members 310L and 310R. The opposing portions of the outer peripheral surfaces of the pair of feeding members 310L and 310R are displaced in the direction in which the wires W pinched by the pinching portion 320 extends, thereby feeding the two or more parallel wires. The pair of feeding members 310L and 310R may be provided with teeth portions on the outer peripheral surface thereof in order to transmit the driving force therebetween.

Figure 49A:
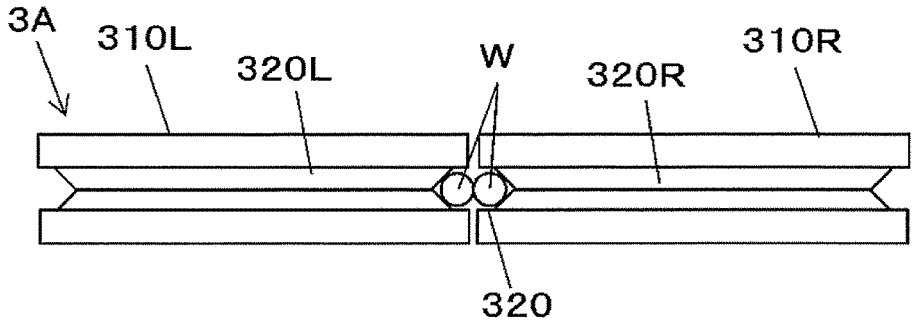
FIG. 49A is a view illustrating an example of a wire feeding unit described in additional note 1.
Figure 49B:
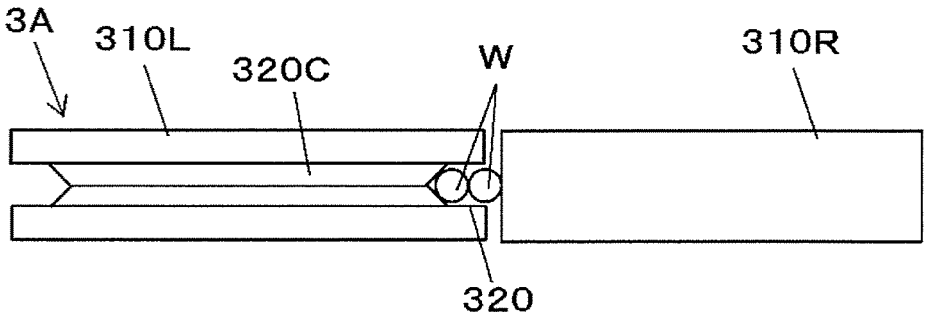
FIG. 49B is a view illustrating an example of a wire feeding unit described in additional note 1.
Figure 49C:
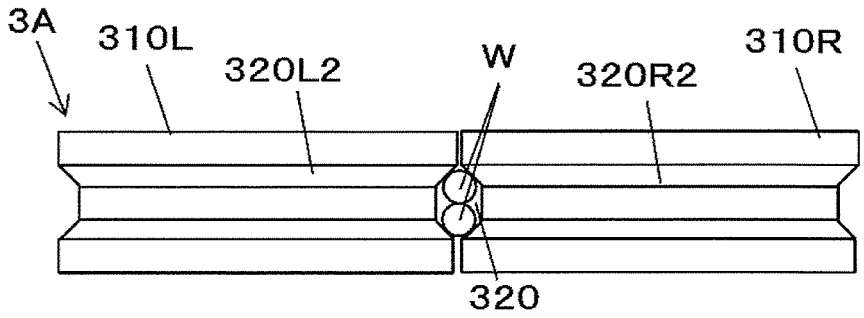
FIG. 49C is a view illustrating an example of a wire feeding unit described in additional note 1.
Figure 49D:
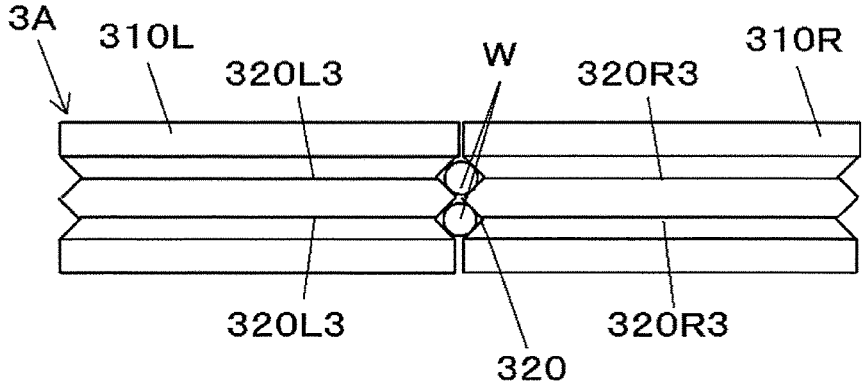
FIG. 49D is a view illustrating an example of the wire feeding unit described in additional note 1.

The pair of feeding members 310L and 310R are disk-shaped members, respectively, and are opposed to each other along the direction in which the wires W are arranged in parallel, as illustrated in FIGS. 49A and 49B. Alternatively, as illustrated in FIGS. 49C and 49D, the pair of feeding members 310L and 310R are opposed to each other in a direction orthogonal to the direction in which the wires W are arranged in parallel. The pair of feeding members 310L and 310R are biased by biasing unit (not illustrated) in a direction in which they approach each other.

As illustrated in FIG. 49A, the pinching portion 320 is provided with a groove 320L which one of the wires W arranged in parallel enters on the outer peripheral surface of one feeding member 310L, and on the outer peripheral surface of the other feeding member 310R, a groove 320R which the other of the wires W arranged in parallel enters is provided. When the pair of feeding members 310L and 310R are biased toward each other, one and the other wires W are pressed by the grooves 320L and 320R.

As illustrated in FIG. 49B, the pinching portion 320 is provided with a groove 320C which the parallel wires W enter on the outer peripheral surface of one of the pair of feeding members, in this example, one feeding member 310L. When the pair of feeding members 310L and 310R are biased toward each other, one and the other wires W are pressed by the outer circumferential surface of the other feeding member 310R and the groove 320C.

As illustrated in FIG. 49C, the pinching portion 320 is provided with a groove 320L2 which the parallel wires W enter on the outer peripheral surface of one feeding member 310L, and a groove 320R2 which the parallel wires W enter is formed on the outer peripheral surface of the other feeding member 310R. As the pair of feeding members 310L and 310R are biased toward each other, the respective wires W are pressed by the grooves 320L2 and 320R2.

As illustrated in FIG. 49D, the pinching portion 320 has grooves 320L3 which one wire W enters on the outer peripheral surface of one feeding member 310L in accordance with the number of wires W arranged in parallel, and grooves 320R3 which one wire W enters are provided on the outer peripheral surface of the other feeding member 310R in accordance with the number of wires W arranged in parallel. As the pair of feeding members 310L and 310R are biased toward each other, the respective wires W are pressed by the respective grooves 320L3 and 320R3.

As illustrated in FIGS. 48, 49A, 49B, 49C, and 49D, in the wire feeding unit 3A, in a state where two or more wires W are arranged in parallel with each other, the wires can be fed along the extending direction of the wire W. The fact that two or more wires W are fed in a state in which they are arranged in parallel with each other includes both a state in which each wire W is in contact with each other and a state in which each wire does not in contact with each other. The direction in which the wires W are arranged in parallel includes both a direction along the axial direction R1 of the loop Ru formed by the wire W and a direction orthogonal thereto.

Figure 50A:
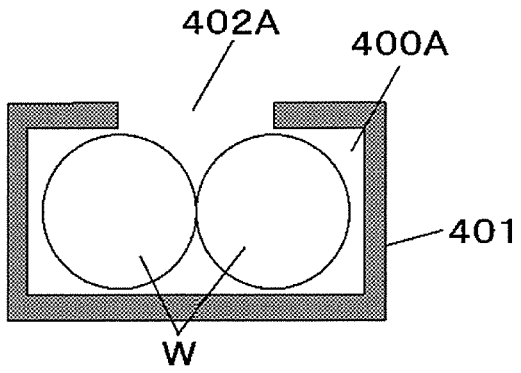
FIG. 50A is a view illustrating an example of the guide groove described in additional note 6.
Figure 50B:
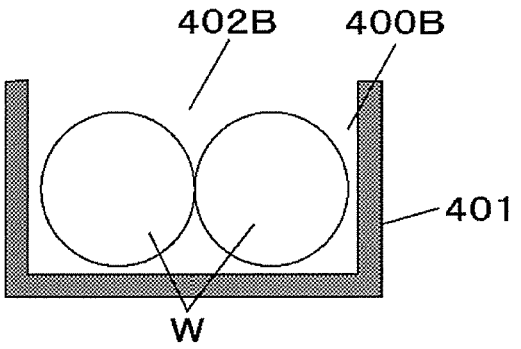
FIG. 50B is a view illustrating an example of a guide groove described in additional note 6.
Figure 50C:
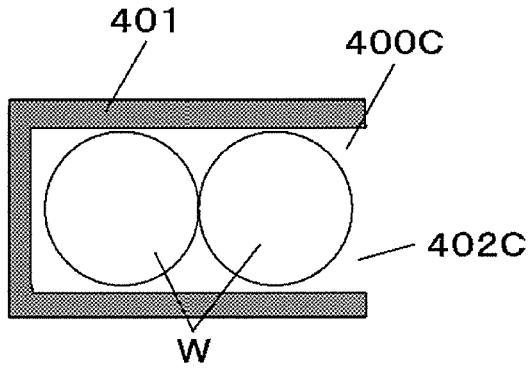
FIG. 50C is a view illustrating an example of a guide groove described in additional note 6.

FIGS. 50A, 50B, and 50C are diagrams illustrating an example of the guide groove described in additional note 6. The guide groove 400A is formed in the guide main body 401 along the feeding direction of the wire W (or the guide main body 401 itself may constitute the guide groove 400A). As illustrated in FIG. 50A, the guide groove 400A includes an opening 402A partially opened at one of two opposed sides along the parallel direction of the wires W. The opening may be provided on the other side along the parallel direction of the wires W or the opening may be provided in a part of a side orthogonal to the parallel direction of the wires W.

As illustrated in FIG. 50B, the guide groove 400B includes an opening 402B in which one side in one direction of one side out of two opposed sides along the parallel direction of the wires W is opened. As illustrated in FIG. 50C, the guide groove 400C includes an opening 402C in which a section or all of one side out of two sides orthogonal to the parallel direction of the wires W is opened.

In the configuration in which two or more guide grooves 400B are arranged along the feeding direction of the wire W, the direction of the opening 402B may be differently provided. In the configuration in which two or more guide grooves 400C are arranged along the feeding direction of the wire W, the direction of the opening 402C may be differently provided. The guide groove 400B and the guide groove 400C may be provided along the feeding direction of the wire W.

Figure 51:
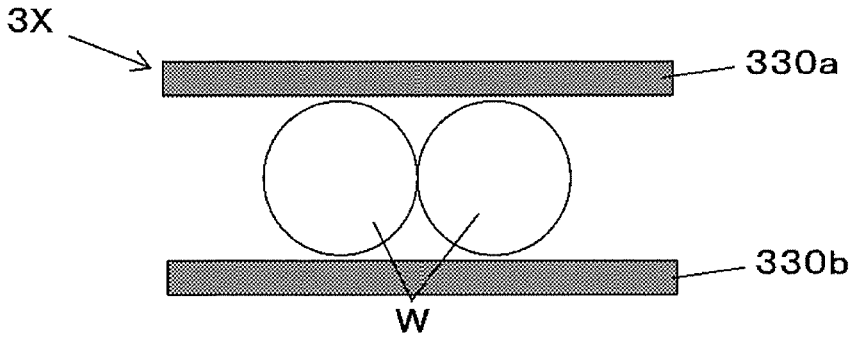
FIG. 51 is a view illustrating another example of a wire feeding unit.

FIG. 51 is a diagram illustrating another example of the wire feeding unit. The wire feeding unit 3X includes a first wall portion 330*a* and a second wall portion 330*b*. The first wall portion 330*a* and the second wall portion 330*b* are provided so as to pinch two or more wires W. The distance between the first wall portion 330*a* and the second wall portion 330*b* exceeds 1 time the diameter of the wire W and is 1.5 times or less.

By providing the first wall portion 330*a* and the second wall portion 330*b*, for example, on the upstream side of the wire feeding unit 3A illustrated in FIG. 34, it is possible to suppress that the two or more wires W fed to the wire feeding unit 3A are twisted or intersected.

This application is based upon and claims the benefit of priority from Japanese Patent Application Nos. 2015-145282 and 2015-145286 filed on Jul. 22, 2015 and Japanese Patent Application No. 2016-136066 filed on Jul. 8, 2016, the entire contents of which are incorporated herein by reference.

REFERENCE SIGNS LIST

1A: reinforcing bar binding machine
2A: magazine
20: reel
3A: wire feeding unit (wire feeding unit (feeding unit))
4A: parallel guide (restricting unit (feeding unit))
5A: curl guide unit (guide unit (feeding unit))
6A: cutting unit
7A: binding portion (binding unit)
8A: binding unit driving mechanism
30L: first feed gear
30R: second feed gear
31L: tooth portion
31La: tooth bottom circle
32L: first feed groove
32La: first inclined surface
32Lb: second inclined surface
31R: tooth portion
31Ra: tooth bottom circle
32R: second feed groove
32Ra: first inclined surface
32Rb: second inclined surface
33: driving unit
33*a*: feed motor
33*b*: transmission mechanism
34: displacement unit
4AW, 40G1, 40G2, 40G3: opening
4AG, 41G1, 41G2: guide main body
40A: sliding member (sliding unit)
42G1, 42G2: hole portion
40E: roller
44G1, 44G2: mounting hole
50: first guide unit
51: second guide unit
52: guide groove (guide unit)
53: guide pin
53*a*: retreat mechanism
54: fixed guide unit
54*a*: wall surface
55: movable guide unit
55*a*: wall surface
55*b*: shaft
60: fixed blade portion
61: rotary blade portion
61*a*: shaft
62: transmission mechanism
70: gripping unit
70C: fixed gripping member
70L: first movable gripping member
70R: second movable gripping member
71: bending portion
80: motor
81: reduction gear
82: rotary shaft
83: movable member
W: wire

The invention claimed is:

1. A binding machine comprising:

a housing that is configured to house a wire reel containing two or more wires;

a wire feeding unit that is configured to feed the two or more wires from the housing and wherein the wire feeding unit feeds the two or more wires in parallel with each other; wherein the two or more wires are movable relative to each other in directions orthogonal to a feeding direction;

a curl guide that is configured to wind the two or more wires fed from the wire feeding unit in a loop around a binding object; and a binding unit that is configured to grip and twist the two or more wires wound around the binding object to bind the binding object.

2. The binding machine according to claim 1, wherein the wire feeding unit includes a first feeding member and a second feeding member, which feed the two or more wires with the two or more wires between the first feeding member and the second feeding member, and wherein the first and second feeding members respectively include first and second facing surfaces which face each other and form a pinching portion to pinch the two or more wires between the first and second facing surfaces, and the first and second facing surfaces are displaceable in a wire feeding direction to feed the two or more wires pinched therebetween, and the pinching portion controls a direction of movement of the two or more wires in the directions orthogonal to the feeding direction while maintaining axes of the two or more wires parallel to each other and parallel to the feeding direction.

3. The binding machine according to claim 1, further comprising:

a restricting unit that is positioned between the housing and the curl guide and that is configured to restrict a direction of movement of the two or more wires, and wherein the restricting unit restricts the direction of movement of the two or more wires and is configured so as to arrange the two or more wires in parallel.

4. The binding machine according to claim 3, wherein the restricting unit includes a wire introducing portion at an inlet side and through which the two or more wires enter the restricting unit, and a wire restricting portion which restricts the direction of movement of the two or more wires entering from the wire introducing portion, and the wire introducing portion includes a larger opening than an opening of the wire restricting portion to facilitate entry of the two or more wires into the wire introducing portion.

5. The binding machine according to claim 4, wherein the opening of the wire restricting portion is formed such that a length in a first direction orthogonal to the wire feeding direction is larger than a length in a second direction orthogonal to the wire feeding direction and orthogonal to the first direction.

6. The binding machine according to claim 5, wherein the length in the first direction is larger than twice a diameter of one wire, and the length in the second direction is larger than the diameter of one wire and is smaller than twice the diameter of one wire.

7. The binding machine according to claim 6, wherein the length of the opening of the wire restricting portion in the second direction is smaller than 1.5 times the diameter of one wire.

8. The binding machine according to claim 5, wherein in the opening of the wire restricting portion, the length in the first direction is at least 1.2 times the length in the second direction.

9. The binding machine according to claim 5, wherein the opening of the wire restricting portion is configured such that an inclination of a line extending through axes of the two or more wires in the opening is 45 degrees or less with respect to the length of the opening extending in the first direction when the two or more wires is inserted therein.

10. The binding machine according to claim 9, wherein the opening of the wire restricting portion is configured such that the inclination is 15 degrees or less.

11. The binding unit according to claim 5, wherein the two or more wires are movable relative to each other, and the wire restricting portion restricts relative movement of the two or more wires such that the two or more wires are maintained in parallel with axes of the two or more wires parallel to each other.

12. The binding machine according to claim 3, wherein the restricting unit is located between the housing and the wire feeding unit.

13. The binding machine according to claim 3, wherein the restricting unit is located between the wire feeding unit and the curl guide.

14. The binding machine according to claim 13, further comprising:

a cutting unit located between the wire feeding unit and the curl guide and configured to cut the wires wound around the binding object, and wherein the restricting unit is located between the wire feeding unit and the cutting unit.

15. The binding machine according to claim 13, further comprising:

a cutting unit located between the wire feeding unit and the curl guide and configured to cut the wires wound around the binding object, wherein the restricting unit is located in or near the cutting unit.

16. The binding machine according to claim 13, further comprising:

a cutting unit located between the wire feeding unit and the curl guide and configured to cut the wires wound around the binding object, wherein the restricting unit is located between the cutting unit and the curl guide.

17. The binding machine according to claim 1, further including:

a restricting unit positioned between the housing and the curl guide;

wherein the restricting unit is configured to restrict lateral movement of the at least two wires relative to each other in a direction orthogonal to a feed direction.

18. The binding unit according to claim 17, wherein the restricting unit includes an opening having a first dimension in a first direction orthogonal to the feed direction and a second dimension orthogonal to both the first direction and the feed direction, and wherein the first dimension is at least twice a diameter of one wire and the second dimension is less than twice the diameter of one wire.

19. The binding machine according to claim 18, wherein the wire feeding unit and the binding unit form a single loop of the two or more wires simultaneously wound around the binding object, and the wires of the single loop are gripped and twisted to bind the binding object.

20. The binding machine according to claim 19, wherein the feeding unit reverses a feeding direction of the wire after forming of the single loop about the binding object to tighten the single loop of the at least two wires.

21. The binding machine according to claim 1, wherein the wire feeding unit includes a first feeding member having a first groove thereon and a second feeding member having a second groove thereon, and wherein the wire feeding unit is configured to feed the two or more wires with a first wire of the two or more wires positioned in said first groove and a second wire of the two or more wires positioned in said second groove.

22. A binding machine comprising a housing configured to house a wire reel containing two or more wires which are separate and movable relative to each other, a wire feeding unit that is configured to feed the two or more wires from the housing in parallel with each other, a curl guide that is configured to wind the two or more wires fed from the wire feeding unit in a loop around a binding object;

a binding unit that is configured to grip and twist the two or more wires wound around the binding object to bind the binding object; and a parallel guide restricting unit positioned at least one of upstream or downstream from the feeding unit, and configured to restrict movement of the two or more wires such that they are maintained in parallel to each other with axes of the two or more wires in parallel with each other and parallel to a feeding direction.

23. The binding machine according to claim 22, wherein the wire feeding unit includes a first feeding member having a first groove therein and a second feeding member having a second groove therein, and wherein the wire feeding unit is configured to feed the two or more wires with a first wire of the two or more wires positioned in said first groove and a second wire of the two or more wires positioned in said second groove; and wherein the parallel guide restricting unit includes a restricting portion having an opening with a first length in a first direction orthogonal to the feeding direction and a second length in a second direction orthogonal to the feeding direction and orthogonal to the first direction;

wherein the first length is at least twice a diameter of one wire;

wherein the second length is less than 1.5 times the diameter of one wire;

wherein the opening is configured such that an inclination of a line extending through axes of the two or more wires with respect to the first direction is 45 degrees or less.

24. A binding machine comprising:

a housing configured to house a wire reel containing two or more wires which are separate and movable relative to each other;

a wire feeding unit that is configured to feed the two or more wires from the housing in parallel with each other;

a curl guide configured to wind the two or more wires fed from the wire feeding unit in a loop around a binding object, and wherein the two or more wires are fed in the loop around the binding object in parallel and untwisted;

a binding unit that is configured to grip and twist the two or more wires after being wound around the binding object to bind the binding object;

wherein upstream of the wire feeding unit, the wires are movable relative to each other in a direction orthogonal to a wire feeding direction; and wherein the wire feeding unit includes first and second grooves configured so that a first wire of the two or more wires is held in the first groove and a second wire of the two or more wires is held in the second groove with the first and second wires in frictional contact with each other and with axes of the first and second wires in parallel to each other and parallel to the feeding direction.

* * * * *